US010284977B2

(12) United States Patent
Shen et al.

(10) Patent No.: US 10,284,977 B2
(45) Date of Patent: May 7, 2019

(54) ADJUSTABLE SECURING MECHANISM

(71) Applicant: Eargo, Inc., Mountain View, CA (US)

(72) Inventors: Daniel Shen, Palo Alto, CA (US); Michael Barrett, Campbell, CA (US); Raphael Michel, Palo Alto, CA (US); Florent Michel, Vetraz-Monthouz (FR)

(73) Assignee: Eargo, Inc., San Jose, CA (US)

( * ) Notice: Subject to any disclaimer, the term of this patent is extended or adjusted under 35 U.S.C. 154(b) by 0 days.

(21) Appl. No.: 16/105,175

(22) Filed: Aug. 20, 2018

(65) Prior Publication Data

US 2018/0359579 A1 Dec. 13, 2018

Related U.S. Application Data

(63) Continuation-in-part of application No. 15/785,731, filed on Oct. 17, 2017, which is a continuation-in-part (Continued)

(51) Int. Cl.

| | |
|---|---|
| ***H04R 25/00*** | (2006.01) |
| ***H04R 25/02*** | (2006.01) |
| *H04R 1/42* | (2006.01) |

(52) U.S. Cl.

CPC ..... *H04R 25/656* (2013.01); *H04R 25/02* (2013.01); *H04R 25/456* (2013.01); *H04R 25/48* (2013.01); *H04R 25/606* (2013.01); *H04R 25/652* (2013.01); *H04R 1/42* (2013.01); *H04R 25/604* (2013.01); *H04R 25/658* (2013.01); *H04R 2225/023* (2013.01); *H04R 2460/09* (2013.01); *H04R 2460/11* (2013.01); *H04R 2460/13* (2013.01); *H04R 2460/17* (2013.01)

(58) Field of Classification Search

CPC ..... H04R 1/42; H04R 25/02; H04R 25/48; H04R 25/456; H04R 25/604; H04R 25/606; H04R 25/652; H04R 25/656; H04R 25/658; H04R 2225/023; H04R 2460/09; H04R 2460/11; H04R 2460/13; H04R 2460/17

See application file for complete search history.

(56) References Cited

U.S. PATENT DOCUMENTS 3,156,117 A 11/1964 Benzinger
3,183,312 A 5/1965 Solomon et al.
(Continued)

FOREIGN PATENT DOCUMENTS

WO WO2013126645 8/2013

*Primary Examiner* — Brian Ensey
(74) *Attorney, Agent, or Firm* — Law Office of Alan W. Cannon

(57) ABSTRACT

Securing mechanisms for space access devices, such as an audio signal transmitting device, include a plurality of flattened members that are configured to transition from a relaxed state to a securing state when the space access device is inserted into an internal space or opening that has an inside diameter smaller than an outside diameter of the flattened members in the relaxed state. The flattened members securely engage a surface of the internal space and conform to the shape and size of the internal space. An amount of force applied by the flattened members to the surface of the internal space can be tuned by changing a stiffness of a rib supporting the flattened member.

25 Claims, 28 Drawing Sheets

Related U.S. Application Data of application No. 15/373,379, filed on Dec. 8, 2016, now Pat. No. 9,826,322, which is a continuation-in-part of application No. 15/195,100, filed on Jun. 28, 2016, now Pat. No. 9,866,978, which is a continuation of application No. 14/032,310, filed on Sep. 20, 2013, now abandoned, which is a continuation of application No. 13/865,717, filed on Apr. 18, 2013, now Pat. No. 8,577,067, which is a continuation of application No. 12/841,120, filed on Jul. 21, 2010, now Pat. No. 8,457,337.

(60) Provisional application No. 61/228,571, filed on Jul. 25, 2009, provisional application No. 61/228,588, filed on Jul. 26, 2009.

(56) References Cited

U.S. PATENT DOCUMENTS 4,870,689 A 9/1989 Weiss
5,031,219 A 7/1991 Ward et al.
5,259,032 A 11/1993 Perkins et al.
5,425,104 A 6/1995 Shennib
5,535,282 A 7/1996 Luca
5,572,594 A 11/1996 Devoe et al.
5,606,621 A 2/1997 Reiter et al.
5,654,530 A 8/1997 Sauer et al.
5,682,020 A 10/1997 Oliveira
5,691,515 A 11/1997 Landis
5,881,159 A 3/1999 Aceti et al.
5,920,636 A 7/1999 Oliveira et al.
5,979,589 A 11/1999 Aceti
5,987,146 A 11/1999 Pluvinage et al.
6,009,183 A 12/1999 Taenzer et al.
6,033,417 A 3/2000 Tseng
6,048,305 A 4/2000 Bauman et al.
6,058,198 A 5/2000 Aceti et al.
6,072,884 A 6/2000 Kates
6,097,823 A 8/2000 Kuo
6,129,174 A 10/2000 Brown et al.
6,137,889 A 10/2000 Shennib et al.
6,256,396 B1 7/2001 Cushman
6,473,513 B1 10/2002 Shennib et al.
6,879,695 B2 4/2005 Maltan et al.
6,940,989 B1 9/2005 Shennib et al.
7,016,512 B1 3/2006 Feeley et al.
7,027,608 B2 4/2006 Fretz et al.
7,076,076 B2 7/2006 Bauman
7,116,793 B2 * 10/2006 Seto ..... H04R 1/1016 381/322
7,236,605 B2 6/2007 Oliveira et al.
7,313,245 B1 12/2007 Shennib
7,362,875 B2 4/2008 Saxton et al.
7,421,086 B2 9/2008 Bauman et al.
7,480,387 B2 1/2009 Meyer et al.
7,580,537 B2 8/2009 Urso et al.
7,627,131 B2 12/2009 Nielsen et al.
7,940,946 B2 5/2011 Caldarola
8,224,005 B2 7/2012 Smith
8,457,337 B2 6/2013 Michel et al.
8,477,978 B2 7/2013 Caldarola
8,553,901 B2 10/2013 Hersbach
D693,007 S 11/2013 Michel et al.
8,577,067 B2 11/2013 Michel et al.
8,934,587 B2 1/2015 Weber
9,060,230 B2 6/2015 Michel et al.
9,167,363 B2 10/2015 Michel et al.
9,344,819 B2 5/2016 Michel et al.
9,432,781 B2 8/2016 Herscher
9,826,322 B2 11/2017 Shen et al.
2002/0027996 A1 3/2002 Leedom et al.
2002/0085728 A1 7/2002 Shennib et al.
2004/0052391 A1 3/2004 Bren et al.
2004/0081328 A1 * 4/2004 Leedom ..... A61B 5/6817 381/312
2004/0258263 A1 12/2004 Saxton et al.
2005/0096678 A1 5/2005 Olson
2005/0238192 A1 10/2005 Ford et al.
2005/0244026 A1 11/2005 Nielsen et al.
2006/0067551 A1 3/2006 Cartwright et al.
2006/0085018 A1 4/2006 Clevenger
2007/0009106 A1 1/2007 Tilson et al.
2007/0100197 A1 5/2007 Perkins et al.
2008/0137892 A1 6/2008 Shennib et al.
2008/0253596 A1 10/2008 Klinkby et al.
2009/0041279 A1 2/2009 Davis
2009/0052709 A1 2/2009 Smith
2009/0052710 A1 2/2009 Smith
2009/0074220 A1 3/2009 Shennib et al.
2011/0019851 A1 1/2011 Michel et al.
2011/0170722 A1 * 7/2011 Brimhall ..... H04R 25/60 381/322
2012/0296355 A1 11/2012 Burres
2014/0052163 A1 2/2014 Lai
2014/0219488 A1 8/2014 Michel et al.
2015/0063612 A1 3/2015 Petersen et al.
2015/0086054 A1 3/2015 Michel et al.
2015/0289064 A1 10/2015 Jensen et al.
2016/0066110 A1 3/2016 Shennib et al.
2016/0313405 A1 10/2016 Herscher
2016/0323682 A1 11/2016 Michel et al.
2017/0094426 A1 3/2017 Shen et al.
2017/0164121 A1 6/2017 Herscher et al.

* cited by examiner

ADJUSTABLE SECURING MECHANISM

CROSS-REFERENCE

This application is a continuation-in-part application of co-pending U.S. application Ser. No. 15/785,731, filed Oct. 17, 2017, which is a continuation-in-part application of U.S. application Ser. No. 15/373,379, filed Dec. 8, 2016, now U.S. Pat. No. 9,826,322, which is a continuation-in-part application of U.S. application Ser. No. 15/195,100, filed Jun. 28, 2016, now U.S. Pat. No. 9,866,978, which is a continuation of U.S. application Ser. No. 14/032,310, filed Sep. 20, 2013, now abandoned, which is a continuation of U.S. application Ser. No. 13/865,717, filed Apr. 18, 2013, now U.S. Pat. No. 8,577,067, which is a continuation of U.S. application Ser. No. 12/841,120, filed Jul. 21, 2010, now U.S. Pat. No. 8,457,337, which claims the benefit of U.S. Provisional Application No. 61/228,571, filed Jul. 27, 2009 and claims the benefit of U.S. Provisional Application No. 61/228,588, filed Jul. 26, 2009, each of which applications and patents now being incorporated herein, in its entirety, by reference thereto and to which non-provisional applications we claim priority under 35 USC § 120 and to which provisional applications we claim priority under 35 USC § 119.

U.S. application Ser. No. 15/785,731 is a continuation-in-part application of co-pending U.S. application Ser. No. 15/373,389, filed Dec. 8, 2016, which claims the benefit of U.S. Provisional Application No. 62/246,583, filed on Dec. 8, 2015, which applications are hereby incorporated herein, in their entireties, by reference thereto, and to which we claim priority under 35 U.S.C. Sections 120 and 119.

BACKGROUND OF THE INVENTION

As is well known in the art, many space access devices and systems are designed and configured to be inserted in one or more biological spaces or openings, such as an ear canal, nasal opening, etc. Such devices include hearing aids, ear phones or buds, and oxygen nasal cannula.

Various space access devices and systems are also designed and configured to be inserted in non-biological spaces or openings, such a fluid flow lines and conduits. Such devices include conduit inspection and energy, e.g. heat, generating and/or dissipating systems.

The noted devices and systems often include means of securing the devices and/or systems in internal spaces or openings for a desired period of time, e.g. 1-2 minutes, 24 hours, 1 month, 1 year, etc. Such securing means include, for example, securing rings disposed on the outer surface of the devices, compliant outer layers, and/or conical fins that are adapted to removably secure the device(s) to an interior surface of a space or opening, e.g., an ear canal.

There are, however, a number of significant drawbacks and disadvantages associated with conventional securing means; particularly when employed on audio transmitting (or receiving) devices, such as an in-ear hearing device.

A disadvantage of conventional securing means is that the securing means, e.g., securing rings and compliant outer surfaces, do not include any means for fluid flow through the device or between the securing means of device and the opening when the device is inserted therein.

Another drawback is that most of the devices employing the conventional securing means are easily dislodged.

A further drawback is that most conventional securing means do not self-adjust or self-conform to the shape of the internal space or opening when the space access device is inserted therein. Indeed, many conventional securing devices either have a preset circular shape that may conform adequately to the shape of an internal space or opening, or are custom made to conform to (or match) the shape of a space or opening.

An additional drawback is that most of the conventional securing means do not include any means for modulating the amplitude and/or frequency of audio signal transmitted through the securing means and/or space access device associated therewith and/or the space between the surface of an internal space or opening and the space access device, when the space access device is inserted therein.

Another drawback is that most conventional securing means do not provide for tuning an amount of force applied by the securing means to the surface of the internal space into which the securing means is inserted.

There are some examples of conventional devices used to secure a hearing aid to mitigate leakage of sound around the hearing aid and through the canal. Smith, in U.S. Pat. No. 8,224,005 describes a hearing aid extension in which two flanges are configured to mitigate leakage of sound around the hearing aid to which the flanges are fitted. However the hearing aids disclosed are molded to match the shape of the openings into which they are inserted. The flanges are compressible and allow one size of hearing aid to fit a larger range of sizes of ear canals, due to the compressibility of the flanges. However, the smaller the ear canal is, the greater are the forces that are applied by the flanges to the ear canal surfaces, which can lead to discomfort to the user in shorter periods of time than may be desirable. Also, since the body of the hearing aid conforms to the surfaces of the ear canal, it does not allow any air flow around any part of the hearing aid, as the hearing aid seals all along the walls of the ear canal. Also a strap is required to attach the flanges to the hearing aid.

Shennib et al., U.S. Patent Application Publication No. 2016/0066110 discloses a trenched sealing retainer for a canal hearing device in which flanges are snapped on to the end of a hearing device. The flanges are configured to seal inside the ear canal to reduce the acoustical feedback which may occur where there is acoustic leakage from an output of a receiver of the hearing device to an input of a microphone of the hearing device through an uncontrolled leakage path. The flanges are made of a compliant material and conform to the shape of the ear canal to seal it as well as to anchor the hearing device to the ear canal. Because the flanges are the sole source of anchoring, the forces applied by both sealing off and anchoring may be at a level that may become uncomfortable to the wearer in a shorter period of time then desired.

Caldarola, U.S. Pat. Nos. 7,940,946 and 8,477,978 discloses a hearing device in which an open propeller type insert or apertured dome inserts are provided to contact the ear canal. The propeller type insert does not distribute the contact forces very well about the circumference of the ear canal that it contacts, which can result is pressure spots and discomfort to the wearer. The aperture dome inserts provide continuous contact about the circumference of the dome to the ear canal and therefore cannot independently adjust the amount of force that is applied to various locations of the ear canal, such as where the ear canal may vary from a circular cross-section, for example. Also, the aperture dome inserts are limited as to the amount of open space that can be provided in them before they start to lose structural integrity.

There is a continuing need for securing means for space access devices; particularly, audio transmitting devices, that securely engage a surface of an internal space or opening for an extended period of time.

There is a continuing need to extend the fitting range of hearing assist devices so that they are useable for a wider range of the continuum of degree of hearing loss, and to provide such devices with means to conform or self-adjust to the shape of an internal space or opening There is a continuing need for devices capable of increased fitting range along the spectrum of degrees of hearing loss which include means for fluid flow through the device and/or between the device and a space or opening when the device is inserted therein and/or include means for modulating the amplitude and/or frequency of audio signals transmitted through the securing means and/or space access device associated therewith and/or the space between the surface of an internal space or opening and the space access device, when the devices are inserted in the internal space or opening, e.g., ear canal.

There is a continuing need for improved securing means for space access devices; particularly, audio transmitting devices, that (i) securely engage a surface of an internal space or opening for an extended period of time without becoming significantly uncomfortable to the wearer, (ii) include means to conform or self-adjust to the shape of an internal space or opening, include means for fluid flow through at least a portion of the device and/or between the device and a space or opening when the device is inserted therein and/or (iii) require a force for removal from the space or opening that is greater than a force needed to insert the device into the space or opening.

SUMMARY OF THE INVENTION

The present invention is directed to securing mechanisms that can be readily employed with devices and systems that are configured to be inserted in one or more biological spaces or openings, such as ear canals or non-biological spaces or openings.

According to an aspect of the present invention, a securing mechanism for an audio signal transmitting device is provided that includes: a base comprising a longitudinal axis and an outer surface; and an adjustable securing mechanism disposed on at least a portion of said base, said securing mechanism being configured to contact a surface of an internal space or opening into which the securing mechanism is inserted; the adjustable securing mechanism being configured for positioning and maintaining the base at a distance from a location along the internal space or opening; and wherein a least a portion of the adjustable securing mechanism being configured to transition from a first state to a securing state when inserted into the internal space or opening, the securing state comprising at least a portion of the adjustable securing mechanism being constrained to have a smaller dimension transverse to the longitudinal axis relative to a dimension transverse to the longitudinal axis in the first state; and wherein the adjustable securing mechanism comprises a plurality of flattened members, each of the plurality of flattened members having a flat contact surface configured to contact the surface of the internal space or opening.

In at least one embodiment, the flattened members comprise leaflets each having a length dimension extending in a direction radially outwardly from the longitudinal axis, a width dimension extending transverse to the longitudinal axis and a depth dimension extending normal to the width dimension; wherein the width dimension is greater than the depth dimension.

In at least one embodiment, the width dimension is at least eight times greater than the depth dimension.

In at least one embodiment, the depth dimension has a value in the range from 0.05 mm to 2 mm.

In at least one embodiment, the depth dimension has a value in the range from 0.1 mm to 0.7 mm.

In at least one embodiment, the flattened members each further comprise a rib extending in a lengthwise direction of the flattened member.

In at least one embodiment, the rib protrudes from a surface opposite the flat contact surface.

In at least one embodiment, the securing mechanism is installed on an in-the-ear hearing aid.

In at least one embodiment, the securing mechanism is installed on an earpiece speaker.

In at least one embodiment, the adjustable securing mechanism is configured to modulate at least one of an amplitude and a frequency of audio signals transmitted through the internal space or opening when the securing means is secured in the internal space or opening.

In at least one embodiment, the adjustable securing mechanism provides differential acoustic impedance when inserted in the internal space or opening.

In at least one embodiment, the securing mechanism further includes a sound blocking portion disposed on at least another portion of the base; the sound blocking portion being configured to seal circumferentially around the surface of the internal space or opening, In another aspect of the present invention, a securing mechanism for an audio signal transmitting device includes: a base comprising a longitudinal axis and an outer surface; and an adjustable securing mechanism disposed on at least a portion of the base, the securing mechanism being configured to contact a surface of an internal space or opening into which the securing mechanism is inserted; wherein the adjustable securing mechanism comprises a row of leaflets arranged circumferentially around the base and separated by gaps; wherein the gaps may extend fully or partially to the base; wherein each leaflet has a length dimension extending in a direction radially outwardly from the longitudinal axis, a width dimension extending transverse to the longitudinal axis, a depth dimension extending normal to the width dimension and a flat contact surface configured to contact the surface of the internal space or opening; and wherein the width dimension is greater than the depth dimension.

In at least one embodiment, a plurality of the rows are provided, wherein adjacent ones of the plurality of rows are spaced apart from one another in a direction along the longitudinal axis, forming spaces between the rows.

In at least one embodiment, the gaps in a first of the rows are overlapped by the leaflets of an immediately adjacent row by an amount greater than 30% of the gap, in a direction aligned with the longitudinal axis; wherein the gaps, in combination with the spaces between the rows, form non-straight through channels relative to the longitudinal axis when the securing mechanism is positioned in the internal space or opening.

In at least one embodiment, the gaps in the first row are overlapped 100% by the leaflets of the immediately adjacent row.

In at least one embodiment, each leaflet further comprises a rib extending in a lengthwise direction of the leaflet.

In at least one embodiment, the adjustable securing mechanism is configured to perform at least one of: differential acoustic impedance of; modulation of an amplitude of, or modulation of a frequency of audio signals transmitted through the internal space or opening when the securing means is secured in the internal space or opening.

In another aspect of the present invention, a kit comprising a plurality of securing mechanisms for an audio signal transmitting device is provided, wherein each securing mechanism includes: a base comprising a longitudinal axis and an outer surface; and an adjustable securing mechanism disposed on at least a portion of the base, the securing mechanism being configured to contact a surface of an internal space or opening into which the securing mechanism is inserted; wherein the adjustable securing mechanism comprises a row of leaflets arranged circumferentially around the base and separated by gaps; wherein the gaps may extend fully or partially to the base; wherein each leaflet has a length dimension extending in a direction radially outwardly from the longitudinal axis, a width dimension extending transverse to the longitudinal axis, a depth dimension extending normal to the width dimension, a flat contact surface configured to contact the surface of the internal space or opening and a rib extending in a length direction of the leaflet; wherein the width dimension is greater than the depth dimension; wherein the ribs of each securing mechanism have stiffnesses different from the ribs of at least one other of the securing mechanisms.

In at least one embodiment, each of the adjustable securing mechanisms is configured to perform at least one of: differential acoustic impedance of; modulation of an amplitude of, or modulation of a frequency of audio signals transmitted through the internal space or opening when the securing mechanism is secured in the internal space or opening; and wherein an amount of the at least one of differential acoustic impedance, modulation of amplitude and/or modulation of frequency of audio signals provided by each the securing mechanism is different from an amount of the at least one of differential acoustic impedance, modulation of amplitude and/or modulation of frequency of audio signals by each of the others of the securing mechanisms.

In at least one embodiment, each of the adjustable securing mechanisms comprises a plurality of the rows, wherein the rows are separated by spaces in a direction along the longitudinal axis.

In at least one embodiment, the depth dimension of the leaflets of one of the securing mechanisms is different from a depth dimension of the leaflets of another of the securing mechanisms.

In at least one embodiment, the depth dimension of a leaflet varies along the length of the leaflet.

In another aspect of the present invention a method of changing an amount of force applied by a securing mechanism to a surface of an internal space or opening is provided, the method including: providing the audio signal transmitting device with a first securing mechanism attached thereto and configured to contact the surface of the internal space or opening into which the securing mechanism is inserted, wherein the first securing mechanism comprises first leaflets arranged circumferentially around a first base and separated by first gaps; wherein each first leaflet has a first length dimension extending in a direction radially outwardly from a longitudinal axis of the first securing mechanism, a first width dimension extending transverse to the longitudinal axis, a first depth dimension extending normal to the first width dimension, a first flat contact surface configured to contact the surface of the internal space or opening and a first rib extending in a length direction of the first leaflet; wherein the first width dimension is greater than the first depth dimension; removing the first securing mechanism from the audio signal transmitting device; and attaching a second securing mechanism to the audio signal transmitting device, wherein the second securing mechanism comprises second leaflets arranged circumferentially around a second base and separated by gaps; wherein the gaps may extend fully or partially to the base; wherein each second leaflet has a second length dimension extending in a direction radially outwardly from a longitudinal axis of the second securing mechanism, a second width dimension extending transverse to the longitudinal axis, a second depth dimension extending normal to the second width dimension, a second flat contact surface configured to contact the surface of the internal space or opening and a second rib extending in a length direction of the second leaflet; wherein the second width dimension is greater than the second depth dimension; and wherein the first rib has a first stiffness, the second rib has a second stiffness, and the first stiffness is unequal to the second stiffness.

These and other features of the invention will become apparent to those persons skilled in the art upon reading the details of the invention as more fully described below.

BRIEF DESCRIPTION OF THE DRAWINGS

In the course of the detailed description to follow, reference will be made to the attached drawings. These drawings show different aspects of the present invention and, where appropriate, reference numerals illustrating like structures, components, materials and/or elements in different figures are labeled similarly. It is understood that various combinations of the structures, components, materials and/or elements, other than those specifically shown, are contemplated and are within the scope of the present invention.

FIG. 5 is a front view of the securing mechanism shown in FIG. 4, i.e., in the constrained configuration referred to.

DETAILED DESCRIPTION OF THE INVENTION

Figure 1A:
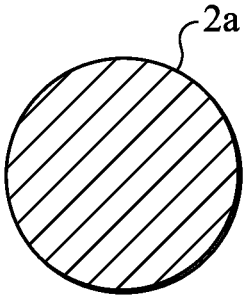
FIGS. 1A-1F show views of several embodiments of cross-sectional shapes of securing mechanism members, according to an aspect of the present invention.

Before the present systems, devices, mechanisms and methods are described, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

It is also to be understood that, although the securing mechanism structures and systems of the invention are illustrated and described in connection with in-ear hearing devices, the securing mechanism structures and systems of the invention are not limited to in-ear hearing devices and systems. According to the invention, the securing mechanism structures and systems of the invention can be employed on any anatomical, i.e. biological, space access device or system, e.g. an in-ear head set, and non-biological space access device or system, e.g., inspection systems for fluid flow pipes and/or conduits, etc.

It is also to be understood that the terminology used herein is for the purpose of describing particular embodiments of the invention only and is not intended to be limiting.

Unless defined otherwise, all technical and scientific terms used herein have the same meaning as commonly understood by one having ordinary skill in the art to which the invention pertains.

Further, all publications, patents and patent applications cited herein, whether supra or infra, are hereby incorporated by reference in their entirety.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Although any methods and materials similar or equivalent to those described herein can be used in the practice or testing of the present invention, the preferred methods and materials are now described.

It must be noted that as used herein and in the appended claims, the singular forms "a", "an", and "the" include plural referents unless the context clearly dictates otherwise. Thus, for example, reference to "a row" includes a plurality of such rows and reference to "the leaflet" includes reference to one or more leaflets and equivalents thereof known to those skilled in the art, and so forth.

The publications discussed herein are provided solely for their disclosure prior to the filing date of the present application. The dates of publication provided may be different from the actual publication dates which may need to be independently confirmed.

Definitions

The term "outwardly projecting member", as used in connection with a securing mechanism of the invention, means and includes any projection extending from a base member, including, without limitation, fins, bristles, blades, leaflets, leaves, flattened members, protrusions, ridges, grooves, bubbles, balloons, hooks, looped structure, disks and/or tubes.

The term "radially outwardly" refers to a direction extending from a central axis of a body toward an external wall of the body. When a leaflet is described as having a length dimension that extends radially outwardly from the longitudinal axis, the extension may be in a plane that is normal to the longitudinal axis, or it may be at an angle relative to the plane that is normal to the longitudinal axis.

The term "space access device", as used herein, means and includes audio signal transmitting devices, including but not limited to anatomical or biological and non-biological devices that are designed and adapted to be inserted into a space or opening, such as an ear canal, nasal conduit, esophagus, airway, gastro-intestinal tract, blood vessel, pipe, or conduit.

The terms "frequency modulation", "modulate a frequency" and the like, as used herein, mean and include modulation of the frequency of a transmitted audio signal. Thus, "frequency modulation" or "modulate a frequency", as used in connection with a securing mechanism of the invention, means and includes modulating the frequency of an audio signal that is transmitted from an external source, wherein the audio signal has a first frequency at a first external reference point and, after transmission through a securing mechanism of the invention, has an adjusted second frequency at a second reference point, wherein the adjusted second frequency is unequal to the first frequency.

The term "overlap" as used herein, refers to two objects or portions thereof existing along a straight line or pathway at different locations of the line or pathway. For example, when one portion of a skirt "overlaps" another portion of a skirt, this overlap blocks a pathway in a direction along a longitudinal axis of a securing mechanism/hearing device. The overlapping portions serve to block sound transmission along the pathway where the portions overlap. In some embodiments, the securing members of different rows of securing members overlap one another. In these examples, a restricted airflow pathway typically remains between the overlapping securing members of different rows. In the case of overlapping skirts, the overlapped portions contact one another and do not allow airflow through the contacted, overlapped portions. In the case of leaflets that include ribs, the rib portions of the leaflets do not overlap, only flat portions of the leaflets overlap.

The terms "amplitude modulation", "modulate an amplitude" and the like, as used herein, mean and include modulation of the amplitude of a transmitted audio signal. Thus, "amplitude modulation" or "modulate an amplitude", as used in connection with a securing mechanism of the invention, means and includes modulating the amplitude of an audio signal that is transmitted from an external source, wherein the audio signal has a first amplitude at a first external reference point and, after transmission through a securing mechanism of the invention, has an adjusted second amplitude at a second reference point, wherein the adjusted second amplitude is unequal to the first amplitude.

The terms "headphone" and "headset" are used interchangeably herein and mean and include a listening device that is adapted to receive transmitted sound via wireless or wired communication means. As is well known in the art, conventional headphones and headsets typically include one or more speakers and/or sound production components, which can be in the form of one or two earpieces (often referred to as "ear plugs" or "ear buds").

The term "differential acoustic impedance" as used herein, means and includes a property, configuration or function that causes different wavelengths of an audio signal to be differentially impeded. Typically, for the embodiments describe herein the devices and/or securing mechanisms, when providing differential acoustic impedance impeded the high frequencies of the signal to a greater extent than the degree to which mid and low range frequencies are impeded. Optionally, mid-range frequencies may be impeded more than the low range frequencies, but still less than the high range frequencies. Approximate dividing lines between the different ranges referred to are: high range: 2 kHz and above; midrange: 500 Hz to 2 kHz; and low range: below 500 Hz.

The terms "pharmacological agent", "active agent", "drug" and "active agent formulation" are used interchangeably herein, and mean and include an agent, drug, compound, composition of matter or mixture thereof, including its formulation, which provides some therapeutic, often beneficial, effect. This includes any physiologically or pharmacologically active substance that produces a localized or systemic effect or effects in animals, including warm blooded mammals, humans and primates, avians, domestic household or farm animals, such as cats, dogs, sheep, goats, cattle, horses and pigs; laboratory animals, such as mice, rats and guinea pigs; reptiles, zoo and wild animals, and the like. One or more of the components described herein may be coated with or otherwise provided with one or more pharmacological agents.

The terms "pharmacological agent", "active agent", "drug" and "active agent formulation" thus mean and include, without limitation, antibiotics, anti-viral agents, analgesics, steroidal anti-inflammatories, non-steroidal anti-inflammatories, anti-neoplastics, anti-spasmodics, modulators of cell-extracellular matrix interactions, proteins, hormones, enzymes and enzyme inhibitors, anticoagulants and/or antithrombotic agents, DNA, RNA, modified DNA and RNA, NSAIDs, inhibitors of DNA, RNA or protein synthesis, polypeptides, oligonucleotides, polynucleotides, nucleoproteins, compounds modulating cell migration, compounds modulating proliferation and growth of tissue, and vasodilating agents.

The following disclosure is provided to further explain in an enabling fashion the best modes of performing one or more embodiments of the present invention. The disclosure is further offered to enhance an understanding of and appreciation for the inventive principles and advantages thereof, rather than to limit in any manner the invention. The invention is defined solely by the appended claims including any amendments made during the pendency of this application and all equivalents of those claims as issued.

As will readily be appreciated by one having ordinary skill in the art, the present invention substantially reduces or eliminates the disadvantages and drawbacks associated with conventional securing means for space access devices.

In overview, one aspect of the present invention is directed to securing mechanisms that can be readily employed with devices and systems that are configured to be inserted in one or more biological spaces or openings, such as an ear canal.

As discussed in detail below, according to an aspect of the invention, the securing mechanisms may include at least one, more preferably, a plurality of outwardly projecting securing members (e.g., flattened members, leaflets and/or alternative securing members described herein) that are configured to transition from a relaxed state to a securing state when a space access device employing such a securing mechanism is disposed in an internal space or opening, wherein the securing members and, hence securing mechanisms (i) securely engage a surface of the internal space or opening, (ii) conform to the shape and size of an internal space or opening, (iii) may modulate pressure waves or audio signals through the securing member, (iv) may block or partially block pressure waves or audio signals from feeding back from a distal end of a space access device to a proximal end of the space access device and/or block or partially block pressure waves or audio signals from feeding from a proximal end portion of the space access device along a path external to the space access device, to a distal end of the space access device, preferably without fully occluding the internal space or opening.

Figure 1B:
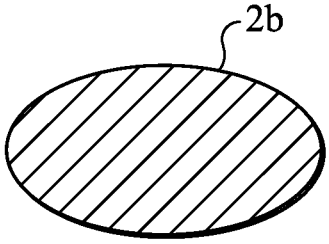
Figure 1C:
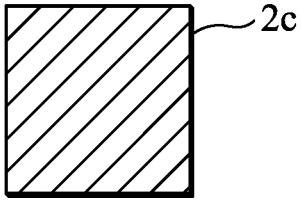
Figure 1D:
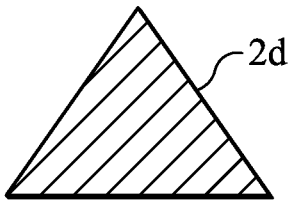
Figure 1E:
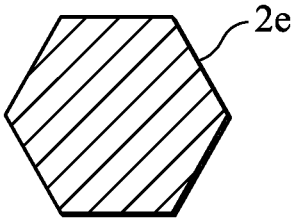
Figure 1F:
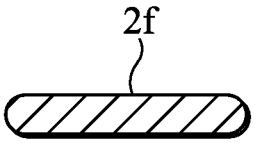

As illustrated in FIGS. 1A through 1F, according to an aspect of the invention, the members may comprise various cross-sectional shapes, including, but not limited to cylindrical 2*a*, as shown in FIG. 1A, elliptical 2*b*, as shown in FIG. 1B, square 2*c*, as shown in FIG. 1C, triangular 2*d*, as shown in FIG. 1D, hexagonal 2*e*, as shown in FIG. 1E or flat 2F, as shown in FIG. 1F. It is noted that the members, including bristle members and other types of members are not limited to these cross-sectional shapes, as the cross-sectional shape may be irregular, flat but v-shaped (i.e. two flat segments joining), flat with a circular or partially circular component, or other shape. For example, the bristle members 40 in FIGS. 15-22 have a cross-section shape that is partially flat and partially V-shaped, with a circular portion intervening, as can be discerned from the end view thereof in FIG. 17. Further, the leaflets in FIGS. 32-38 have a cross-section that is similar to that of FIG. 1F, except that it further includes the rib that protrudes from the surface opposite the contact surface. The rib in FIGS. 32-38 comprises a rounded cross-sectional component of the cross-section of the leaflet, such as a hemispherical or otherwise rounded section. Alternatively, the rib could have other cross-sectional shapes that partially or fully protrude from the flat portion of the surface, including, but not limited to oval, elliptical, square, triangular, hexagonal, polygonal or irregular.

According to the invention, the space access devices of the invention, e.g., 10*a*, 10*b*, 10*c*, 10*d*, 10*e*, 10*f* and/or 10*g* can comprise any device that is designed to be inserted into a biological space or opening, such as an ear canal, nasal opening, etc. (see, for example, FIG. 14).

In some embodiments of the invention, the space access device includes an electronics-containing portion or region 14 (see, e.g., FIG. 2) that is adapted to receive various electronic components and associated circuitry, such as sensor systems, receivers, amplifiers, batteries, antennae, speakers, energy generating and dissipating means, microphones, sensors, communication modules, pressure sensors, wireless communication components, wired communication components, etc., or is attached to a device having such electronics-containing portion.

The space access devices of the invention can thus comprise various conventional anatomical and non-anatomical devices and systems, such as physiological sensors, conduit inspection systems, flow sensors, flow restrictors, fluid samplers, pressure sensors, sound or vibration actuators, accelerometers, and mechanisms for releasing particles or fluids into conduits or other fluids, etc. The space access devices can also comprise a radio system or component thereof, e.g., receiver, transmitter, transceiver, microphone, microcontroller, etc.

Figure 2:
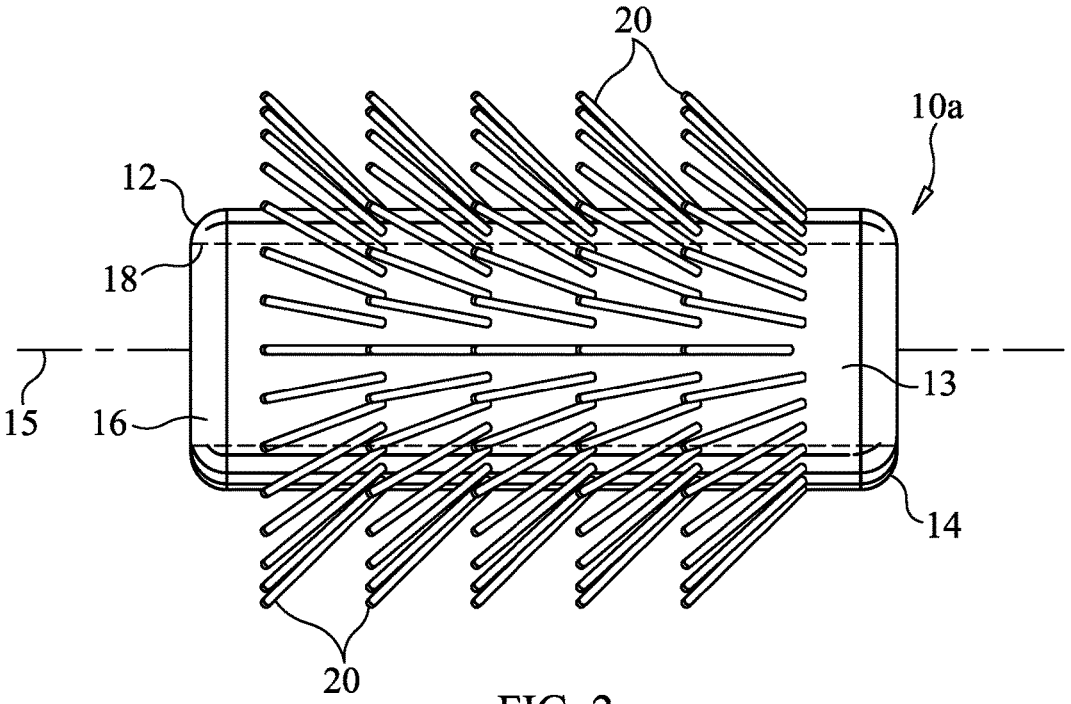
FIG. 2 is a side view of a securing mechanism, according to an embodiment of the present invention.
Figure 10:
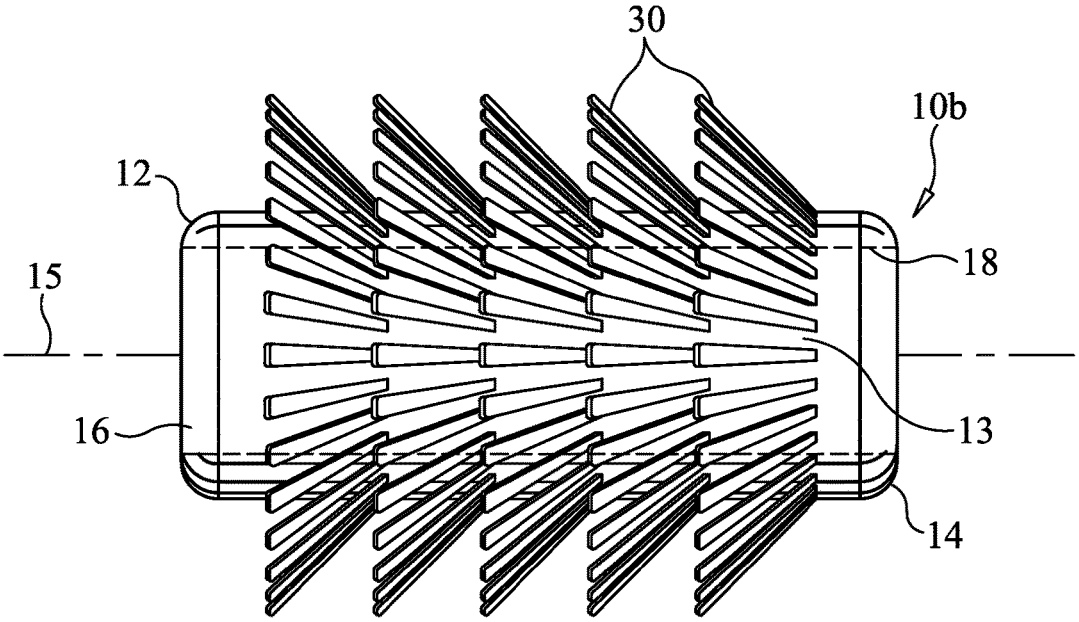
FIG. 10 is a side view of another embodiment of a securing mechanism, according to an aspect of the present invention.
Figure 11:
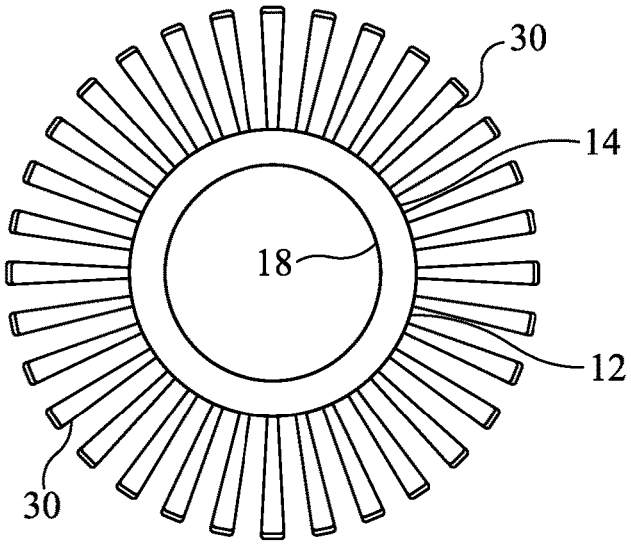
FIG. 11 is a front view of the securing mechanism shown in FIG. 10.
Figure 12:
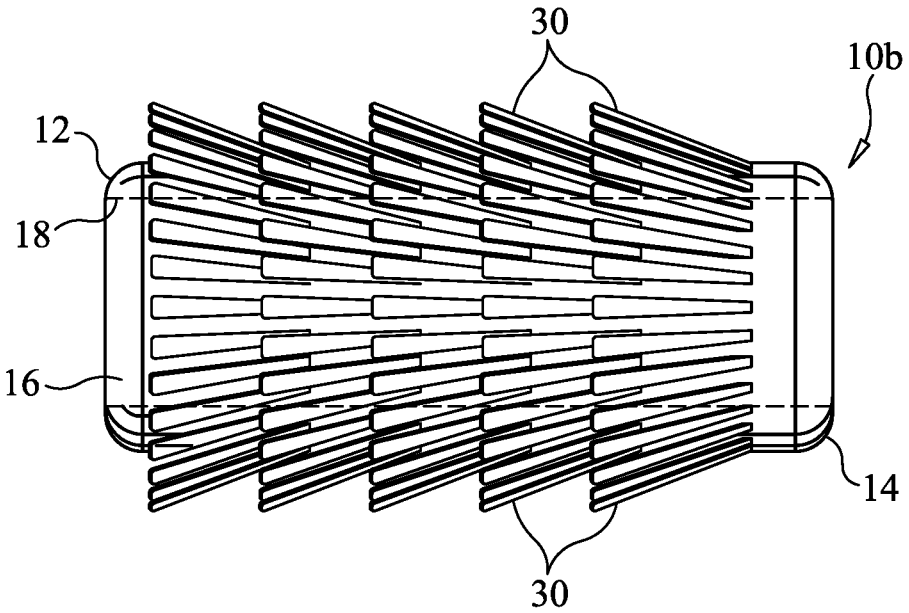
FIG. 12 is a side view of the securing mechanism shown in FIG. 10, but in a constrained configuration, according to an aspect of the present invention.
Figure 13:
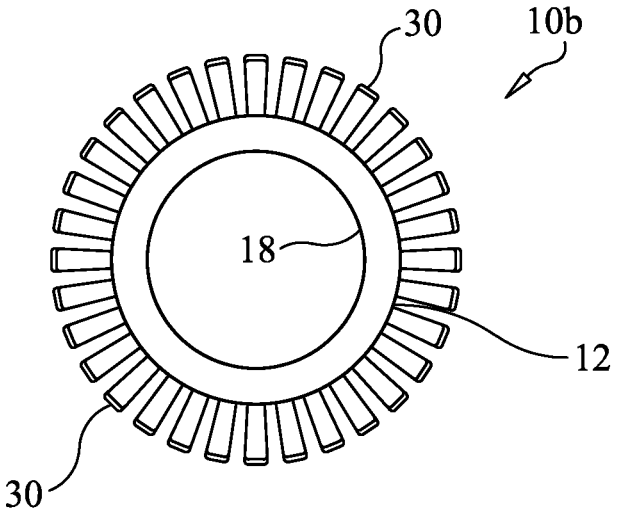
FIG. 13 is a front view of the securing mechanism in a constrained configuration shown in FIG. 12.

According to an aspect of the invention, the outwardly projecting members, such as leaflets or other bristle members can comprise separate members, i.e., engaged to a base member, or integral members that are integral with the base member and project outwardly from the base member as illustrated, for example, in FIGS. 2 and 10 by bristles 20 and 30, respectively, relative to base member 16.

As set forth in detail in U.S. Pat. No. 8,457,337 to which the present application claims priority and which is expressly incorporated by reference herein in its entirety, the space access devices can also comprise a hearing apparatus, such as a hearing prosthesis or aid.

Figure 22:
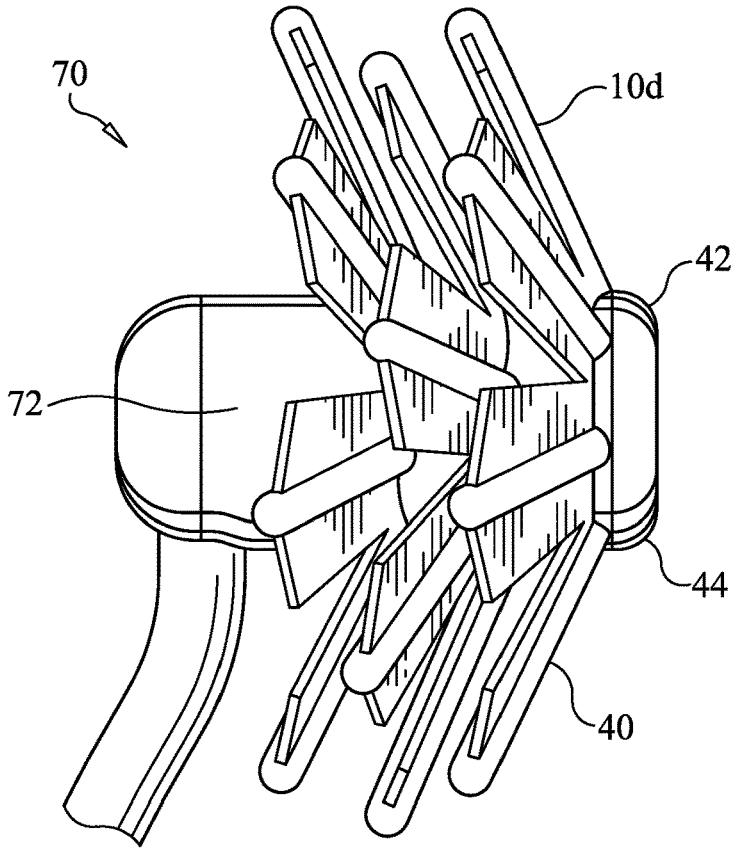
FIG. 22 is a side view of an earpiece speaker system having the securing mechanism shown in FIG. 15 disposed on the earpiece speaker system, according to an aspect of the present invention.
Figure 38:
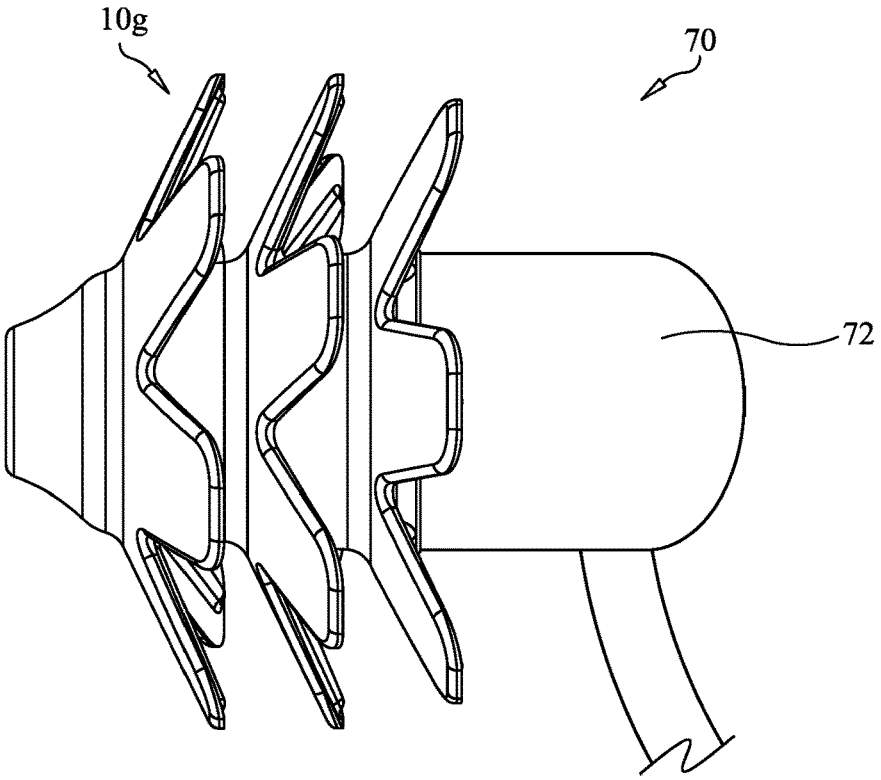
FIG. 38 is a side view of an earpiece speaker system having the securing mechanism shown in FIG. 32 disposed on the earpiece speaker system, according to an aspect of the present invention.

The space access devices can additionally comprise headphones or a headset for a portable electronic device, such as a GPS device, CD or DVD player, MPEG player, MP-3 player, cell phone, personal digital assistant (PDA), tablet, laptop, video game system, audio guide system, phone, musical instrument, stethoscope and other medical or industrial instrumentation, smart phone, computer, etc., and/or a combination thereof. FIGS. 22 and 38 show embodiments according to the present invention wherein the space access device 70 comprises securing mechanism 10*d* or 10*g* attached to headphones or headset 72. Only one headphone 72 is shown, for simplicity of illustration, but typically a pair of such headphones 72 would be provided, each with a securing mechanism 10*d*/10*g* attached or attachable thereto. In the embodiments shown in FIGS. 22 and 38, the securing mechanism is removably attached to the headphone 72, but alternatively may be permanently attached thereto or integral therewith. Further alternatively, any of the other securing mechanisms 10*a*, 10*b*, 10*c*, 10*e* and 10*f* described herein may be similarly attached to headphones 72 in any of the same manners.

The space access devices can also comprise headphones (or a headset) for augmented reality glasses, head-mounted displays, and/or heads-up displays.

There are a wide variety of headset types, including over-ear headsets, around-ear headsets, on ear headsets, in-concha headsets, in-ear headsets, etc. Each type of head set has advantages and disadvantages with regard to sound quality, ease of use, aesthetics, user comfort, etc.

Two popular headset designs are the in-concha headset and the in-ear headset. The in-concha headset design generally includes a speaker that is, when properly positioned, received within the concha of the ear of a user (generally the area of the ear surrounding the opening of the ear canal). The in-ear headset design generally includes a speaker and/or insert that is at least partially received within the ear canal of a user when properly positioned. These designs are typically compact and are often supported by a small structure that is secured to the external portion of the ear (e.g., with an ear hook) and/or supported and/or retained within the ear by the concha or ear canal in what amounts to an interference fit.

A major drawback of both the in-concha and in-ear headsets is that wearers often experience discomfort after a period of time of use. The discomfort can be due to one or more of the fitment or breathability of the headset, the type of material of which the headset is composed, the pressure of the headset on the surface of the ear canal, or simply sensitive ears.

A further drawback of in-concha and in-ear headsets is that they are also easily dislodged during various activities of the wearer, e.g., jogging.

A further drawback of in-concha and in-ear headsets is that they often fail at maintaining a good alignment between the speaker and the ear canal, which may result in inconsistent sound quality and/or sound volume.

Another drawback is that some headsets require components that need to be molded for a specific user to achieve the desired fit.

By employing a securing mechanism of the invention with in-concha and in-ear headsets the noted discomfort can, however, be substantially reduced or eliminated. The securing mechanism will also enhance the engagement and hold of the head set in the concha or ear canal(s). The securing mechanism will also enhance the alignment of the headset with the ear canal(s). The securing mechanism will also enhance the ability to allow air flow around at least a portion of the securing mechanism.

Figure 3:
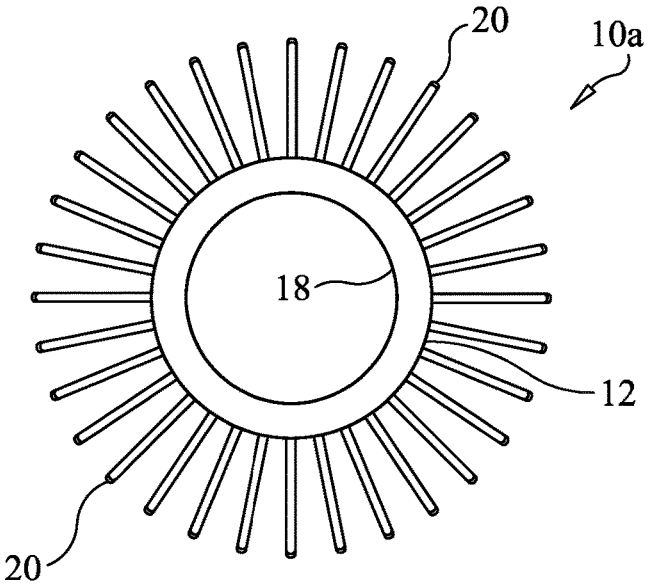
FIG. 3 is a front view of the securing mechanism shown in FIG. 2.

FIG. 2 shows a side view and FIG. 3 shows an end view (viewed at the proximal end 18) of a securing mechanism 10*a*, according to an embodiment of the present invention. The securing mechanism 10*a*, as noted above may be used to secure any space access device including, but not limited to hearing aids, speaker systems, other biological, space access devices or systems, and non-biological space access device or system, e.g., inspection systems for fluid flow pipes and/or conduits, etc.

One or more of the parts described may be integrated into one component or integrally connected. For example, a securing part may be integrally formed with a base member or housing. They may be connected as an integral piece or separate portions.

The base 16 of the securing mechanism may have a cylindrical shape, as illustrated in FIGS. 2-3, with a lumen 18 (in this example, an annulus, since the cross-section of the lumen 18 is circular in this embodiment) configured and dimensioned to allow the securing mechanism 10*a* to be slid over and attached to a portion of the body of a space access device. For example, the space access device 10 of FIG. 6 has a cylindrically-shaped body portion 64 that is configured and dimensioned to receive securing mechanism 20*a* slidably thereover. A lip 64L is provided on an end portion of the body portion 64 that has an outside diameter, in an un-deformed state, that is greater than an inside diameter of the lumen 18 in an un-deformed state. In a preferred embodiment, lip 64L is made of a resiliently compressible material (such as silicone or other elastomer) that allows it to be compressed to a smaller outside diameter as the securing mechanism 10*a* is slid thereover. Typically, the securing mechanism 18 would be passed over the lip 64L and portion 64 starting from end 12 and ending at end 14. Once end 14 passes over and clears lip 64L, lip 64L resiliently expands to its un-deformed condition, thereby securing the securing mechanism 10*a* on the body portion 64, not to be removed without a substantial pulling force being applied thereto, wherein the substantial pulling force is at least two times greater or three times greater or four times greater or more than four times greater than any pulling force that would be experienced when removing the space access device as a whole from its position within an internal space or opening.

Alternatively, the lumen 18 may expand to allow it to pass over the lip 64L and then resiliently contract once it has passed over the lip 64L. Further alternatively, there may be a combination action, wherein the lumen 18 expands and the lip 64L compresses when then the securing mechanism 18 passes thereover and then the lumen 18 contracts and the lip 64L expands when the lumen 18 and lip 64L are no longer contacting each other.

Securement of the securing mechanism 10*a*, 10*b*, 10*c*, 10*d*, 10*e*, 10*f* or 10*g* is not limited to the mechanism described above, as securement can be accomplished by a simple friction fit of the components, for example. Further alternatively, additional frictional and/or mechanical interlock enhancements may be provided to facilitate securement, including, but not limited to: tongue and groove features, bayonet-type mechanisms, snap fit, ball and detent arrangements, etc.

The lumen 18 and the portion 64 need not be circular in cross-section, but typically do provide cross-sections that have a mating fit as the securing mechanism 10*a*, 10*b*, 10*c*, 10*d*, 10*e*, 10*f* or 10*g* is slid over the body of the space access device. Thus the cross-sectional shapes may be any of the shapes 2*a*-2*f* described above with regard to shapes of members such as bristles, or any other shapes that allow mateability and slidability of the securing mechanism relative to the body of the space access device, including but not limited to a circular shape, elliptical shape, any polygonal shape, or regular or irregular shape.

Securing mechanism 10*a* (FIG. 2), 10*b* (FIG. 10), 10*c* (FIG. 8), 10*d* (FIG. 15), 10*e* (FIG. 24A), 10*f* (FIG. 25A-25C) or 10*g* (FIG. 32) may secure a space access device that may include an audio signal transmitting device and/or any of the types of space access devices previously mentioned and/or mentioned below. Securing mechanism 10*a*, 10*b*, 10*c*, 10*d*, 10*e*, 10*f*, 10*g* may include adjustable securing members 20 (FIGS. 2, 8), 30 (FIG. 10), 40 (FIG. 15), 120 (FIG. 24A), 60 (FIGS. 25A-25*c*), 160 (FIG. 32) that form an adjustable securing portion and which may be outwardly projecting members that include, but are not limited to, one or more of fins, bristles, blades, leaflets, leaves, flattened members, protrusions, ridges, grooves, bubbles, balloons, hooks, looped structure, disks, and/or tubes.

The adjustable securing portion, 20, 30, 40, 120, 130, 160 is disposed on at least a portion of the base 16 and is configured to contact a surface of an internal space or opening into which said securing mechanism 10*a*, 10*b*, 10*c*, 10*d*, 10*e*, 10*f*, 10*g* is inserted.

The securing portion, by action of the adjustable, outwardly projecting members 20, 30, 40, 120, 130, 160 is configured for positioning and maintaining the base 16 (and a space access device when the securing mechanism is mounted thereon) at a distance from a location along the internal space or opening. Thus, for example, when the securing mechanism is mounted on or attached to an in-ear hearing aid, the adjustable, outwardly projecting members adjust so as to keep the base 16 and the space access securing device located in the internal space or opening so that a distance or gap is provided between the base 16 and the space access device at all locations 360 degrees about the base and space access device.

Figure 14:
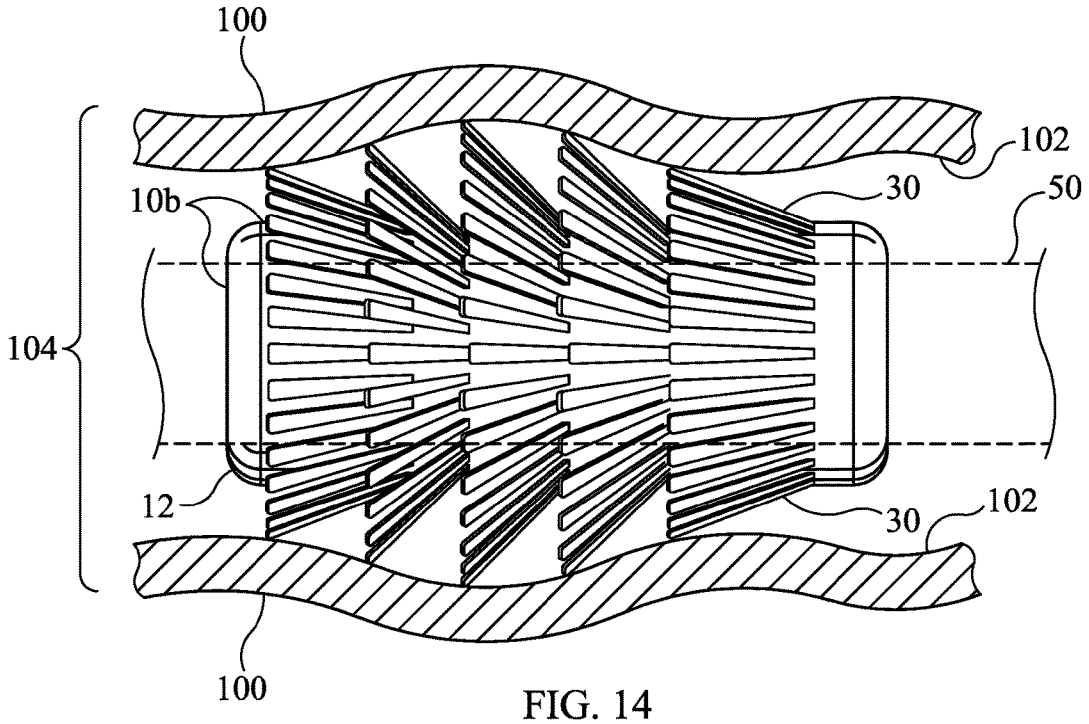
FIG. 14 is an illustration of the securing mechanism shown in FIG. 10 disposed in an internal anatomical space, according to an aspect of the present invention.
Figure 15:
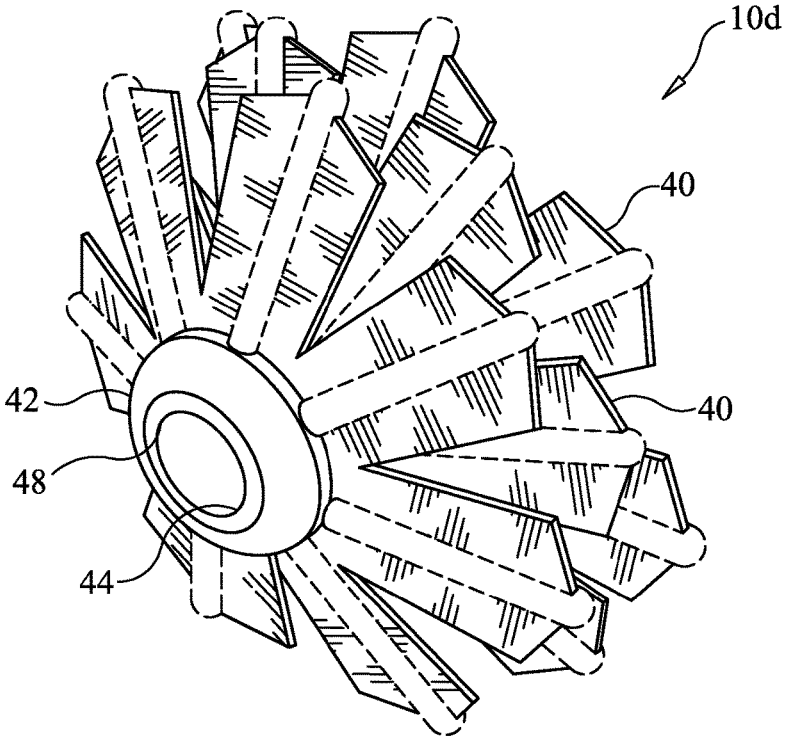
FIG. 15 is a perspective view of another embodiment of a securing mechanism, according to an aspect of the present invention.

The securing portion is configured for positioning and maintaining the base and the space access device at a distance from a location such as an end of the internal space or opening. For example, the adjustable securing portion of the securing mechanism 10*a*, 10*b*, 10*c*, 10*d*, 10*e*, 10*f*, 10*g* may be configured to maintain a distal end of a hearing aid and distal end of the securing mechanism at a predetermined distance relative to the ear drum. As another example, the securing portion of the mechanism 10*a*, 10*b*, 10*c*, 10*d*, 10*e*, 10*f*, 10*g* may be configured to maintain a proximal end of a hearing aid at a predetermined distance relative to the opening of the ear canal. The securing portion 10*a*, 10*b*, 10*c*, 10*d*, 10*e*, 10*f*, 10*g* is designed and adapted to conform or self-adjust to the shape of the interior surface of an opening (or interior space) of a member (biological or non-biological) when the securing mechanism (typically, but not necessarily attached to an access device) of the invention and, thereby, the projecting members 20, 30, 40, 120, 130. 160 are inserted in the opening 104 (e.g., see opening and interior space formed by tube 100 in FIG. 14, illustrating an internal anatomical space) thereby putting the projecting members into a constrained configuration. In some embodiments of the invention, each projecting member 20, 30, 40, 120, 130, 160 is adapted to flex and/or deform to conform to the shape and/or size of the interior surface. For example in FIG. 14, the bristles 30 in the more centrally located rows of bristles 30 are constrained less than the bristles 30 in the end rows, because the inside diameter of the opening formed by the walls 102 of the anatomical structure 100 is smaller at the locations of the end rows of bristles 30 than it is at locations of the more central rows of bristles 30. Note that the bristles 30 automatically conform at various levels to keep the space access device 50 substantially centered in the interior space of the anatomical structure, along the entire length thereof. In some embodiments of the invention, one or more member(s) 20, 30, 40, 120, 130, 160 is adapted to flex and/or deform to conform to the shape and/or size of the interior surface.

Figure 4:
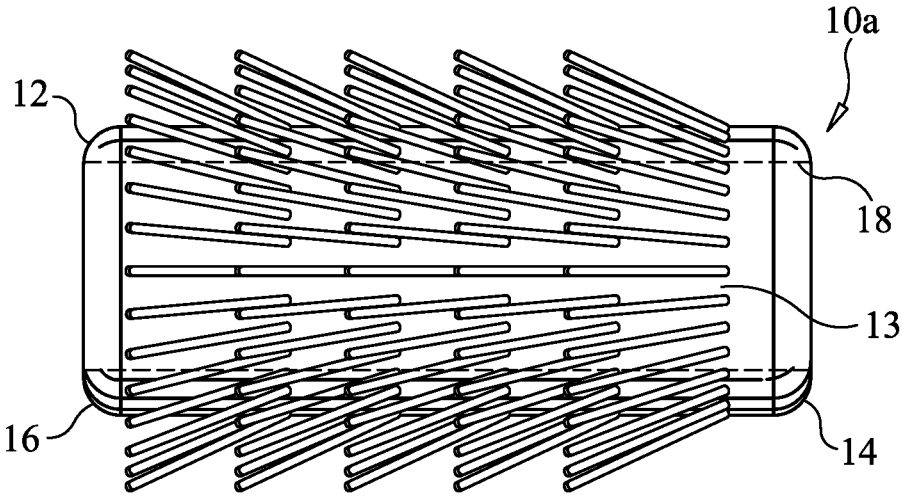
FIG. 4 is a side view of the securing mechanism shown in FIG. 2 in a constrained configuration, according to an aspect of the present invention.
Figure 5:
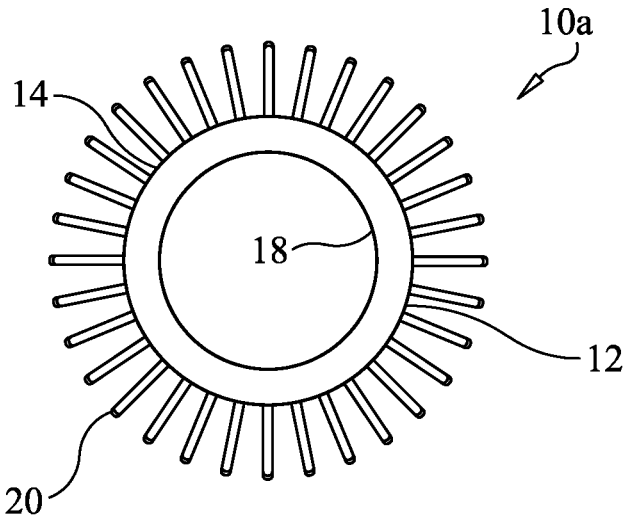

FIGS. 2-3 illustrate an embodiment of the securing mechanism 10*a* wherein the adjustable securing portion (outwardly projecting members 20) are in an unconstrained state, such as when the securing mechanism 10*a* has not yet been inserted into an opening or interior space. FIGS. 4-5 illustrate the securing mechanism 10*a* wherein the adjustable securing mechanism (outwardly projecting members) are in a constrained state and thus do not project out as far as in the unconstrained state of FIGS. 1-2. For example, such a constrained state would be assumed when the securing mechanism 10*a* is inserted into an opening or interior space having an inside diameter or cross-sectional dimension that is less than an outside diameter or cross-sectional dimension of the unconstrained outwardly projecting member 20. Thus, the projecting members 20, 30, 40, 120, 130, 160 are designed and adapted to flex and deform, whereby the securing mechanism 10*a*, 10*b*, 10*c*, 10*d*, 10*e*, 10*f*, 10*g* conforms to the shape of the interior surface 102 of the internal space when the access device 10*a*, 10*b*, 10*c*, 10*d*, 10*e*, 10*f*, 10*g* is inserted in the opening 104 and the projecting members 20, 30, 40, 120, 130, 160 are in a constrained state.

Thus, at least a portion of the adjustable securing portion is configured to transition from a first state to a securing state when inserted into the internal space or opening, wherein the securing state comprises at least a portion of the adjustable securing portion being constrained to have a smaller cross-sectional diameter relative to a cross-sectional diameter in the first state.

Figure 6:
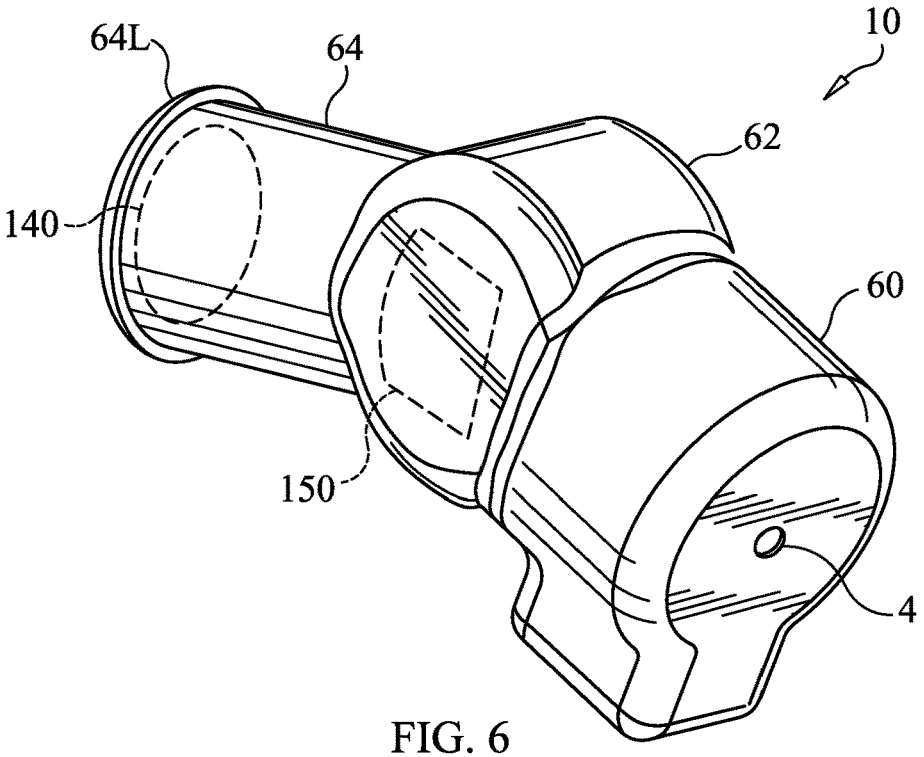
FIG. 6 is a perspective view of an embodiment of a hearing device, according to an aspect of the present invention.
Figure 7:
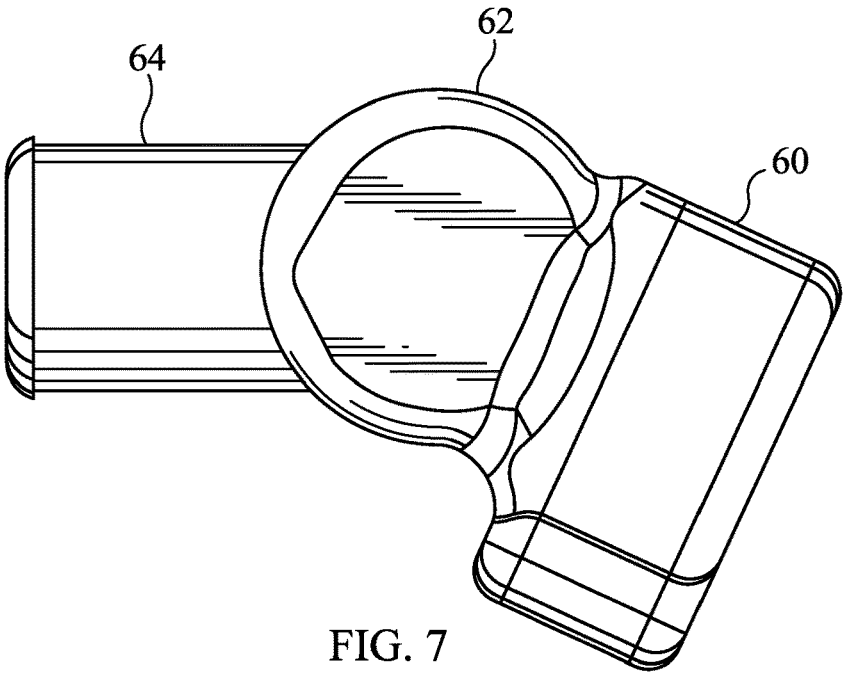
FIG. 7 is a side view of the hearing device shown in FIG. 6.

FIGS. 6 and 7 illustrate an in-ear hearing aid 10 according to an embodiment of the present invention, wherein the in-ear hearing aid 10 is shown without a securing mechanism. Hearing aid 10 comprises a housing which may house electronic components which may include, without limitation, a microphone, a battery, a sound processor, and/or an actuator. The battery or any other energy storage system may provide power to the other electronic components. The microphone may receive and/or collect sound. The sound processor may be used for sound amplification. The actuator may be used for sound transmission to a passive amplifier. In the embodiment shown in FIG. 6, a receiver 140, sound processor 150 and microphone 4 are schematically shown. Thus, the distal end portion 64 of the housing 60 houses the receiver 140, the central portion of the housing 60 houses the sound processor 150 and the proximal end of the housing 60 opens to the microphone in the embodiment of FIG. 6.

Figure 8:
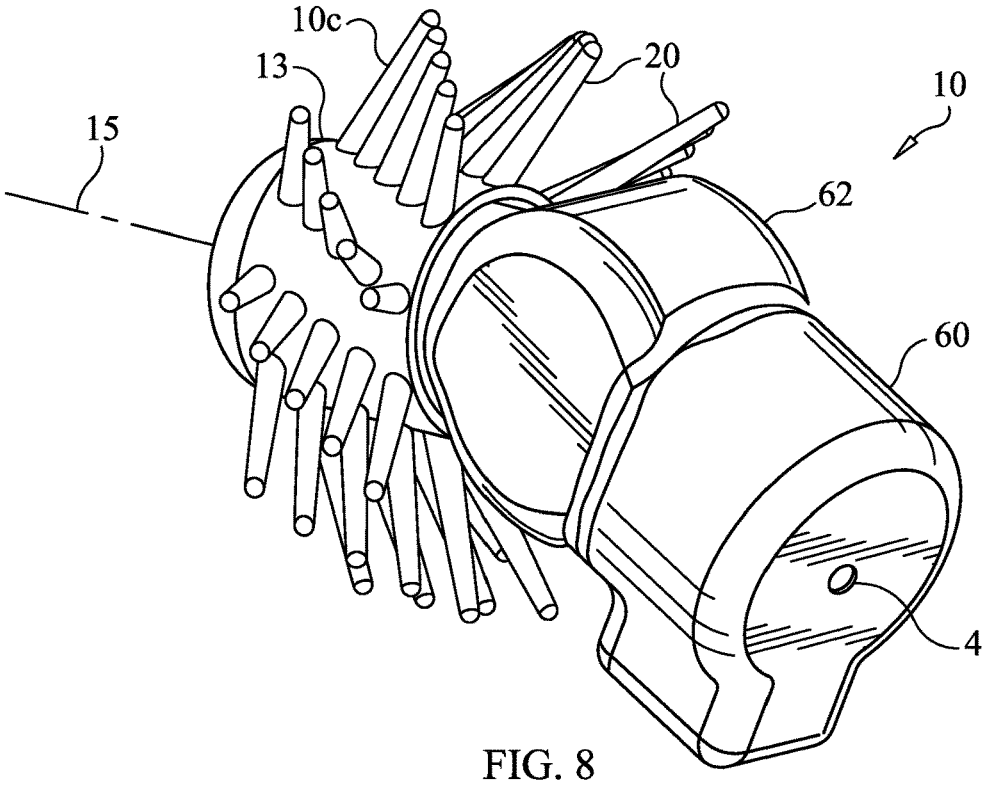
FIG. 8 is a perspective view of the hearing device shown in FIG. 6 having an embodiment of a securing mechanism disposed on the hearing device housing, according to an aspect of the present invention.
Figure 9:
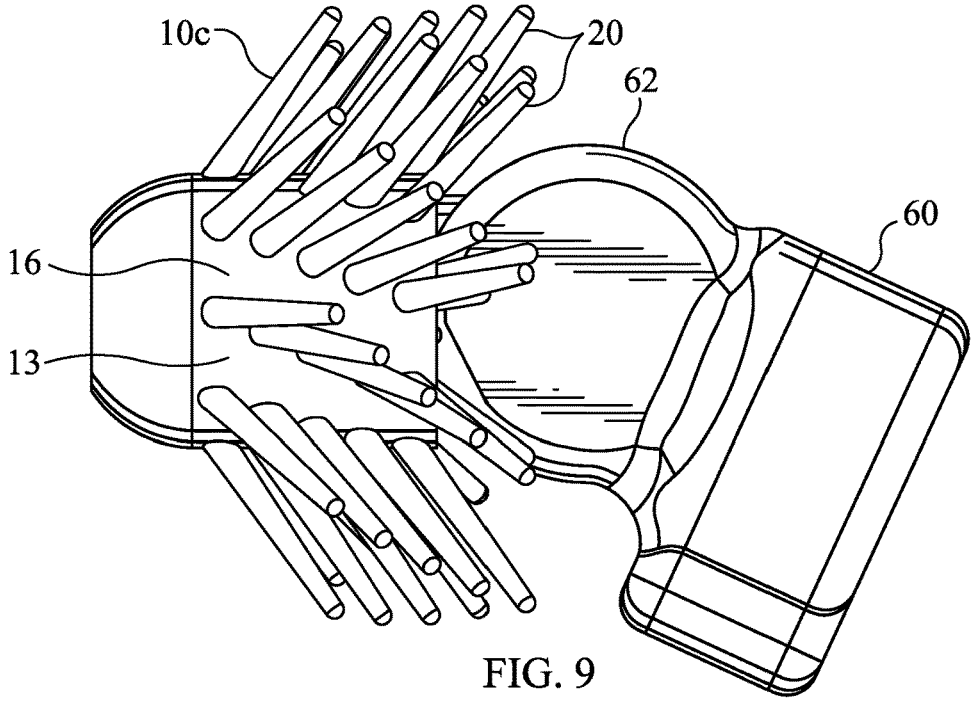
FIG. 9 is a side view of the hearing device shown in FIG. 8.

FIGS. 8-9 illustrate the hearing aid 10 with securing mechanism 10*c* attached thereto. Securing mechanism 10*c* has been attached to the hearing aid 10 in the manner described above, by sliding the securing mechanism 10*c* over the distal end portion 64 of the hearing aid 10 until it passes over the lip 64L in its entirety, whereby the lip 64L secures the securing mechanism in its mounted position on the distal end portion 64 of housing 60. Thus, securing mechanism may secure the hearing aid 10 inside an external ear canal. The securing mechanism 10*c* may secure part or all of the hearing aid 10 inside the ear canal. The securing mechanism 10*c* may also be used to maintain a passive amplifier (not shown) at a desired location or orientation. For example, the securing mechanism 10*c* may keep the passive amplifier in contact with the eardrum. In another example, the securing mechanism 10*c* may keep the passive amplifier at a desired distance from the eardrum. In preferable embodiments, the securing mechanism 10*c* may keep the ear canal open and allow for comfortable extended wear.

The securing mechanism 10*a*, 10*b*, 10*c*, 10*d*, 10*e*, 10*f*, 10*g* may comprise a compressible or flexible portion that may be permeable to air, to secure part or all of a hearing aid 10 while maintaining the ear canal open. The securing mechanism 10*a*, 10*b*, 10*c*, 10*d*, 10*e*, 10*f*, 10*g* may have one or more air channels 13 through the securing mechanism 10*a*, 10*b*, 10*c*, 10*d*, 10*g* or through a portion of the securing mechanism 10*e*, 10*f* defined by gaps between the outwardly projecting members 20, 30, 40, 120, 130, 160 or may allow one or more air channels to exist between the securing portion and the ear canal when the hearing aid is in use. One or more air flow paths may be provided through the hearing aid or between the hearing aid and ear canal surface. One or more air flow paths may provide fluid communication between one side of the hearing aid and an opposing side of the hearing aid (10*a*, 10*b*, 10*c*, 10*d*, 10*g*). Alternatively, one or more air flow paths may provide fluid communication along the securing portion, through air flow paths between the ear canal surface and the securing mechanism, while a blocking portion distal of the securing portion substantially blocks fluid communication between the air flow paths and the ear drum (10*e*, 10*f*). The opposing sides of the hearing aid may be on opposite longitudinal sides of the hearing aid (toward ear drum and away from ear drum) or on opposing lateral sides of the hearing aid.

In at least one embodiment, the securing mechanism 10*a*, 10*b*, 10*c*, 10*d*, 10*e*, 10*f*, 10*g* may include a plurality of small, soft, outwardly projecting members 20, 30, 40, 120, 130, 160. The members 20, 30, 40, 120, 130, 160 may be attached to a part of the hearing aid by attachment of the securing mechanism thereto, or alternatively, the members 20, 30, 40, 120, 130, 160 can be secured directly to the housing 60 of the hearing aid or be formed integrally therewith. In some embodiments, the outwardly projecting members 20, 30, 40, 120, 130, 160 may be assembled in a shape that may look like a circular hair brush. The securing portion of 10*a*, 10*b*, 10*c*, 10*d*, 10*e*, 10*f*, 10*g* may be attached to the distal end portion 64 of the hearing aid 10 only, the central portion 62 only, the proximal end portion of the housing 60 only, or any combination of these. The securing mechanism may be integrally formed on all or a portion of the housing 60 or may be integrally formed to include the base 16 and outwardly projecting members 20, 30, 40, 120, 130, 160 or the outwardly projecting members 20, 30, 40, 120, 130, 160 can be securely attached to the base 16.

The securing portion may contact a surface of the ear canal. For example, a plurality of outwardly projecting members 20, 30, 40, 120, 130, 160 may contact a surface of an ear canal when the hearing aid is in use. In some embodiments, the securing portion may contact the ear canal surrounding the hearing aid at one or more points. For example, if an axis is defined lengthwise along the hearing aid, the securing mechanism may be provided and/or may contact the ear canal surface at any angle around the lengthwise axis. In some embodiments, the securing mechanism may contact the ear canal at 360 degrees around the axis. Various possible configurations for the securing mechanisms are discussed in greater detail below. Any securing mechanism embodiment described elsewhere herein may be utilized.

According to an aspect of the present invention, the securing mechanisms and/or projecting members thereof can comprise compliant and/or flexible materials, including, without limitation, silicone, rubber, latex, polyurethane, polyamide, polyimide, nylon, paper, cotton, polyester, polyurethane, hydrogel, plastic, feather, leather, wood, and/or shape memory alloy, such as NITINOL® or the like. In some embodiments of the invention, the securing mechanisms and/or projecting members comprise a polymeric material.

Likewise, the blocking portions of the embodiments 10*e* and 10*f* can comprise compliant and/or flexible materials, including, without limitation, silicone, rubber, latex, polyurethane, polyamide, polyimide, nylon, paper, cotton, polyester, polyurethane, hydrogel, plastic, feather, leather, wood, and/or shape memory alloy, such as NITINOL® or the like. In some embodiments of the invention, the blocking portions comprise a polymeric material.

In some embodiments of the invention, the securing mechanisms, securing portions, blocking portions and/or projecting members comprise a coated, preferably, compliant and flexible material. According to an embodiment of the invention, a base material used to make the base 16 and/or outwardly projecting members 20, 30, 40, 120, 130, 160 can be coated with various materials and compositions to enhance the lubricity, alter the friction, adjust the hydrophobicity, adjust the oleophobicity and/or increase the stability in the chemical, environmental, and physical conditions of the target space or opening of the projecting members 20, 30, 40, 120, 130, 160.

The base material can also be coated with or contain various materials to allow for administration of a pharmacological agent or composition to biological tissue. The coating material can thus comprise, without limitation, active agents or drugs, such as anti-inflammatory coatings, and drug eluting materials. The coating material can additionally or alternatively include non-pharmacological agents.

In a preferred embodiment of the invention, the securing portions 10*a*, 10*b*, 10*c*, 10*d*, 10*e*, 10*f*, 10*g* of the invention are designed and adapted to self-conform or self-adjust to the shape of the interior surface of an opening (or interior space) of a member (biological or non-biological) when a space access device of the invention and, thereby, the projecting members 20, 30, 40, 120, 130, 160 are inserted in the opening and thereby placed into a constrained state. In some embodiments of the invention, each projecting member is adapted to flex and/or deform to conform to the shape and/or size of the interior surface. In some embodiments of the invention, one or more member(s) is adapted to flex and/or deform to conform to the shape and/or size of the interior surface.

The outwardly projecting members 20, 30, 40, 120, 130, 160 are preferably leaflets or leaflets reinforced with ribs, but may be bristles, or any of the types described above, including combinations of different types of projecting members. In the embodiment of FIGS. 2-5 the outwardly projecting members comprise bristles 20 that are substantially cylindrical in cross-sectional shape and have a substantially constant cross-sectional diameter over the entire lengths thereof. In the embodiments of FIGS. 8-9 and 24A-27C, the outwardly projecting members comprise bristles 20, 120, 130 that are substantially cylindrical in cross-sectional shape and have a tapering cross-sectional diameter over the entire lengths thereof, such that the bases of the bristles 20, 120, 130 where they attach to the base 16 have the largest diameters and the free ends have the smallest diameters, with a constantly tapering diameter at all locations therealong so as to form cone-shaped bristles 20, 120, 130. In the embodiment of FIGS. 10-13, the outwardly projecting members comprises bristles 30 that have a substantially flat cross-sectional shape 2*f* like that shown in FIG. 1F. In the embodiments of FIGS. 15-22, the outwardly projecting members comprise bristles 40 that have a complex cross-sectional shape that is partially flat and partially V-shaped, with a circular portion intervening. In the embodiments of FIGS. 32-38, the outwardly projecting members comprise leaflets 160 that have a flat contact surface and a reinforcing rib that may protrudes at least partially from a surface opposite the contact surface. As noted previously, the outwardly projecting members may take on many other various cross-sectional shapes as contemplated within the scope of the present invention.

Figure 21:
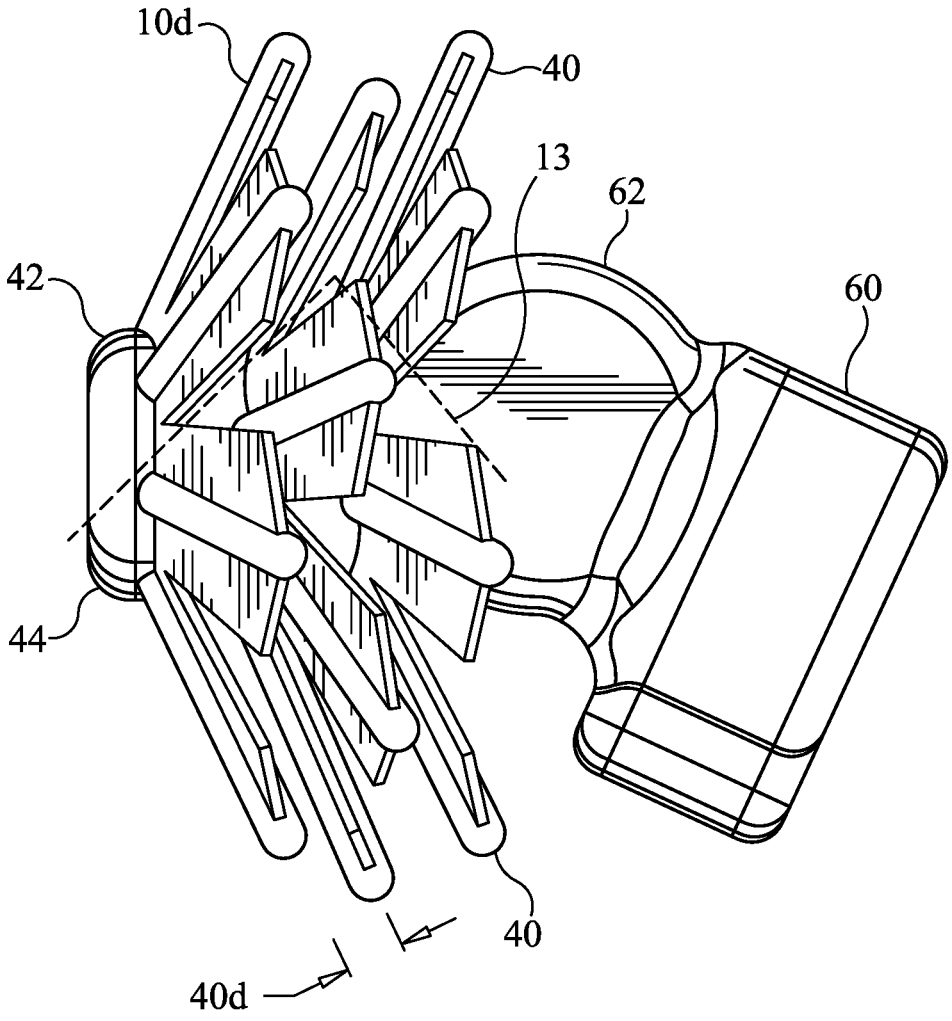
FIG. 21 is a side view of the hearing device shown in FIG. 6 having the securing mechanism shown in FIG. 15 disposed thereon, according to an aspect of the present invention.
Figure 24A:
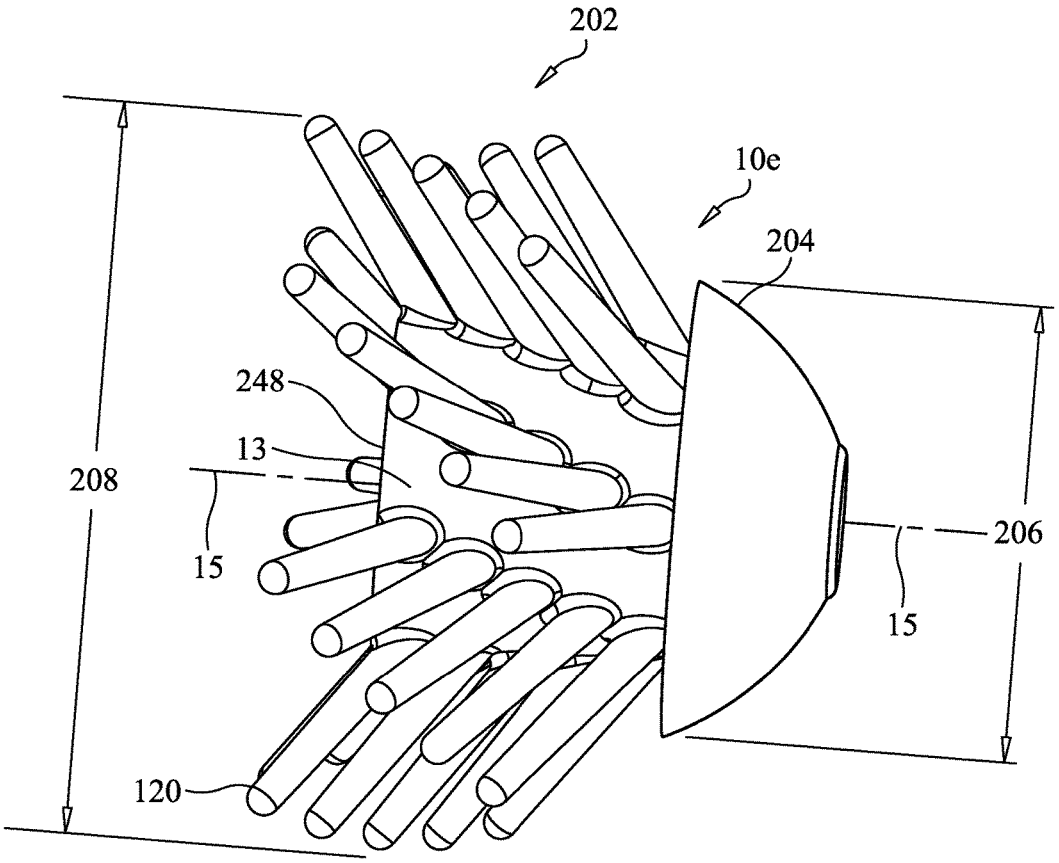
FIG. 24A is a perspective side view of a securing mechanism that includes a securing portion and a sound blocking portion, according to an embodiment of the present invention.
Figure 26B:
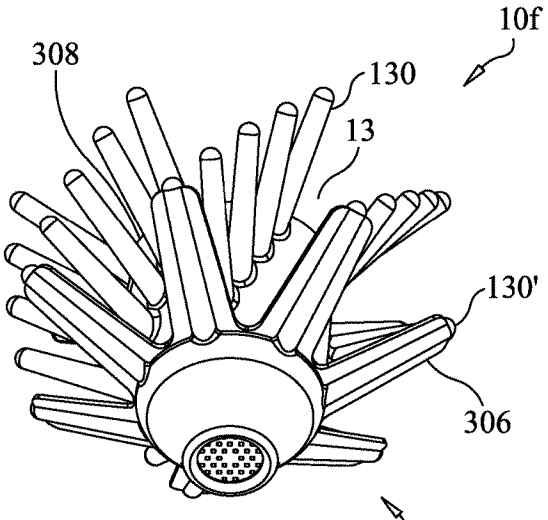
FIGS. 26A-26C are perspective views of the mechanisms of FIGS. 25A-25C, respectively.
Figure 26A:
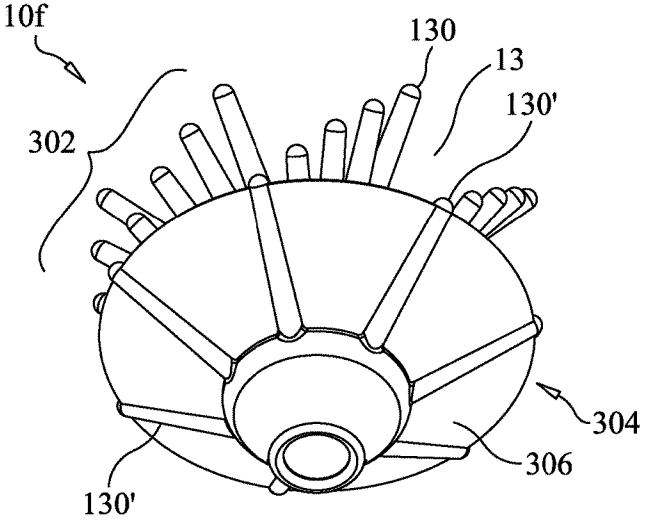
Figure 26C:
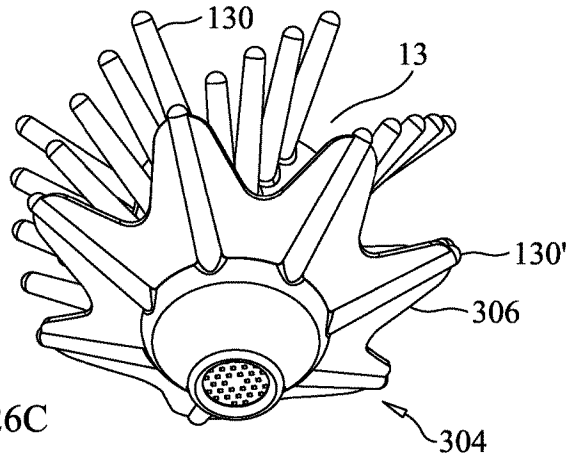
Figure 32:
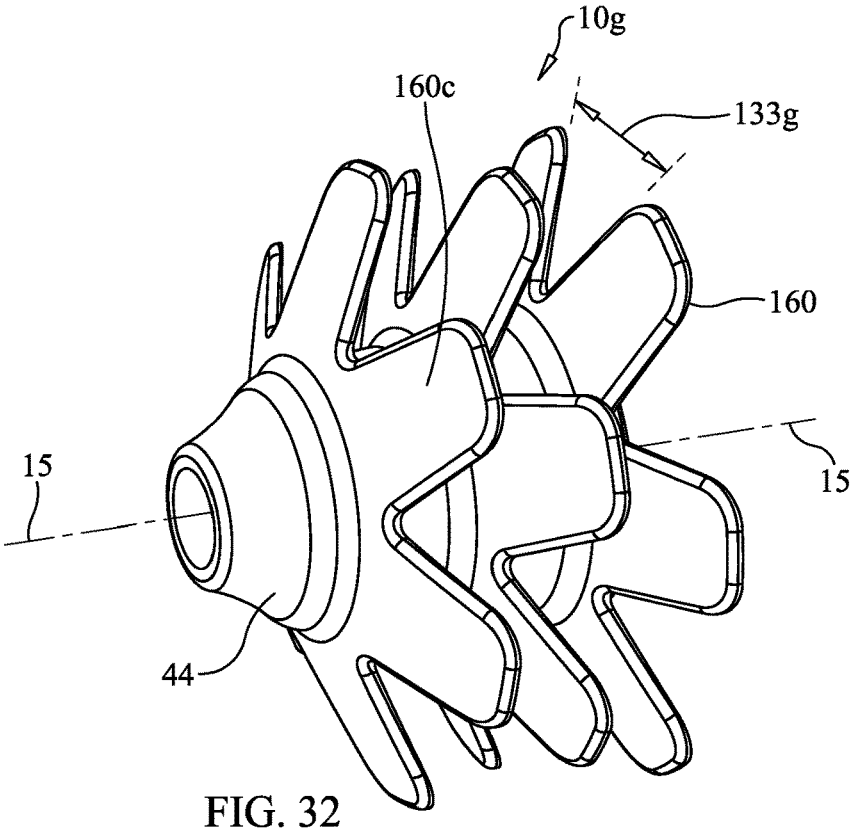
FIG. 32 is a perspective view of another embodiment of a securing mechanism, according to an aspect of the present invention.

The outwardly projecting members can be disposed on a single planar row of members 20, 30, 40, multiple planar rows as illustrated by bristles 20 in FIGS. 2 and 4, bristles 40 in FIG. 21, leaflets 160 in FIG. 32, a single spiral row of outwardly projecting members, multiple spiral rows as illustrated by bristles 20 in FIGS. 8-9, bristles 120 in FIG. 24A, bristles 130 in FIGS. 26A-26C, and further in U.S. Design Pat. No. D717,957, which is hereby incorporated herein, in its entirety, by reference thereto or other row configurations arranged with varying degrees of overlap of the outwardly projecting members of one row by outwardly projecting members of an adjacent and subsequent rows.

According to another aspect of the present invention, the securing mechanisms 10*a*, 10*b*, 10*c*, 10*d*, 10*e*, 10*f*, 10*g* can include outwardly projecting members having the same cross-sectional shapes or different cross-sectional shapes, e.g. a first bristle row comprising a first plurality of bristles 20 having a cylindrical cross-sectional shape and a second bristle row comprising a plurality of bristles 30 having a flat cross-sectional shape.

According to another aspect of the present invention, the outwardly projecting members may comprise reinforcement members and surface features that are configured to enhance the lubricity, alter the friction, adjust the hydrophobicity, oleophobicity and/or lipophobicity of the securing mechanism and/or outwardly projecting members associated therewith, and/or support and/or enhance modulation of (i) the pressure applied to a surface of an internal space or opening by a space access device employing a securing mechanism according to an embodiment of the present invention, and/or (ii) pressure waves or audio signals through the securing mechanism and, hence, space access device, and between the space access device and the internal space or opening and, thereby, modulate at least one of an amplitude and a frequency of audio signals/pressure waves transmitted through the internal space or opening when the space access device including the securing means is secured in the internal space or opening.

As hearing loss becomes more severe in a patient, a relatively high maximum stable output needs to be produced by a hearing aid treating such a patient as compared to the maximum stable output required of a hearing aid treating a patient with less severe hearing loss. In order to improve maximum stable output of a hearing aid device (maximum output or loudness before feedback occurs to an extent to produce undesirable effects), feedback reduction considerations are an important factor to be taken into account. When a hearing aid device such as device 10 in FIG. 8 is secured in the ear canal of a user, sound entering the ear is sensed by the microphone 4, digitally converted and fed forward to the receiver 140 where it is reproduced to the ear drum in an amplified fashion. However, sound reproduced by the receiver may also feed back to the microphone 4 and if this feedback becomes too great, can result in unpleasant and counterproductive effects, such as squelch, squealing, or just lessened maximum stable output of the device 10 in general. The more "open" an in-ear device is, the greater the propensity for feedback, so there is a tradeoff between "openness", i.e., the amount and directionality of air flow that is allowed to pass through the ear canal between the device 10 and the inner walls of the ear canal, and feedback experienced by the microphone 4.

For cases of relatively severe hearing loss in a patient, embodiments of FIGS. 24A-27C provide a sound blocking portion in addition to a securing portion, such that the securing mechanism effectively blocks air flow/sound conduction from the ear drum to the securing portion and vice versa, as the blocking portion is positioned between the securing portion and the eardrum in use, thus improving maximum stable output of the hearing aid device in these embodiments, relative to the more open devices described herein.

The independent flexi-fibers, such as outwardly projecting members 20, 30, 40, 120, 130, 160 conform to each individual's ear canal and are comfortable to wear over extended periods of time as they do not create "pressure spots" of relatively greater force generated by any one portion of the securing mechanism, as occurs in many prior art devices, but distribute the securing forces lightly and substantially evenly over all of the outwardly projecting members. This conformation forms to any shape ear canal. Also a hearing aid employing a securing mechanism according to the present invention is more secure because the outwardly projecting members 20, 30, 40, 120, 130, 160 move with the movements of the wearer's jaw so that the hearing aid device 10 does not become displaced, but remains in the same relative insertion location.

By allowing air to move in and out of the ear canal past at least a portion of the secured hearing aid 10, as in all embodiments described herein, this allows for temperature and moisture control within the ear canal, providing significantly more comfort to the wearer and a healthier environment for the ear canal as it helps prevent maceration of the ear canal. The flexible, outwardly projecting members 20, 30, 40, 120, 130, 160 and orientation thereof relative to the hearing aid device 10 when fixed thereto provides for asymmetrical forces applied to the members 20, 30, 40, 120, 130, 160 when comparing insertion of the hearing aid to removal of the hearing aid. As the hearing aid 10 is inserted into the ear canal the angulation and directionality of the members 20, 30, 40, 120, 130, 160 causes them to compress relatively easily with a relatively less amount of force compared to the force that is applied to the members 20, 30, 40, 120, 130, 160 as the members 20, 30, 40, 120, 130, 160 have relatively large forces applied to them as they attempt to re-expand as they are being drawn out of the ear canal, which may cause buckling of one or more members 20, 30, 40, 120, 130, 160 in a manner that further increases the minimum amount of force needed to remove the hearing aid, relative to the minimum amount of force necessary to insert the hearing aid. The flattened cross section of the leaflets 160 further increases the asymmetry between the minimum insertion and removal forces as they cannot rotate, like a bristle, as they are being removed, and therefore have fewer degrees of freedom in buckling. This causes an increase in the buckling force and consequently an increase in force asymmetry, as the minimum amount of removal force is greater, while the minimal insertion force is about similar or less than that of embodiments employing bristles having circular cross sections. This force disparity is beneficial for ease of insertion and placement of the hearing aid 10 and for assistance in wax removal upon removing the hearing aid 10 from the ear canal.

The multiple rows of outwardly projecting members not only aids in linear retention of the space access device when securing it within an internal space, but also aids in angular retention and stability about axes perpendicular to the longitudinal axis 15, as the contact points of the outwardly projecting members extend along the longitudinal axis direction.

The most open designs of the securing mechanisms are those that allow straight through channels that are aligned with the longitudinal axis of the ear canal and/or hearing aid device 10/securing mechanism 10*a*. For example, in the arrangement shown in FIG. 2 it can be seen that straight through open air channels 13 are provided that are aligned with the longitudinal axis 15 of the securing mechanism 10*a*. This arrangement is very non-occlusive and allows all frequencies of sound to easily pass through the channels 13, both forward and backward, which allows a greater propensity for feedback effects, but at the same time provides for a very comfortable fit.

The design of the securing mechanism 10*c* in FIG. 8 is a spiral design in which no straight through channels are provided that are aligned with the longitudinal axis 15. Instead the channels 13 are occluded in the straight through directions aligned with the longitudinal axis. However the spiral channels 13 are fairly wide as the straight through paths are not fully occluded until the fourth row of bristles 20 is reached. These fairly wide channels still allow some feedback of relatively higher frequencies of sound. The bristles 30 of the embodiment of FIG. 10 are also arranged like the embodiment of FIG. 2, such that straight through paths 13 aligned with the longitudinal axis 15 of the securing mechanism 10*b* are provided However, because the bristles 30 have a flat cross-sectional shape 1F and are wider than the diameters of the cylindrical bristles 20 of FIG. 2, the gaps between the bristles 30 are narrower than the gaps between the bristles 20 in FIG. 2 and the embodiment of FIG. 10 therefore occludes more than the embodiment of FIG. 2. However due to the straight through pathways 13 in FIG. 10 there is some feeding forward and back of higher frequency sound, though less than is the case with the embodiment of FIG. 2.

Since high frequency sound waves are more directional than midrange frequencies and much more directional than low frequency sound waves, it is beneficial to provide a hearing aid device with a securing mechanism that has/performs a differential acoustic impedance. Because the spiral channels 13 of the embodiment of FIG. 8 do not provide any straight through channels that are aligned with the longitudinal axis of the ear canal/hearing aid device 10, this causes some of the high frequency sound waves to be deflected and impeded by the bristles 20 defining the curved channels as the shorter wave, higher frequency sound waves try to pass in a straight through direction aligned with the longitudinal axis 15 of the ear canal/hearing aid device 10. Advantageously, low and midrange sound frequencies are still allowed to pass and thereby supplement the sound reproduction, in a manner as described above. In the feedback direction, the higher frequency sounds emitted from the receiver are also impeded somewhat, thereby reducing contributions to undesirable feedback effects, as these typically occur when the higher frequency sound waves reproduced by the receiver 140 get fed back to the microphone too much.

For patients in which hearing loss is relatively severe, a securing mechanism can be provided that completely or nearly completely occludes the ear canal by providing the securing mechanism with a blocking portion in addition to the securing portion, such as described with regard to embodiments 10*e* and 10*f*. By effectively sealing off the ear canal relative to the proximal end portion of the hearing aid or other location in which the microphone is located, air flow/sound is prevented from feeding back from locations distal of the seal (such as the eardrum) to locations proximal of the seal (such as the microphone 4) thus increasing maximum stable output of the hearing aid device to which the securing mechanism is mounted (or integral therewith). Because the securing portion of the securing mechanism still allows airflow therethrough (proximally of the seal), this allows for the temperature and moisture control along the ear canal at locations proximal of the seal. Also the securing portion as described herein provides a more comfortable anchoring solution compared to use of a dome or series of domes to provide the anchoring function along with the sealing function. By anchoring primarily with the securing portion (bristles or the like), this permits the forces applied by the blocking portion to be significantly less for providing the sealing function then they would otherwise be when required to perform both sealing and anchoring functions.

In order to obtain an acceptable tradeoff between increasing the maximum stable output of a hearing aid design to allow treatment of more severe cases of hearing loss and the benefits of open air design as described above, hearing aids 10 having securing mechanisms that provide greater differential acoustic impedance than those embodiments described previously are provided. As the pathways 13 deviate more and more from straight line pathways aligned with the longitudinal axis 15 of the ear canal/hearing aid device 10, the differential acoustic impedance increases more and more. One way of increasing this deviation is to reduce the straight line distance before a pathway becomes occluded. In the embodiment of FIGS. 15-22, the gaps between the bristles 40 in a first row of bristles of the securing mechanism 10*d* are completely occluded (in the straight line, parallel to longitudinal axis 15 sense) by bristles 40 in the next adjacent (i.e., second row) of bristles 40 and that the gaps between the bristles 40 in the second row of bristles are completely occluded by the bristles 40 in the third row of bristles. This results in very tortuous pathways 13 (see FIG. 21) through which the air and sound waves travel. As a result, although air flow is still allowed into and out of the ear canal to obtain the benefits of an open in-ear hearing aid described previously, the amount of attenuation of high frequency sound waves is quite high, resulting in greater maximum stable output compared to those embodiments described previously.

One factor in achieving greater differential acoustic impedance is the length of the straight line pathways aligned with the longitudinal axis before occlusion occurs. Because the embodiment of FIG. 15 already occludes by the distance that it takes to reach only the second row of bristles 40, this results in very good differential acoustic impedance. The securing mechanism 10*d* in FIG. 15 includes a lumen 48 that is configured to slide over a mating portion of a space access device in any of the same manners described above with regard to lumen 18 of FIGS. 2-5, with the proximal end portion 46 (see FIG. 17) of the securing mechanism 10*d* being slid over the space access device portion before the distal end portion 42. The distal end component 44 may interface with the lip 64L to prevent inadvertent removal of the securing mechanism 10*d* from a space access device once it has been secured in place.

Figure 16:
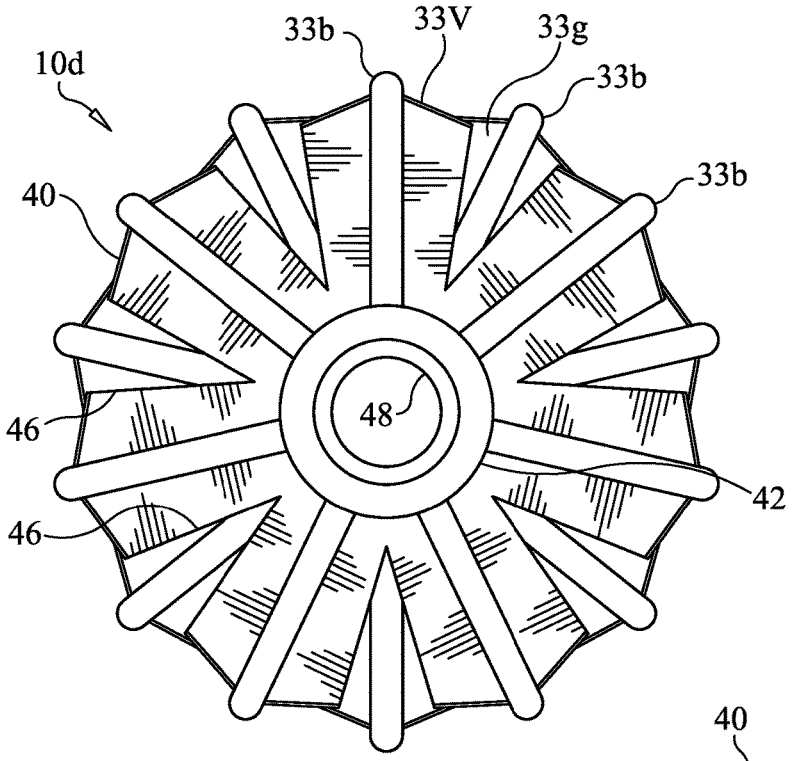
FIG. 16 is a front view of the securing mechanism shown in FIG. 15.
Figure 17:
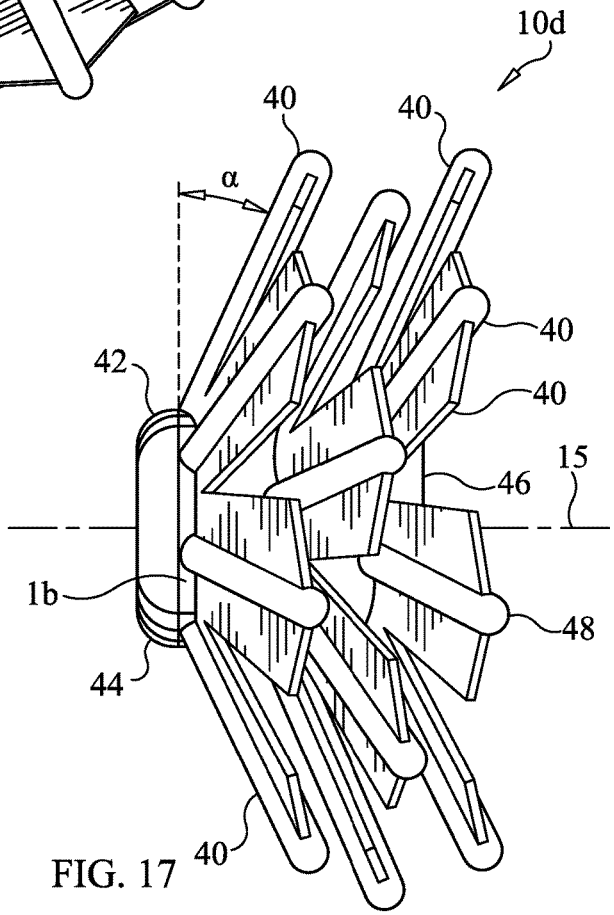
FIG. 17 is a side view of the securing mechanism shown in FIG. 15.

The open area provided by the gaps 33G (see FIG. 18) in a row of outwardly projecting members 40 may be in the range of about 0% to 95% or about 5% to about 50% or about 10% to 40% of the total area defined by the members 40 and gaps 33G as shown in FIG. 16. In the embodiment shown in FIG. 16, the open area, in the unconstrained configuration as shown in about 30%.

Figure 18:
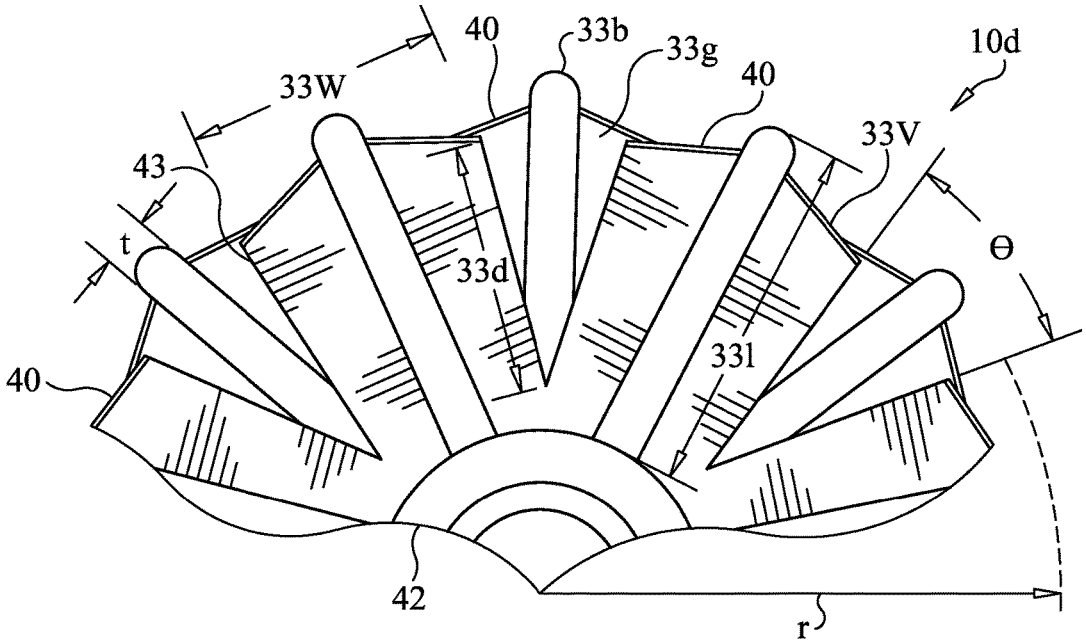
FIG. 18 is a partial front view of the securing mechanism shown in FIG. 15, showing the relationships by and between the securing mechanism bristles, according to an aspect of the present invention.

Additional factors in achieving greater differential acoustic impedance are the width of the bristles and the width of the gaps between the bristles. In the embodiment of FIG. 18, the width 33W of the bristle 40 is a value in a range from about 3.0 mm to 7.0 mm, preferably about 4.0 mm to about 6.0 mm, more preferably about 4.5 mm to about 5.5 mm, and in one specific embodiment was about 5.0 mm. The width of the gaps between the bristles 40 at their widest is a value in a range from about 1 mm to about 5 mm, preferably about 2 mm to 4 mm, more preferably about 2.5 mm to about 3.5 mm and in one specific embodiment was about 3 mm. The angle θ of the gaps may range from about 15 to 45 degrees, more preferably 20 to 40 degrees, and in one embodiment was about 30 degrees. The angle α that the bristles 40 project outwardly at, relative to a normal to the longitudinal axis 15 of the securing mechanism 10*d* is a value in a range from about 0 degrees to about 60 degrees, preferably about 5 degrees to about 30 degrees, more preferably about 10 degrees to about 25 degrees.

The distance 40*d* between the rows of bristles 40 affects the width of the channel 13 and therefore also directly impacts the amount of high frequency impedance. The distance 40*d* may vary, with narrower distances providing relatively higher high frequency impedance. Distance 40*d* is typically a value in the range of about 1 mm to about 3.5 mm, preferably about 1.5 mm to about 2.5 mm and in one specific embodiment was about 2.0 mm.

The bristle members 40 may include sound reducing vanes 33V that are provided on bristle cores 33B as shown in FIG. 16. The bristle cores 33B may be substantially cylindrical (although other cross-sectional shapes may be employed, as noted above) and provide added structural support to the bristle member 40. However, the bristle cores 33B are not strictly necessary, and the bristles may be constructed from a pair of vanes angled with respect to one another like shown, or even as single vanes. The vanes 33V in this embodiment have a thickness that is less than a thickness (e.g., diameter, or other cross-sectional dimension) of the bristle core 33B. The width of the vanes 33V is greater than the width of the bristle core 33B, but need not be in all embodiments. Furthermore, the width of the vane 33V may vary along its length. The lengths 33*d* of the vanes 33V may be equal to, slightly less than, or substantially less than the lengths 331 of the bristle cores 33B. In any case, the securing mechanisms 10*a*, 10*b*, 10*c*, 10*d* are currently made in two sizes, with the large size having an unconstrained diameter having a value in a range from about 13 mm to about 17 mm, preferably from about 14 mm to about 16 mm and in one specific embodiment was about 15 mm. A regular size has an unconstrained diameter with a value in a range from about 10 mm to about 14 mm, preferably about 11 mm to about 13 mm and in one specific embodiment was about 12 mm. the length of bristle core 331 may be a value in a range from about 6 mm to about 9 mm and in one embodiment was about 7 mm. The length 33*d* of vane 33V may be a value in a range from about 5 mm to about 9 mm and in one embodiment was about 6.5 mm. These size ranges are for the regular size and would be respectively larger for the large size. In the embodiment of FIGS. 15-22, all bristle elements 40 are provided with two vanes 33V each. It is within the scope of the present invention that there may be one or more vanes 33V on a bristle core 33B to form a bristle element 40 and/or some bristle elements 40 may have no vanes 33V. An advantage provided by the vanes 33V is the reduction of feedback, as these vanes 33V further assist acoustic feedback reduction in open in-ear hearing aids for users with more severe hearing loss, relative to the amount of hearing loss experienced by users of open in-ear hearing aids that do not employ the vanes 33V.

As noted, various designs and embodiments of the securing mechanism 10*d* may be provided to have variations in: the outwardly projecting member width 33W, gap angle θ, width of gap at its widest, length 33*d* of outwardly projecting members, angle α of outwardly projecting members relative to a normal to the longitudinal axis 15 of the securing mechanism 10*d*, distance between rows of outwardly projecting members in a direction along the longitudinal axis 15, and/or amount of overlap of a gap 33G in one row by an outwardly projecting member 40 in the next adjacent row and subsequent rows, in a direction aligned with the longitudinal axis 15.

In the embodiment of FIGS. 15-22, the gap 33*g* is completely overlapped by member 40 of the next adjacent row as illustrated in FIG. 18, which provides this embodiment with greater differential acoustic impedance performance than an embodiment in which only 95%-99% or 90%-95% or 80% to 90% or 70% to 80% or 60% to 70% or 50% to 60% or less than 50% of the gap 33G is overlapped by the member of the next adjacent row. The greater the degree of overlap, the greater the degree of the differential acoustic impedance is that results. For example, a securing mechanism 10*d* arranged such that a gap 33G in a first row of bristles 40 is completely occluded or overlaid upon reaching the third row of bristles 40 in a straight line direction aligned with the longitudinal axis, will exhibit less differential acoustic impedance than the embodiment shown in FIG. 18, where complete occlusion or overlapping is accomplished by the bristle 40 in the second row of bristles that is immediately adjacent the first row of bristles. Similarly, if a gap 33G is not fully occluded until reaching a bristle 40 in the fourth row of bristles, then this arrangement would provide even less differential acoustic impedance than the example where complete occlusion occurs by the third row. There is a continuum of the amount of differential acoustic impedance that can be achieved by a securement mechanism as described herein, with one of the factors that the continuum is dependent upon being the amount of overlapping or occlusion of a gap 33G by next adjacent row and subsequent row bristles 40. In addition to the physical arrangement and location of the bristles 40 of one row relevant to the next adjacent and subsequent rows, the width 33W of the bristles and gaps 33G also play important roles in changing the differential acoustic impedance properties, where wider bristles 40 result in greater differential acoustic impedance and narrow gaps 33G result in greater differential acoustic impedance properties.

Also, the differential acoustic impedance characteristics of a securing mechanism increase as the width or cross-sectional dimension of the air channels 13 decreases. Thus, the embodiment of FIG. 17 could be provided with even greater differential acoustic impedance characteristics by moving the rows of the bristles 40 closer together along the direction of the longitudinal axis. Conversely, moving the rows of bristles further apart from one another along the direction of the longitudinal axis 15 would increase the width or cross-sectional dimension of the air channels and thereby decrease the differential acoustic impedance characteristics of the securing mechanism 10*d*.

Figure 19:
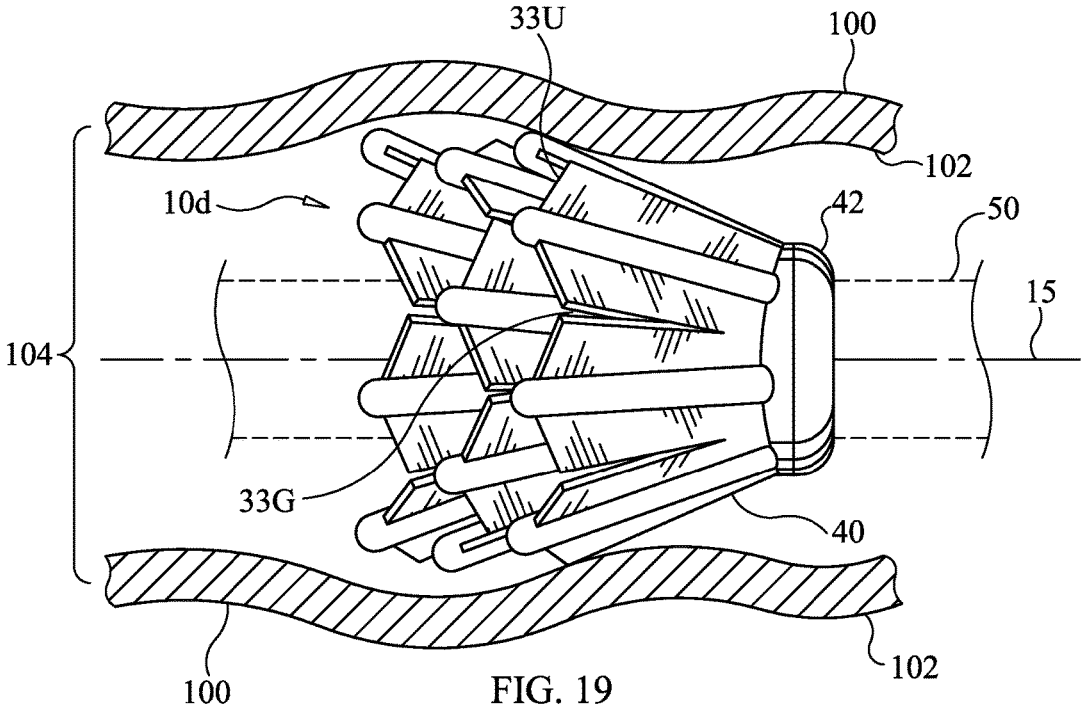
FIG. 19 is an illustration of the securing mechanism shown in FIG. 15 disposed in an internal anatomical space, according to an aspect of the present invention.
Figure 20:
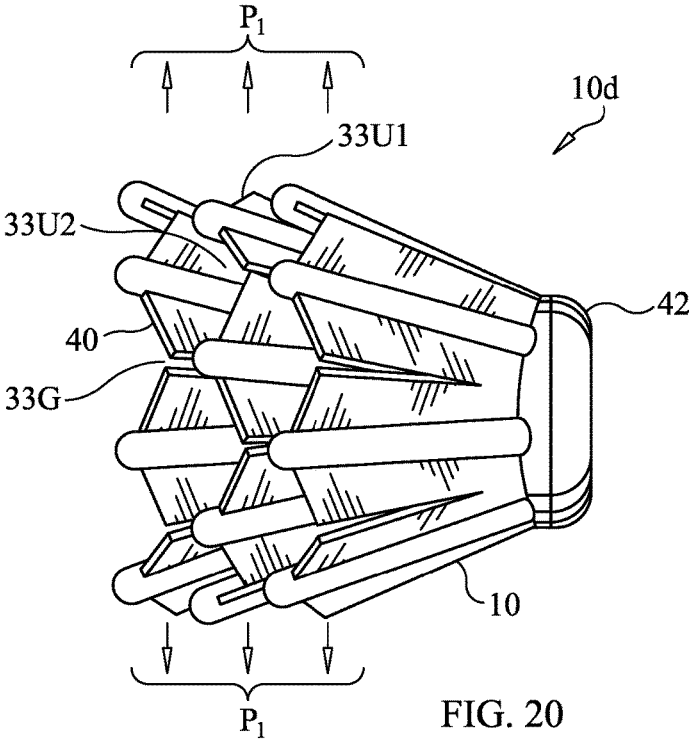
FIG. 20 is a side view of the securing mechanism shown in FIG. 15 in a constrained configuration, illustrating the applied force or pressure profile provided thereby, according to an aspect of the present invention.

FIG. 19 schematically illustrates the securing mechanism 10*d* attached to a space access device 50 having been inserted in the opening 104 (e.g., see opening and interior space formed by tube 100 in FIG. 19, illustrating an internal anatomical space) thereby putting the outward projecting members 40 into a constrained configuration. In some embodiments of the invention, each projecting member 40 is adapted to flex and/or deform to conform to the shape and/or size of the interior surface. For example in FIG. 19, the bristles 40 in the first or distal most row of bristles expand more toward the bottom wall 102 in FIG. 19 than the amount of expansion toward the top wall 102, relative to the longitudinal axis 15, as the bottom wall 102 deviates further from the longitudinal axis than the top wall 102 does at the locations where the bristles 40 of the first row contact the walls 102 and the bristles conform to the shape or topography of the anatomical structure, thereby maintaining the device 50 centered and aligned within the space. The same principles apply to the second and third rows of bristles 40 in FIG. 19. In the compressed/secured configuration it is noted that the gaps 33G become narrower in width as compared to their widths in the initial, non-compressed state, prior to inserting the device. It is further noted that additional air gaps 33U can open up upon the folding inwardly of the vanes 33V toward one another when the securing mechanism is compressed, as illustrated in FIGS. 19 and 20. However, by designing the bristles 40 such that adjacent rows of bristles 40 fold in opposite directions 33U1, 33U2, this counteracts the opening up of new air channels as adjacent folded vanes 33V fill in or overlay the gaps to a great extent.

FIG. 21 illustrates a securing mechanism 10*d* having been removably attached to a distal end portion of a hearing aid device 60 according to an embodiment of the present invention. As mentioned previously, the outwardly projecting members 40 could alternatively be permanently mounted to extend from the housing of the hearing aid device 60 or be made integral therewith.

FIG. 22 illustrates a securing mechanism 10*d* having been removably attached to a distal end portion of a housing 72 of headphone 70 according to an embodiment of the present invention. As mentioned previously, the outwardly projecting members 40 could alternatively be permanently mounted to extend from the housing 72 of the headphone 70 or be made integral therewith.

Figure 23:
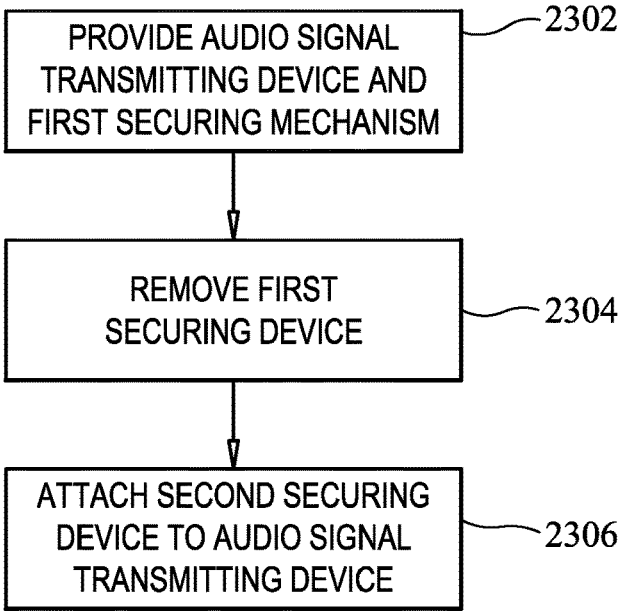
FIG. 23 illustrates events that may be carried out in a method to change operating characteristics of a space access device according to an embodiment of the present invention.

FIG. 23 illustrates events that may carried out to effect a method of changing at least one of: differential acoustic impedance, modulation of amplitude and/or modulation of frequency of audio signals provided by a space access device such as an audio signal transmitting device when inserted into an opening or internal space as described herein.

At event 2302, an audio signal transmitting device is provided. The audio signal transmitting device may be provided with a first securing mechanism 10*a*, 10*b*, 10*c*, 10*d* already attached thereto, or a user may attach the first securing mechanism to the audio signal transmitting device. The first securing mechanism is configured to perform, in conjunction with the audio signal transmitting device, at least one of: differential acoustic impedance of the audio signals, modulation of an amplitude of the audio signals, or modulation of frequency of the audio signals transmitted through the internal space or opening when said securing means is secured in the internal space or opening, by providing the first securing mechanism in accordance with one of the embodiments described herein.

If the user wants to change one of these characteristics, for example to increase maximum stable output or to increase the amount of airflow past the securing mechanism and audio signal transmitting device when installed in the opening or internal space, then the first securing mechanism 10*a*, 10*b*, 10*c*, 10*d*, 10*g* is removed from the audio signal transmitting device at event 2304. At event 2306, a second securing mechanism 10*a*, 10*b*, 10*c*, 10*d*, 10*g* is attached to the audio signal transmitting device, wherein the second securing mechanism is configured to perform at least one of: a second differential acoustic impedance of; a second modulation of an amplitude of, or a second modulation of a frequency of audio signals transmitted through the internal space or opening when the audio transmitting device and securing mechanism are secured in the internal space or opening; and wherein at least one of the second differential acoustic impedance of; second modulation of an amplitude of, or second modulation of a frequency of audio signals transmitted through the internal space or opening when the audio transmitting device and second securing mechanism are secured in the internal space or opening is different from the first differential acoustic impedance of; first modulation of an amplitude of, or first modulation of a frequency of audio signals transmitted through the internal space or opening when the audio transmitting device and first securing mechanism are secured in the internal space or opening.

The different characteristics can be achieved as described herein including changing at least one characteristic of the second securing mechanism relative to the first securing mechanism, where each of the first and second securing mechanisms includes: a plurality of outwardly projecting members arranged in rows; each of the outwardly projecting members comprising a length and a width; gaps separating the outwardly projecting members; the rows being separated by a row distance measured in a direction along a longitudinal axis of the securing mechanisms; the gaps comprising a maximum gap width; the gaps comprising a gap angle; the outwardly projecting members being angled with respect to a normal to the longitudinal axis; and gaps in a first row being overlapped by outwardly projecting members of an immediately adjacent row by a value in a range from 0% to 100% in a direction aligned with the longitudinal axis.

Thus, a set including the characteristics of the length of the outwardly projecting member, width of the outwardly projecting member, row distance, maximum gap width of the gaps, gap angle, angle of the outwardly projecting members with respect to a normal to the longitudinal axis, and overlap of the gaps for the first securing mechanism, is selected to be different from a set including the characteristics of the length of the outwardly projecting member, width of the outwardly projecting member, row distance, maximum gap width of the gaps, gap angle, angle of the outwardly projecting members with respect to a normal to the longitudinal axis, and overlap of the gaps for the second securing mechanism.

In at least one embodiment, the overlap of one of the first and second securing mechanisms is 100%.

In order to provide an even greater maximum stable output of the hearing aid device to which the securing mechanism is mounted (or integral therewith), but still retain the benefits of open air design over at least a portion of the device and also provide increased comfort to the wearer, as described above, hearing aids 10 having a securing mechanism that includes a securing portion and a blocking portion as described herein are provided. FIG. 24A is a perspective side view of a securing mechanism 10*e* that includes a securing portion 202 and a sound blocking portion 204, according to an embodiment of the present invention.

Although the outwardly projecting members 120 used in FIG. 24A are of the type and arrangement of outwardly projecting members 20 shown in FIGS. 8-9, it is noted that any of the other alternative embodiments of outwardly projecting members as described herein could be substituted in whole or in part, while maintaining air channels 13 to allow air flow between the walls of an inner space or opening and the securing portion 202 to provide benefits, such as being substantially more comfortable and allowing for longer wear time, maintaining air circulation within the ear canal, and/or minimizing the potential for development of hot spots that often occur in devices that block the ear canal. Although the embodiments of FIGS. 24A-27C are described for use a hearing aid device, it is noted that the securing mechanism embodiments of FIGS. 24A-27C, like the embodiments described above, can alternatively be used with headset speakers or other space access devices as described herein.

Figure 24B:
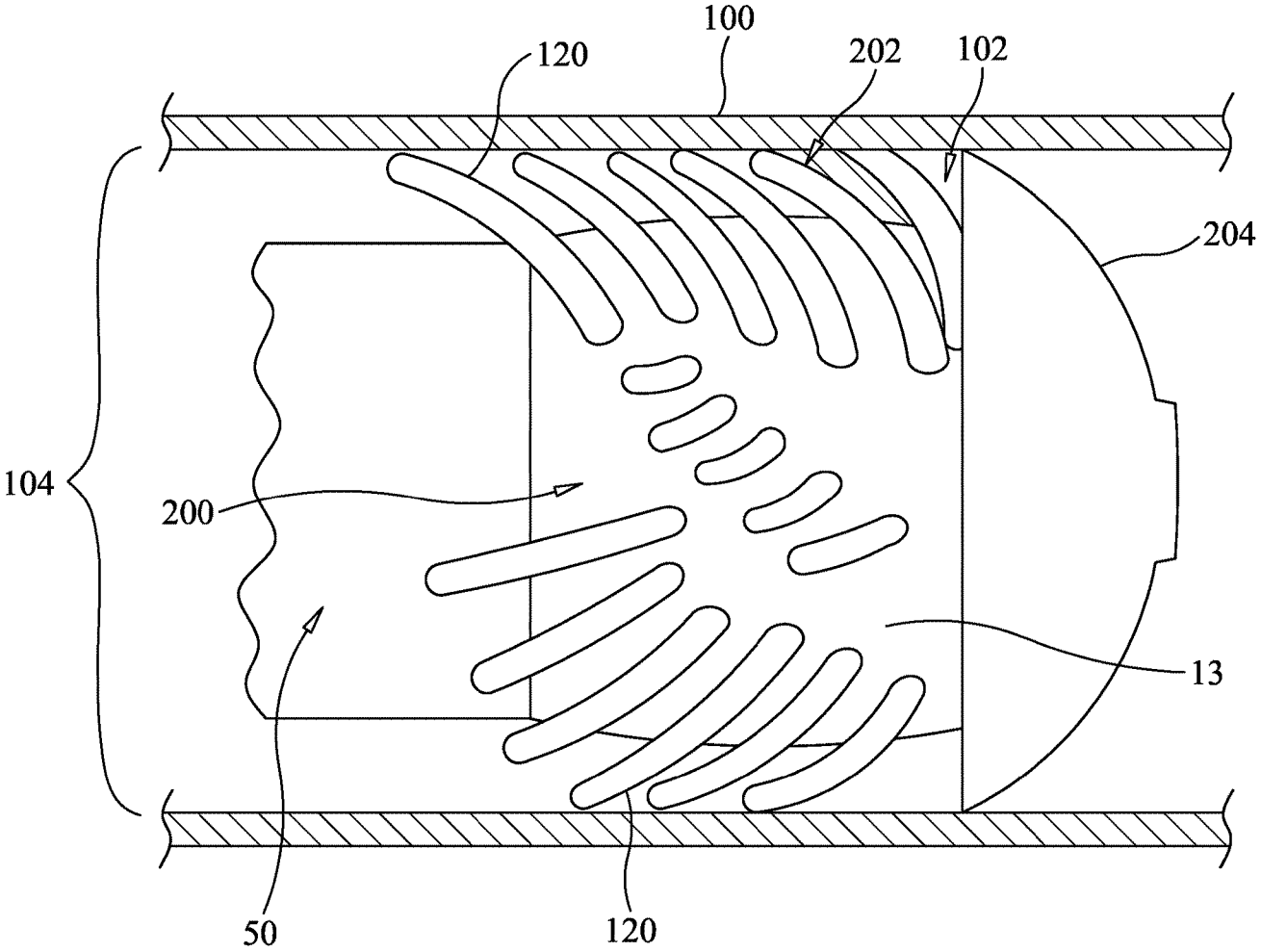
FIG. 24B is an illustration of the securing mechanism shown in FIG. 24A disposed in an internal anatomical space, according to an embodiment of the present invention.

In the embodiment of FIGS. 24A-24B, sound blocking portion 204 may be attached to or integral with a distal end portion of the securing mechanism 10*e*. Blocking portion 204 may be made of the same material as outwardly projecting members 120 and/or the main body of the securing mechanism, or may be made from a different material selected from any of the materials described previously in this disclosure. In one preferred embodiment, the blocking portion, main body and projecting members are all molded from silicone. The hardnesses of the components may be the same or different and may each be in the range from about 20 durometer Shore A to about 80 durometer Shore A, preferably from about 30 to 60 durometer Shore A. In one example, the components were molded from platinum-cured silicone have a hardness of 60 durometer Shore A. In another example, the components were molded from platinum-cured silicone having a hardness of 40 durometer Shore A.

Because the securing portion 202 provides the primary anchoring forces for holding the securing mechanism 10*e* in place in an inner space or opening, the outside diameter (for a sound blocking portion 204 having a circular cross-section) or largest cross-sectional dimension of the sound blocking portion 204, in a direction normal to the longitudinal axis 15 of the securing mechanism 10*e*, when in a relaxed configuration as shown in FIG. 24A, can be significantly less than an outside diameter, or largest cross-sectional dimension, in a direction normal to the longitudinal axis 15, of the securing portion 202/outwardly projecting members 120 when in the relaxed configuration. For example, the largest cross-sectional dimension 206 (outside diameter in this case, since the cross-section of this embodiment is circular) of sound blocking portion 204 in a direction normal to axis 15 in the embodiment of FIG. 24A may be in the range from about 6 mm to about 11 mm, preferably in a range from about 7 mm to about 11 mm, more preferably from about 8 mm to about 10 mm. The largest cross-sectional dimension 208 of securing portion 202/outwardly projecting members 120 may be in the range from about 10 mm to about 17 mm, preferably in a range from about 11 mm to about 16 mm. In one example, dimension 206 was about 8 mm and dimension 208 was about 12 mm. In another example, dimension 206 was about 8 mm and dimension 208 was about 15 mm. In another example, dimension 206 was about 10 mm and dimension 208 was about 15 mm. The blocking portion 204 in FIG. 24A comprises a dome or other continuous member that seals with the opening or internal space, such as a disk, saucer or the like. The sound blocking portion 204 may be made of the same materials as that of the securing portion 202 or of the outwardly extending members 120 or may be made from one or more different materials. Further, the blocking portion may have the same or different hardness relative to the securing portion 202 or outwardly projecting members 120, whether or not made of the same material.

FIG. 24B illustrates the securing mechanism 10*e* attached to a space access device 50 (schematically represented) having been inserted into opening or internal space 100. The outwardly projecting members 120 are designed and adapted to conform or self-adjust to the shape of the interior surface of the opening (or interior space) 100 of a member (biological or non-biological) when the securing mechanism (typically, but not necessarily attached to an access device) of the invention and, thereby, the projecting members 120 are inserted in the opening 104 (e.g., see opening and interior space formed by tube 100 in FIG. 24B, illustrating an internal anatomical space) thereby putting the projecting members 120 into a constrained configuration. FIG. 24B also shows that the sound blocking portion 204 distorts or compresses only negligibly, or not at all, as the sound blocking portion 204 need only create a seal around the internal wall of the interior space 100, since the securing portion 202 performs the anchoring function via the outwardly projecting members 120 to maintain the securing mechanism 200 and space access device 50 in a desired position and orientation. As noted, because the primary function of the sound blocking portion is to seal against the internal wall, a much lower pressure is required to accomplish this function, as compared to the pressure applied by the outwardly projecting members 120 to perform the anchoring function. By not requiring the sound blocking portion 204 to perform the primary anchoring function of the securing mechanism 200, this allows the sound blocking portion 204 to form a gentle seal with the internal wall and does not require significant deformation of the sound blocking portion 204 as it contacts the internal wall 100. This not only provides greater comfort to the wearer/user, but it also prevents the formation of buckles or pleats that can potentially form when a dome is deformed to the extent necessary to provide sufficient anchoring pressure. Therefore a more reliable seal is formed by the sound blocking portion 204 with the internal wall, with a much reduced risk of forming buckling, pleating or any other imperfections along the seal that could allow some sound passage through the interface between the sound blocking portion 204 and the inner wall 100.

The air channels 13 remain in the securing portion 202 even after the insertion of the securing mechanism 200 into the internal opening 104 and space 100, as illustrated in FIG. 24B. This provides benefits, such as being substantially more comfortable and allowing for longer wear time, maintaining air circulation within the ear canal, and/or minimizing the potential for development of hot spots that often occur in devices that block the ear canal. Although the air channels 13 do not extend through the seal between the sound blocking portion 204 and the internal wall 100, the fact that the sound blocking portion 204 does not need to provide an anchoring function allows a much more gentle sealing pressure to be applied by the sound blocking portion 204 to the internal wall which enhances the comfort of the wearer and provides for longer wear time relative to devices that employ a dome to anchor the device.

The securing mechanism 10*e* includes a lumen 248 that is configured to slide over a mating portion of a space access device in any of the same manners described above with regard to lumen 18 of FIGS. 2-5, with the securing portion 202 being slid over the space access device portion so that the sound blocking portion 204 is distal thereof.

Figure 25B:
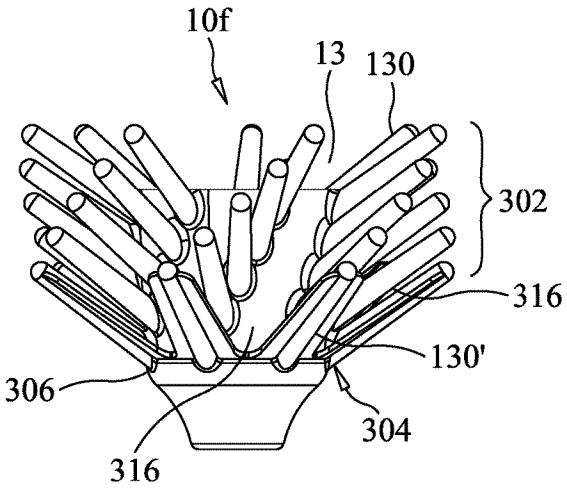
FIGS. 25A-25C are side views of variants of a securing mechanism that includes a securing portion and sound blocking portion, according to another embodiment of the present invention.
Figure 25A:
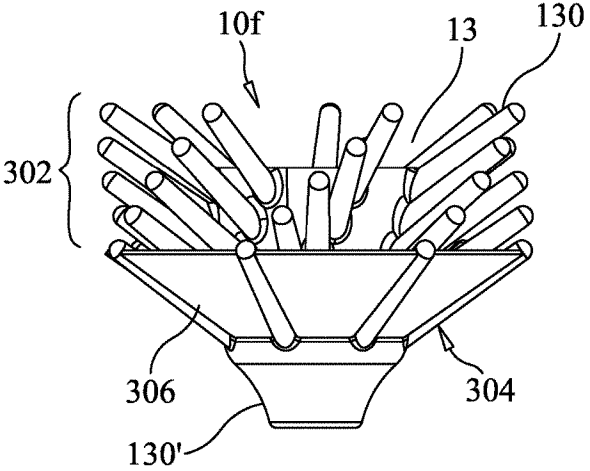
Figure 25C:
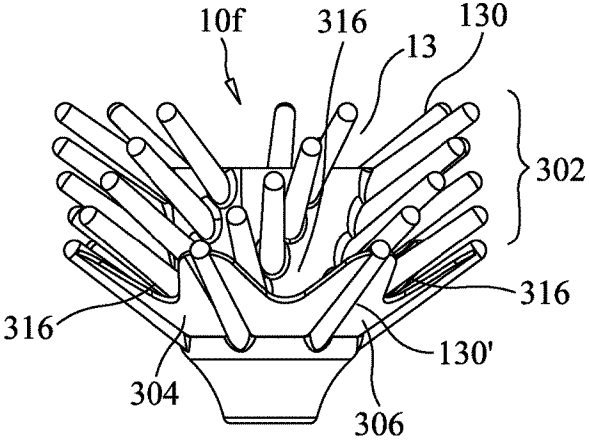

FIGS. 25A-25C are side views of variants of a securing mechanism 10*f* that includes a securing portion 302 and a sound blocking portion 304 that includes skirting 306, according to an embodiment of the present invention and FIGS. 26A-26C are perspective views of the securing mechanisms shown in FIGS. 25A-25C, respectively. Although the outwardly projecting members 130 used in FIGS. 25A-26C are of the type and arrangement of outwardly projecting members 20 shown in FIGS. 8-9, it is noted that any of the other alternative embodiments of outwardly projecting members as described herein could be substituted in whole or in part, while maintaining air channels 13 to allow air flow between the walls of an inner space or opening and the securing portion 302 to provide benefits, such as being substantially more comfortable and allowing for longer wear time, maintaining air circulation within the ear canal, and/or minimizing the potential for development of hot spots that often occur in devices that block the ear canal.

Figure 28A:
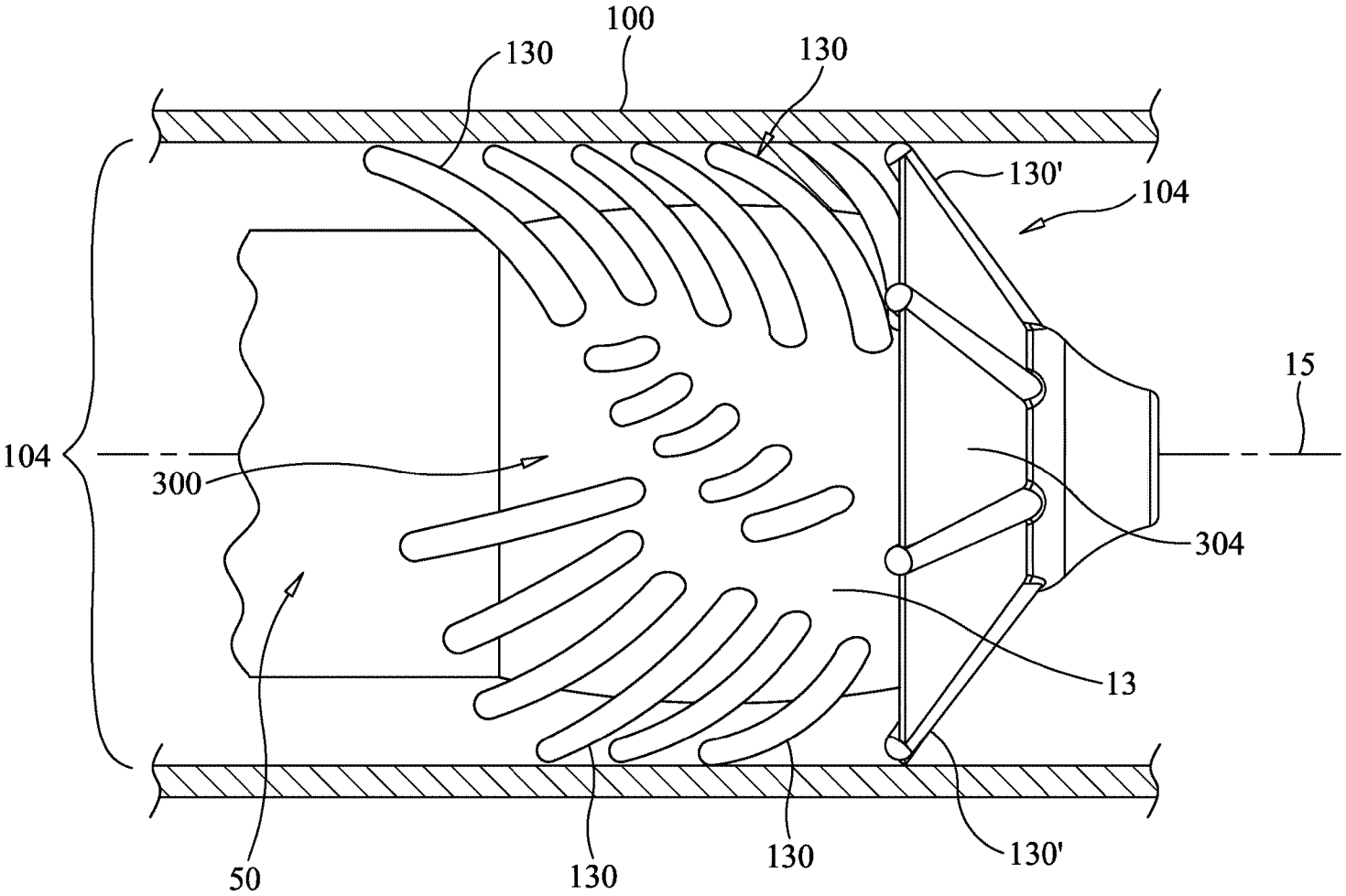
FIG. 28A is an illustration of the securing mechanism of FIG. 25A having been inserted into an opening or internal space.

In the embodiment of FIGS. 25A-26C, sound blocking portion 304 includes skirting formed by skirts 306 attached to outwardly projecting members 130'. Outwardly projecting members 130' may be of the same type and length as outwardly projecting members 130. Alternatively outwardly projecting members 130' may be of a different type that outwardly projecting members 130, including any of the other types and shapes of outwardly projecting members described herein. Further alternatively, the lengths of the outwardly projecting members 130' may be shorter than, longer than or equal to the lengths of the outwardly projecting members 130. For example, in the embodiment of FIG. 25A, where skirting 306 continuously fills the gaps between outwardly projecting members 130' so that the skirting 306 with the projecting members 130' forms a substantially continuous circle at the open end of the sound blocking portion 304 when in the relaxed configuration shown in FIG. 25A and no gaps exist between the projecting members 130' as the spaces that would otherwise exist between the projecting members 130' are closed by the skirting 306, the lengths of outwardly projecting members 130' may be shorter than the lengths of outwardly projecting members 130, so that when the securing mechanism 10*f* is inserted into an internal space or opening, the outwardly projecting members 130' deflect less, or not at all, relative to the amount of deflection of the outwardly projecting members 130 (see FIG. 28A) so that the outwardly projecting members 130 apply pressure to the internal walls that is greater than the pressure applied by projecting members 130' to the internal walls. Because the outwardly projecting members 130' deflect very little, if any, this prevents the occurrence of buckling of the skirting 304 that could cause it to not seal completely all the way around the internal walls 100.

Figure 27B:
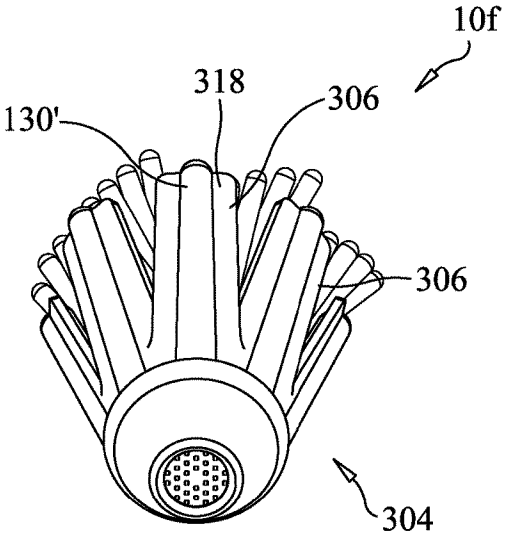
FIGS. 27A-27C are illustrations of the sound blocking portions of FIGS. 26A-26C when in a sound blocking configuration that is taken when the mechanisms of FIGS. 26A-26C, respectively are disposed in an internal anatomical space, according to embodiments of the present invention.
Figure 27C:
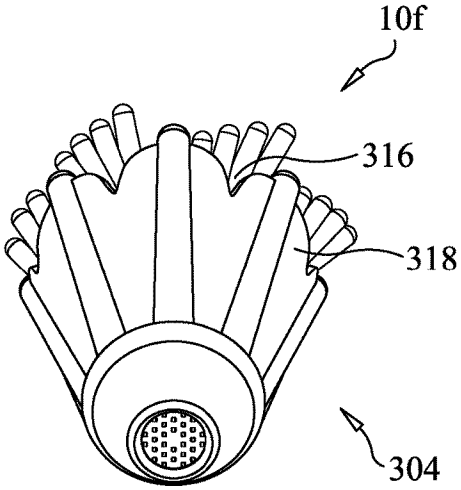
Figure 27A:
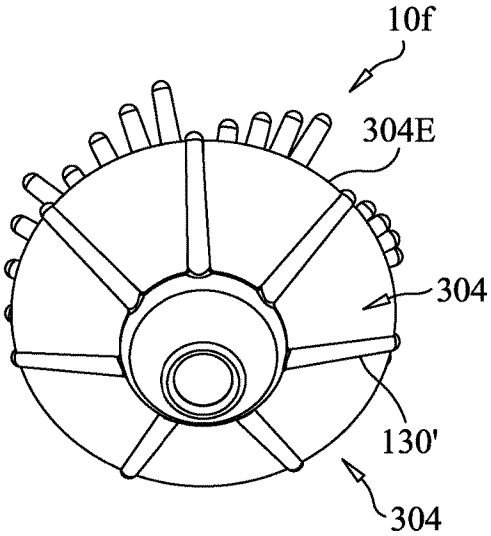

FIG. 27A illustrates an end view of the securing mechanism 10*f* when in a configuration that would occur when the securing mechanism is inserted into an internal space or opening as described and the sound blocking portion 304 forms a seal with the internal walls of the internal space or opening. FIG. 27A shows that no buckling of the edge 306E occurs so that a continuous seal can be formed by the blocking portion 304 and the internal walls of the internal space. Thus the amount of force applied by the outwardly projecting members 130' and skirting 306 is sufficient to form a seal around the internal walls 100 to perform the sound blocking function. In this way, this embodiment is similar to the embodiment of FIGS. 24A-24B in the characteristic that the outside diameter (for a sound blocking portion 304 having a circular cross-section) or largest cross-sectional dimension of the sound blocking portion 304, in a direction normal to the longitudinal axis 15 of the securing mechanism 10*f*, when in a relaxed configuration as shown in FIG. 25A, can be significantly less than an outside diameter, or largest cross-sectional dimension, in a direction normal to the longitudinal axis 15, of the securing portion 302/outwardly projecting members 130 when in the relaxed configuration. For example, the largest cross-sectional dimension 206 of sound blocking portion 304 (outside diameter in this case, since the cross-section of this embodiment is circular) in a direction normal to axis 15 in the embodiment of FIG. 25A may be in the range from about 6 mm to about 11 mm, preferably in a range from about 7 mm to about 11 mm, more preferably from about 8 mm to about 10 mm. The largest cross-sectional dimension of securing portion/outwardly projecting members 130 may be in the range from about 10 mm to about 17 mm, preferably in a range from about 11 mm to about 16 mm. In one example, the largest cross-sectional dimension of the blocking portion 304 was about 8 mm and the largest cross-sectional dimension of the outwardly projecting members was about 12 mm. In another example, largest cross-sectional dimension of the blocking portion 304 was about 8 mm and the largest cross-sectional dimension of securing portion/outwardly projecting members 130 was about 15 mm. In another example, the largest cross-sectional dimension of the blocking portion 304 was about 10 mm and the largest cross-sectional dimension of securing portion/outwardly projecting members 130 was about 15 mm.

Figure 28B:
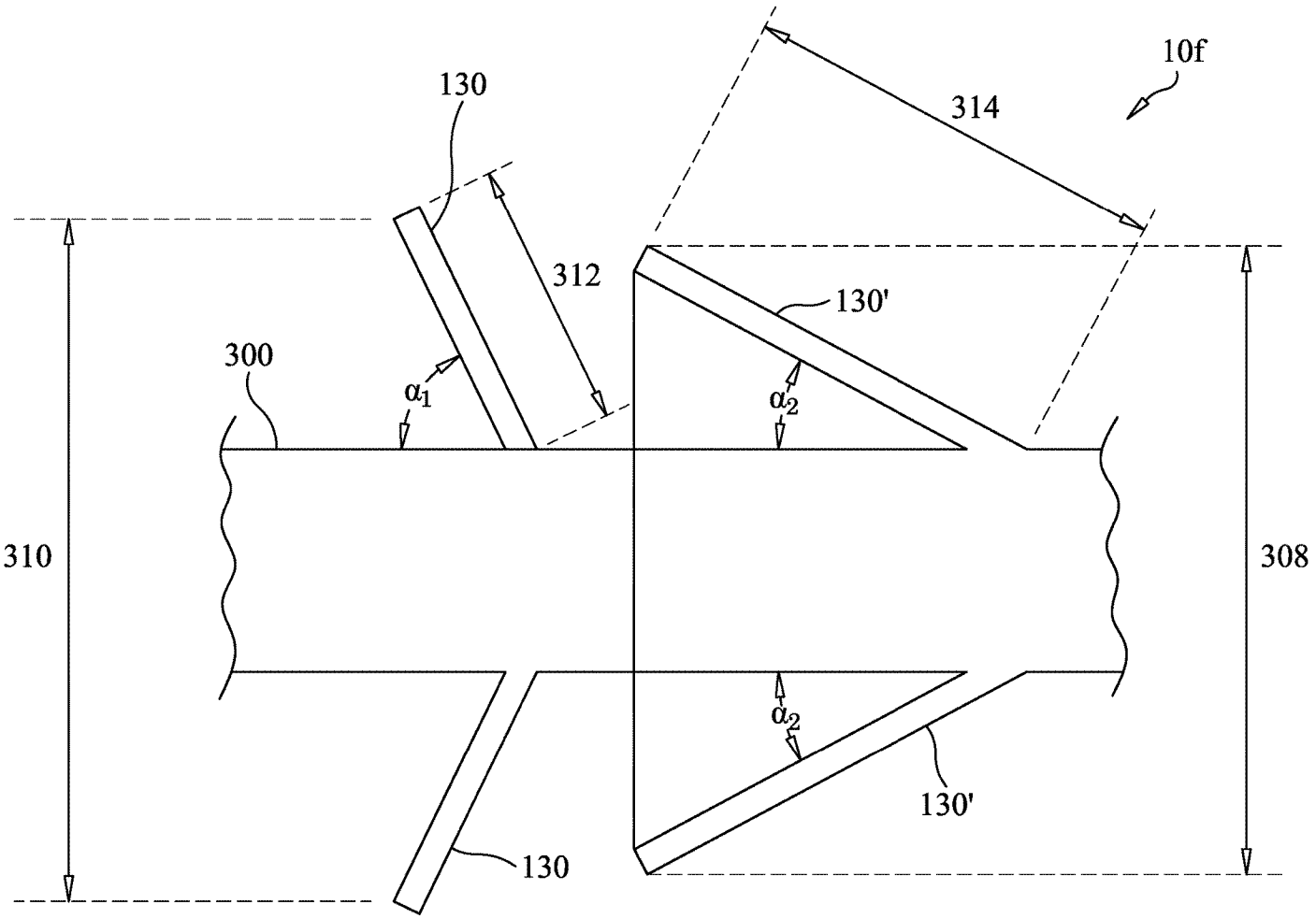
FIG. 28B schematically illustrates an arrangement showing variations between an angle of an outwardly projecting member of the securing portion relative to the body, compared to an angle of an outwardly projecting member of the sound blocking portion relative to the body, according to an embodiment of the present invention.

Further alternatively, the angles formed by the outwardly projecting members 130 and 130' relative to the body 308 of the securing mechanism 10*f* may be different from one another. FIG. 28B schematically illustrates an arrangement in which the angle $\alpha_1$, between the outwardly projecting member 130 and the body 300 of securing mechanism 10*f*, when measured from the proximal side of the outwardly projecting member 130 in a plane the includes the longitudinal axis 15 is greater than an angle $\alpha_2$, between the outwardly projecting member 130' and the body 300 of securing mechanism 10*f*, when measured from the proximal side of the outwardly projecting member 130' in the same plane. As a result, even though the length 314 of member 130' is greater than the length 312 of member 130, the largest cross-sectional dimension 308 of the sound blocking portion 304, in a direction normal to the longitudinal axis 15 of the securing mechanism 10*f*, when in a relaxed configuration as shown in FIG. 28B is significantly less than the largest cross-sectional dimension 310, in a direction normal to the longitudinal axis 15, of the securing portion 302/outwardly projecting members 130 when in the relaxed configuration. Further alternatively, the length 314 could be equal to, or less than the length 312 and the dimension 308 would be even less than dimension 310.

FIGS. 25B-25C illustrate embodiments of securing mechanism 10*f* in which skirting 306 is attached to or integral with projecting members 130' in a manner that only a portion of the spaces between the projecting members 130' is filled when the blocking portion 304/securing mechanism 10*f* is in a relaxed/unbiased configuration, such that gaps 316 exist between skirting portions 306 in locations between the outwardly projecting members 130'. The outwardly projecting members 130' and skirting 306 are configured and dimensioned for a particular size of opening or internal space so that, when the securing mechanism 10*f* is inserted into the opening or internal space, the deflection of the outwardly projecting members 130' against the internal walls of the opening or internal space, cause the folding up of the skirting portions 306 to the extent that they partially overlap one another, as illustrated in the end view of FIG. 27B. Thus, when the securing mechanism is inserted into the opening or internal space, the overlapping skirts 306 eliminate, or nearly eliminate (FIG. 27B) the gaps 316 that exist between the skirts 306 in the relaxed configuration of FIG. 25B and FIG. 26B.

For uses where the opening or internal space is larger than the ones for which the embodiment of FIG. 25B are used, the embodiment of FIG. 25C provides skirting 306 that fills relatively larger areas of the spaces between the outwardly projecting members relative to the area filled by the skirting in FIG. 25B. Gaps 316 are still present in this embodiment, although the skirting 306 can optionally extend continuously between the outwardly projecting members 130' over a distal portion of the spaces.

FIG. 27C illustrates that when the securing mechanism 10*f* is inserted into the opening or internal space, the deflection of the outwardly projecting members 130' against the internal walls of the opening or internal space, cause the folding up of the skirting portions 306 to the extent that they partially overlap one another, as illustrated in the end view of FIG. 27B. Thus, when the securing mechanism is inserted into the opening or internal space, the overlapping skirts 306 eliminate, or nearly eliminate (FIG. 27B) the gaps 316 that exist between the skirts 306 in the relaxed configuration of FIG. 25B. As the skirting 306 is relatively wider than that of the embodiment of FIGS. 25B and 26B, the overlapping is greater in FIG. 27C than in FIG. 27B and the gaps 316 are nearly or completely eliminated.

In these overlapping skirting embodiments, the overlapping portions of the skirting contact one another and close off the flow of air/sound. Ambient sound is effectively prevented from passing through the overlapped skirting, but pressure equalization is permitted by the lack of a complete seal of the skirting relative to the ear canal, as contrasted with the substantially complete seal that the dome 204 or full skirting of FIG. 25A provides. This permits greater amplification, relative to open air embodiments, especially of lower frequency sounds directed from the space access device toward the tympanic membrane, as the skirting allows pressure buildup in the space between the skirting and the eardrum, but allows this pressure to gradually bleed off and equalize with the ambient pressure. As contrasted with open air designs which very rapidly equalize the pressure in the area of the tympanic membrane with the ambient pressure, these overlapping skirt designs slow down the pressure decrease of the pressure generated by sound entering the space between the skirting and the tympanic membrane, so that more force/sound is effectively transmitted to the tympanic membrane before the pressure equalizes.

Like the embodiment of FIG. 25A, the lengths of the outwardly projecting members of the embodiments of FIGS. 25B-25C may be shorter than, longer than or the same length as the lengths of outwardly projecting members 130, and the angles $\alpha_2$ may be greater than, equal to or less than the angles $\alpha_1$. Unlike the embodiment of FIG. 25A however, the outwardly projecting members 130' are configured to bend or distort significantly, to the extent necessary to cause the skirts 306 to overlap one another so as to eliminate or nearly eliminate the gaps 316. Unlike the embodiments of FIGS. 15-22 which are configured to still allow some degree of air flow/sound through all rows of the veins, the skirt configurations of FIGS. 25B-25C are designed to close off the flow of air/sound therepast, when installed in an opening or internal space. Thus, the overlapping portions of the skirting in FIGS. 27B-27C contact one another and close off the flow of air/sound.

Figure 29:
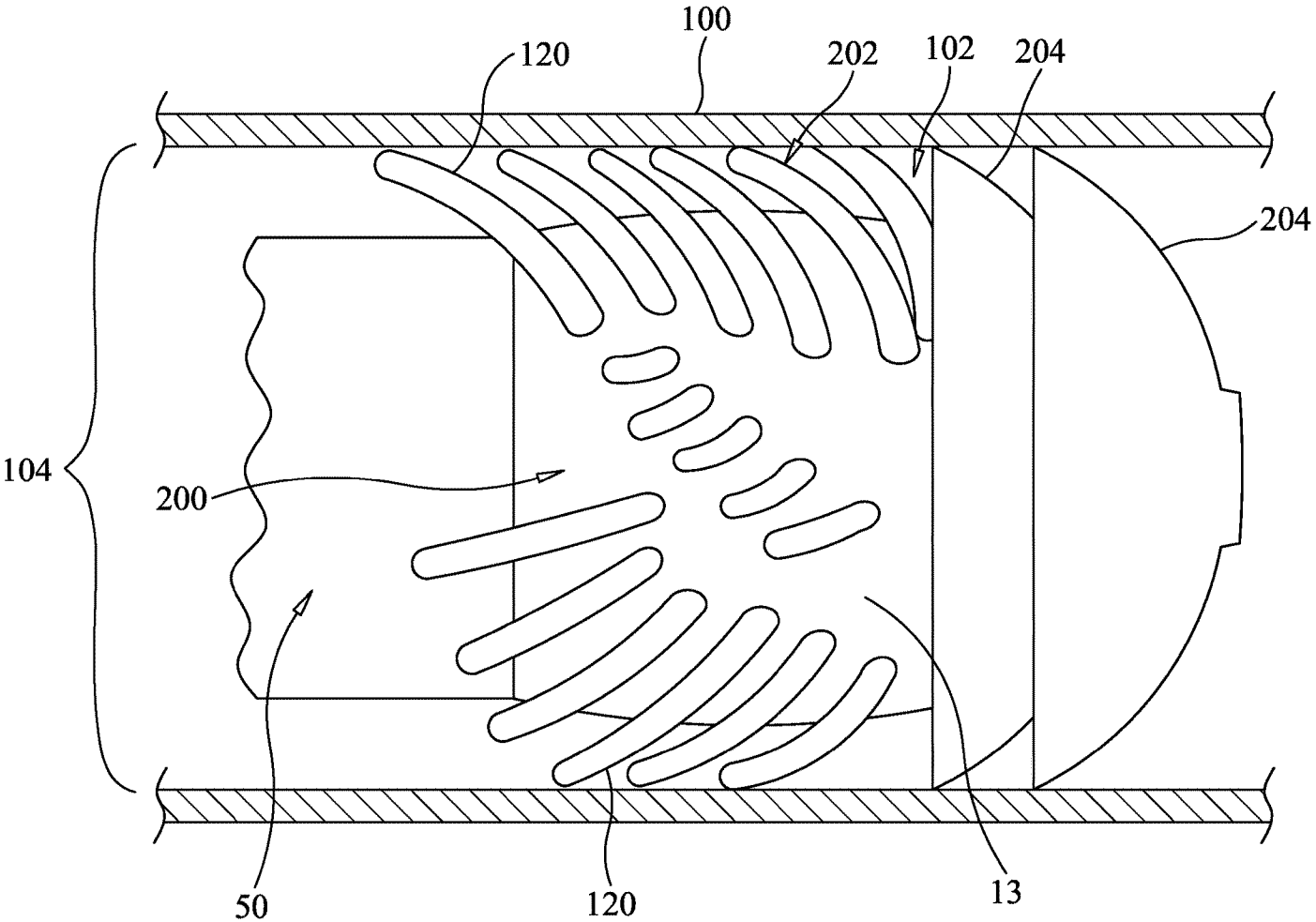
FIG. 29 illustrates a securing mechanism in which the blocking portion includes two domes, according to an embodiment of the present invention.

To provide an even greater blocking of sound, the embodiments described herein may include more than one dome portion 204 or more than one row of outwardly projecting members 130' having skirting 306. FIG. 29 illustrates an embodiment of securing mechanism in which the blocking portion 204 includes two domes. These domes can be made in any manner as that discussed with regard to 204 in the embodiment of FIG. 24 and function similarly, but because two seals are formed with the inner wall, a greater restriction to air/sound flow past the sound blocking portion is provided. It is further noted that this embodiment is not limited to one or two domes, disks, saucers, etc. as three or much such members could be employed in an embodiment of the securing mechanism 10*e*.

Figure 30:
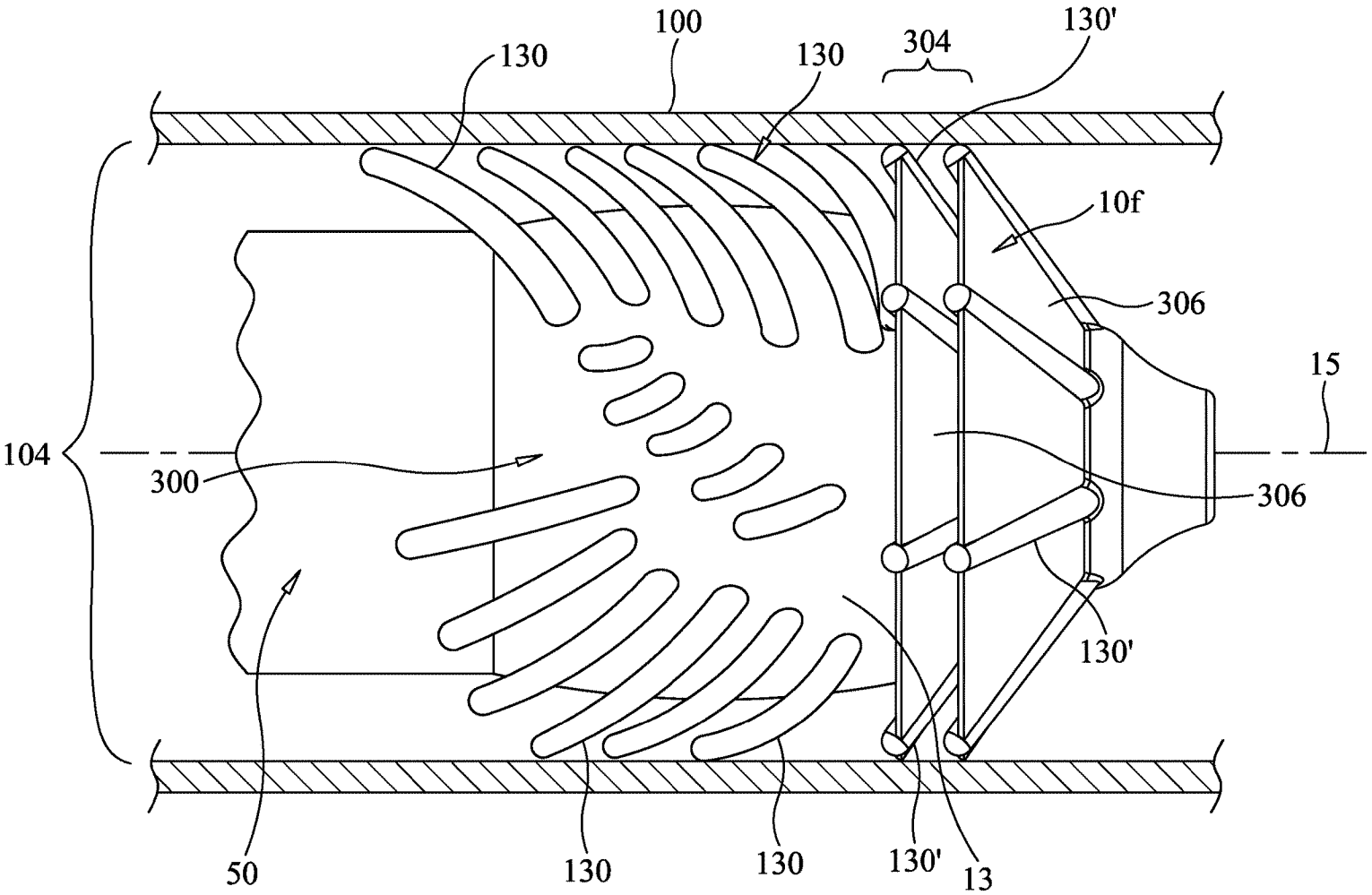
FIG. 30 illustrates a variant of the embodiment of FIGS. 25A, 26A and 27A in which two rows of outwardly projecting members are provided with integrated or attached skirting, according to an embodiment of the present invention.

FIG. 30 illustrates a variant of the embodiment of FIGS. 25A, 26A and 27A in which two rows of outwardly projecting members 130' are provided with integrated or attached skirting 306 that completely fills the spaces between the adjacent member 130' in each of the two rows so that no gaps remain, even when the securing mechanism is in the unbiased configuration. The present invention is not limited to the embodiments shown, as more than two rows, up to all of the rows of outwardly projecting members 130, 130' may be provided with skirting. Furthermore, any of the other types of outwardly projecting members described may be substituted for members 130. Also, the present invention for providing skirting on multiple rows of outwardly projecting members is not limited to providing skirting on adjacent rows, as any combination of rows of outwardly projecting members 130' with skirting and rows of outwardly projecting members 130 without skirting may be provided. For example, every other row of outwardly projecting members could be outwardly projecting members 130' with skirting, with the remaining set of every other row of outwardly projecting members being members 130 with no skirting. In the biased configuration as shown in FIG. 30, both rows of outwardly projecting members 130'/skirting 306 function in the same manner as that described with the single row in the embodiment of FIG. 25A, but because two seals are formed with the inner wall, a greater restriction to air/sound flow past the sound blocking portion 304 is provided.

Because the overlapping skirts 306 of the embodiments of FIGS. 27B-27C may still have relatively insignificant gaps 316 remaining between the skirts 306 when the securing mechanism is inserted into an opening or internal space, the provision of two or more rows of outwardly projecting members 130' having attached or integral skirting as described may be even more beneficial than the benefits added by adding domes or rows to the embodiments of FIGS. 24A and 25A. Furthermore, the outwardly extending members 130' in different rows may be arranged such that the gaps 316 formed between the skirting 306 in one row are offset from the gaps 316 formed between the skirting 306 in another row, when viewed in a direction along the longitudinal axis 15. In this way, when the securing mechanism 10*f* is inserted into an opening or internal space, any remnants of gaps 316 in one row are occluded by skirting 306 in an adjacent row, so that no gaps can be seen when viewing the blocking portion 304 in a direction along the longitudinal axis 15.

Figure 31B:
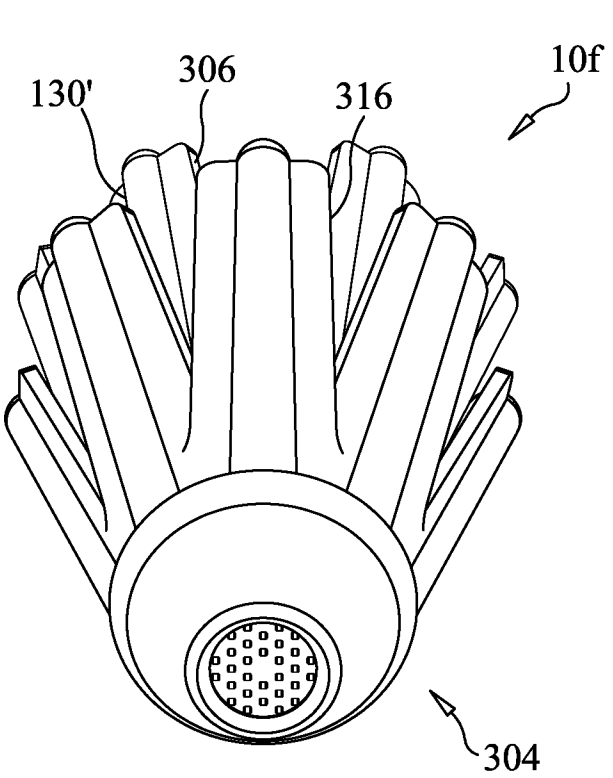
FIGS. 31A and 31B show variants of the embodiments of FIGS. 27B and 27C, respectively, in which two rows of outwardly projecting members are provided with integrated or attached skirting, according to embodiments of the present invention.
Figure 31A:
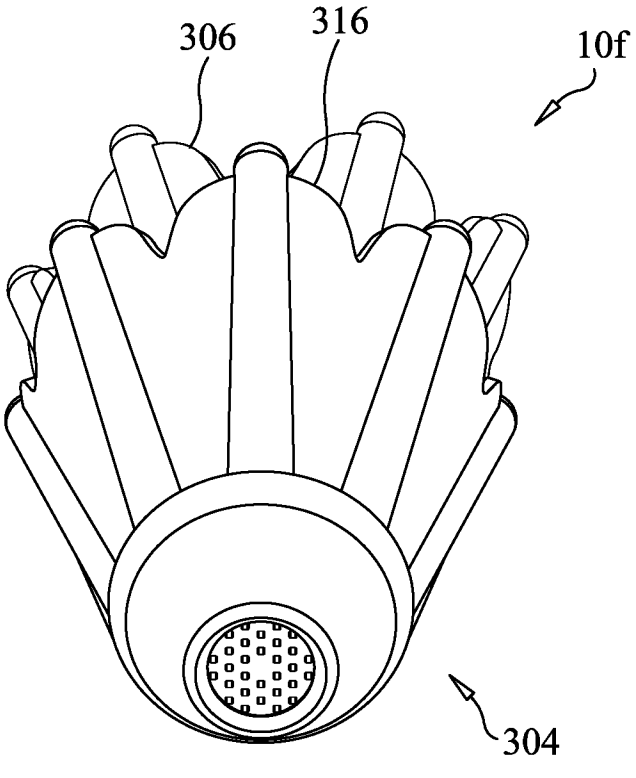

FIGS. 31A and 31B show variants of the embodiments of FIGS. 27B and 27C, respectively, in which two rows of outwardly projecting members 130' are provided with integrated or attached skirting 306 in the manners shown and described in FIGS. 25B and 25C. Because the two rows of outwardly extending members are offset, and gap remnants 316 in the first row are occluded by skirting 306 of the second row as illustrated in FIGS. 31A-31B, when the securing mechanism 10*f* is inserted into the opening or internal space and the outwardly extending members 130' are deformed such that the skirting overlaps in the manner described previously. As a result, a more nearly complete blocking of sound is accomplished by the sound blocking portion 304.

It is further noted that the embodiments of FIGS. 25B, 25C, 26B, 26C, 27B, 27C, 31A and 31B are not limited to one or two rows of outwardly projecting members 130' with skirting 306, as three or much such rows could be employed in an embodiment of the securing mechanism 10*f*. Also, any combination of rows with skirting and rows without skirting can be arranged.

Figure 33:
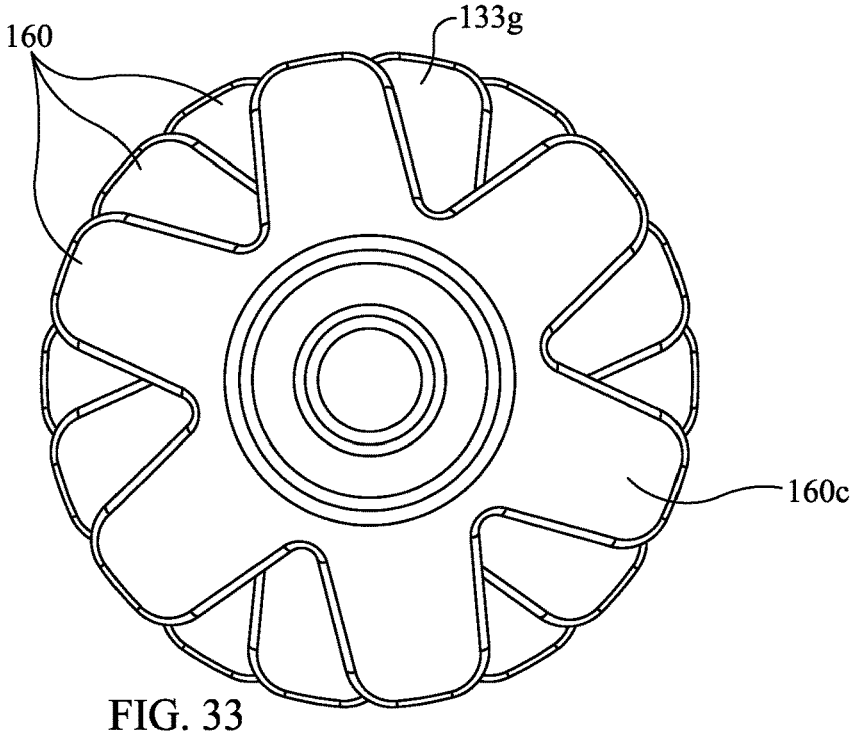
FIG. 33 is a front view of the securing mechanism shown in FIG. 32.
Figure 34:
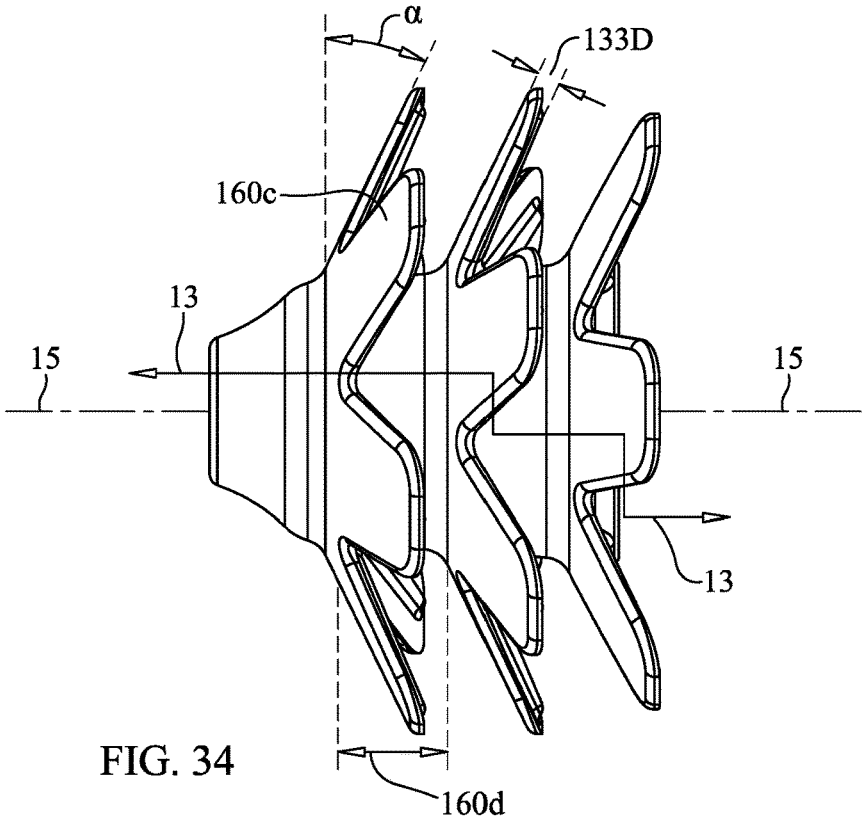
FIG. 34 is a side view showing the contact surfaces of the securing mechanism shown in FIG. 32.

FIGS. 32-35 are various views of a securing mechanism 10*g* according to an embodiment of the present invention. In this embodiment, the outwardly projecting members are formed as leaflets 160 which are flattened members having a width dimension much greater than a depth dimension. The gaps 133*g* between the leaflets 160 in a first row of leaflets 160 of the securing mechanism 10*g* are partially occluded (in the straight line, parallel to longitudinal axis 15 sense) by leaflets 160 in the next adjacent (i.e., second row) of leaflets 160, and then completely occluded by the combination of the leaflets 160 in the second row and leaflets 160 in the third row, as shown in FIG. 33. Likewise, gaps 133*g* between the leaflets 160 in the second row are completely occluded by the leaflets 160 in the first and third rows, and gaps 133*g* between the leaflets 160 in the third row are completely occluded by the leaflets in the first and second rows. This results in very tortuous pathways 13 (see FIG. 34) through which the air and sound waves must travel between locations proximal and distal to the leaflets 160. As a result, although air flow is still allowed into and out of the ear canal to obtain the benefits of an open in-ear hearing aid described previously, the amount of attenuation of high frequency sound waves is quite high, resulting in greater maximum stable output compared to those embodiments described previously. Although the embodiment described requires three rows of leaflets 160 for complete overlay of the gap between leaflets 160 in a single row, the present invention is not limited to this arrangement. Rows of leaflets 160 can be configured with different relative rotational orientations. For example, the rows of leaflets could be arranged so that the second row of leaflets 160 completely block the straight through paths of through the gaps 133*g* in the first row of leaflets 160, similar to the arrangement shown in the embodiment of FIG. 18. Further alternatively, rows may be arranged so that more than three rows of leaflets 160 are required to occlude the straight through path through a gap 133*g* in a direction of the longitudinal axis 15. Still further, although three rows of leaflets 160, each having six leaflets 160 are shown in FIGS. 32-35, the number of rows may vary, and may be one, two, or more than three. Likewise, the number of leaflets 160 per row may be less than or greater than six, such as five, four, three, seven, eight, nine, ten or more. Still further, the number of leaflets 160 per row is typically equal among the rows, but need not be.

The securing mechanism 10*g* in FIGS. 32-35 includes a lumen 48 that is configured to slide over a mating portion of a space access device in any of the same manners described above with regard to lumen 18 of FIGS. 2-5, with the proximal end portion 46 (see FIG. 35) of the securing mechanism 10*g* being slid over the space access device portion before the distal end portion 42. The distal end component 44 may interface with the lip 64L to prevent inadvertent removal of the securing mechanism 10*d* from a space access device once it has been secured in place.

The open area provided by the gaps 133*g* in a row of outwardly projecting members 160 may be in the range of about 0% to 95% or about 5% to about 60% or about 10% to 50% of the total area defined by the members 160 and gaps 133*g* as shown in FIG. 33. In the embodiment shown in FIG. 33, the open area, in the unconstrained configuration as shown is about 35%.

Figure 36:
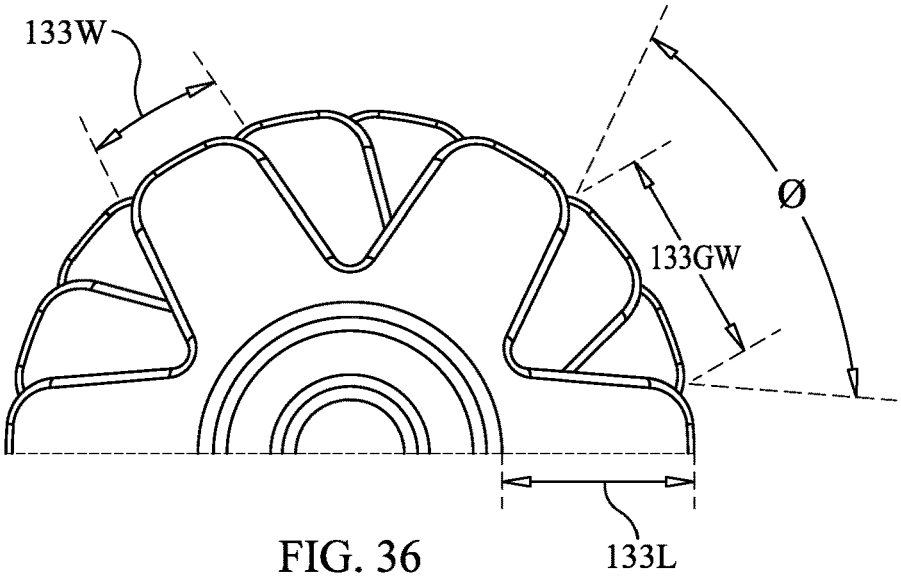
FIG. 36 is a partial front view of the securing mechanism shown in FIG. 32, showing the relationships by and between the securing mechanism leaflets, according to an aspect of the present invention.

Additional factors in achieving greater differential acoustic impedance are the width of the leaflets, the depth of the leaflets, and the width of the gaps between the leaflets. In the embodiment of FIG. 36, the width 133W of the leaflet 160 is a value in a range from about 1.0 mm to 7.0 mm, preferably about 2.0 mm to about 5.0 mm, more preferably about 2.5 mm to about 4.5 mm, and in one specific embodiment was about 3.0 mm. The width 133GW of the gaps 133*g* between the leaflets 160 at their widest is a value in a range from about 1 mm to about 10 mm, preferably about 2 mm to 8 mm, more preferably about 2.5 mm to about 6 mm and in one specific embodiment was about 3 mm. The angle θ of the gaps may range from about 15 to 100 degrees, more preferably 20 to 90 degrees, and in one embodiment was about 45 degrees. The gaps may extend fully or partially to the base. The angle α (FIG. 34) that the leaflets 160 project outwardly at, relative to a normal to the longitudinal axis 15 of the securing mechanism 10*g* is a value in a range from about 0 degrees to about 60 degrees, preferably about 5 degrees to about 50 degrees, more preferably about 10 degrees to about 40 degrees.

The distance 160*d* between the rows of leaflets 160 affects the width of the channel 13 and therefore also directly impacts the amount of high frequency impedance. The distance 160*d* may vary, with narrower distances providing relatively higher high frequency impedance. Distance 160*d* is typically a value in the range of about 0.5 mm to about 8 mm, preferably about 1 mm to about 3 mm and in one specific embodiment was about 2.0 mm.

The leaflets 160 comprise flattened members having a flat contact surface 160*c* configured to contact the surface of the internal space or opening. Leaflets 160 have a thickness or depth dimension 133D that is less than the width dimension 133W. The thickness or depth 133D of leaflet 160 may be a value in the range from 0.05 mm to 2 mm, typically from 0.125 mm to 0.7 mm. The width dimension 133W of leaflet 160 is at least two times greater than the depth dimension 133D, typically in the range from four times to fifty-six times greater, such as at least nine times greater, at least ten times greater, at least eleven times greater, at least twelve times greater, at least thirteen times greater, at least fourteen times greater, at least fifteen times greater, at least sixteen times greater, at least seventeen times greater, at least eighteen times greater, at least nineteen times greater, at least twenty times greater, at least twenty-one times greater, at least twenty-two times greater, at least twenty-three times greater, at least twenty-four times greater, at least twenty-five times greater, at least twenty-six times greater, at least twenty-seven times greater, at least twenty-eight times greater, at least twenty-nine times greater, at least thirty times greater, at least thirty-one times greater, at least thirty-two times greater, at least thirty-three times greater, at least thirty-four times greater, at least thirty-five times greater, at least thirty-six times greater, at least thirty-seven times greater, at least thirty-eight times greater, at least thirty-nine times greater, at least forty times greater, at least forty-one times greater, at least forty-two times greater, at least forty-three times greater, at least forty-four times greater, at least forty-five times greater, at least forty-six times greater, at least forty-seven times greater, at least forty-eight times greater, at least forty-nine times greater, at least fifty times greater, at least fifty-one times greater, at least fifty-two times greater, at least fifty-three times greater, at least fifty-four times greater, or at least fifty-five times greater.

The thin design of the leaflets to have a very small depth dimension as described has been shown to improve the comfort of the wearer of a device using a securing mechanism 10*g*, as compared to a device using a securing mechanism employing thicker outwardly projecting members, and in particular, relative to a device using a securing mechanism that employs bristles have a round cross-section. This comfort advantage is particularly applicable to uses in relatively smaller ear canals, as overlapping of the very thin leaflets 160 can occur to a greater extent than allowed by bristles such as outwardly projecting members having a circular or non-flat cross-section. Thus, the leaflets 160 can overlap more than thicker outwardly projecting members and thereby offer additional acoustic impedance while having the same or reduced bulk when lying down in the ear canal. The thin leaflet cross-sections lie flatter than bristles such as 120 or 130 to reduce device volume and improve fit in smaller ears and exert little pressure, so they are more comfortable and less prone to itchiness across different durometers of silicone (or other materials).

The length 133L of leaflet 160 may be a value in a range from about 2 mm to about 9 mm and in one embodiment was about 4 mm. The length of the rib 162 may be about the same as the length 133L, typically slightly less, or substantially less, but not to extend beyond the length 133L. These size ranges are for the regular size and would be respectively larger for the larger size and smaller for a smaller size. Optionally, the leaflets 160 may be provided without ribs 162, resulting in both the contact surface 160*c* and the opposing surface being substantially flat and smooth. However, this would typically require a relative increase in the depth dimension 133D of the leaflet 160. Further optionally, leaflet 160 may be provided without a discrete rib, but wherein the depth dimension varies, so that it is thinner at the sides of the leaflet and gradually increases to a maximum thickness centrally along the longitudinal axis of the leaflet, or some other intermediate location extending lengthwise of the leaflet. In this case, the contact surface 160*c* would be substantially flat and the opposing surface would protrude along the thickened locations of the leaflet from the locations having the thinner depth dimension.

The securing mechanisms 10*g*, like the securing mechanisms 10*a*, 10*b*, 10*c*, 10*d* are currently made in two sizes, with the large size having an unconstrained diameter having a value in a range from about 13 mm to about 17 mm, preferably from about 14 mm to about 16 mm and in one specific embodiment was about 15 mm. A regular size has an unconstrained diameter with a value in a range from about 10 mm to about 14 mm, preferably about 11 mm to about 13 mm and in one specific embodiment was about 12 mm. The length of leaflet 160 may be a value in a range from about 3 mm to about 10 mm and in one embodiment was about 7 mm. As noted, various designs and embodiments of the securing mechanism 10*g* may be provided to have variations in: the width 133W, gap angle θ, width of gap at its widest, how far the gap extends towards the base, length 133L, angle α of outwardly projecting members relative to a normal to the longitudinal axis 15 of the securing mechanism 10*g*, distance between rows of outwardly projecting members in a direction along the longitudinal axis 15, number of rows, and/or amount of overlap of a gap 133*g* in one row by an outwardly projecting member 160 in the next adjacent row and subsequent rows, in a direction aligned with the longitudinal axis 15.

Figure 35:
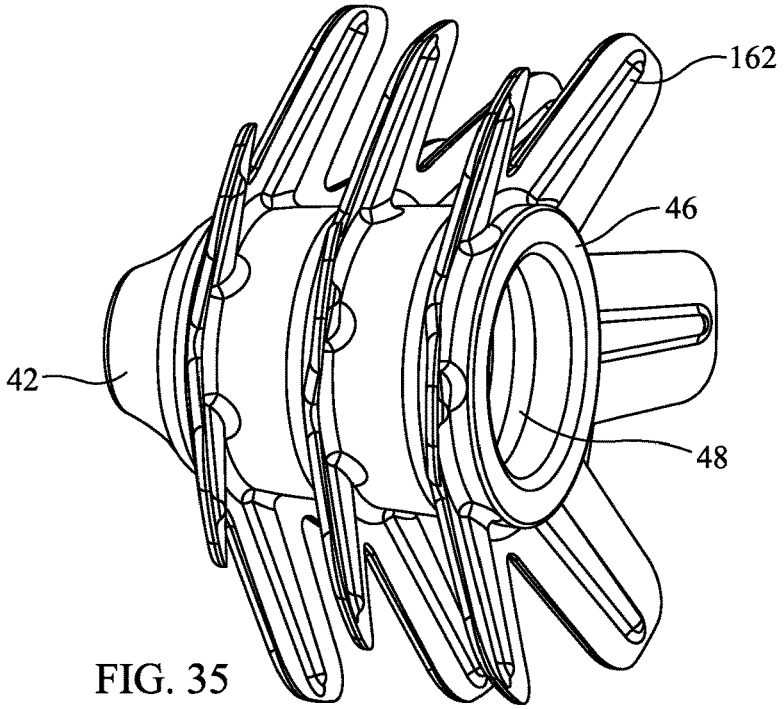
FIG. 35 is a side view showing the surfaces opposite the contact surfaces of the securing mechanism shown in FIG. 32.

Leaflet 160 may be provided with one or more ribs 162 to provide additional resilient force to adjustably contact each leaflet 160 to the surface of the space or opening into which the securing mechanism is inserted. Thus, the leaflets 160 conform to irregularities in the surface of the space or opening in the same manner as illustrated in FIGS. 14 and 19 with respect to other embodiments. Typically a leaflet 160 can be provided with one or more ribs 160. Rib 162 preferably extends centrally along the length direction of the leaflet 160, as shown in FIG. 35. The cross-sectional thickness (diameter, for ribs 162 with circular cross-section) may be varied in order to tune an amount of force that the leaflet is configured to exert against the surface of the space or opening. Rib 162 may extend from the surface of the leaflet 160 that is opposite the flat contact surface 160*c* but does not protrude from the flat contact surface 160*c*. The central placement of the rib 162 ensures that there is no overlapping of the rib 162 when the thin portions of the leaflets 160 overlap upon insertion into the space or opening. This maintains a lower profile of the overall device, which is advantageous in allowing more space to be left open. This is most noticeable with smaller ear canals.

Figure 39:
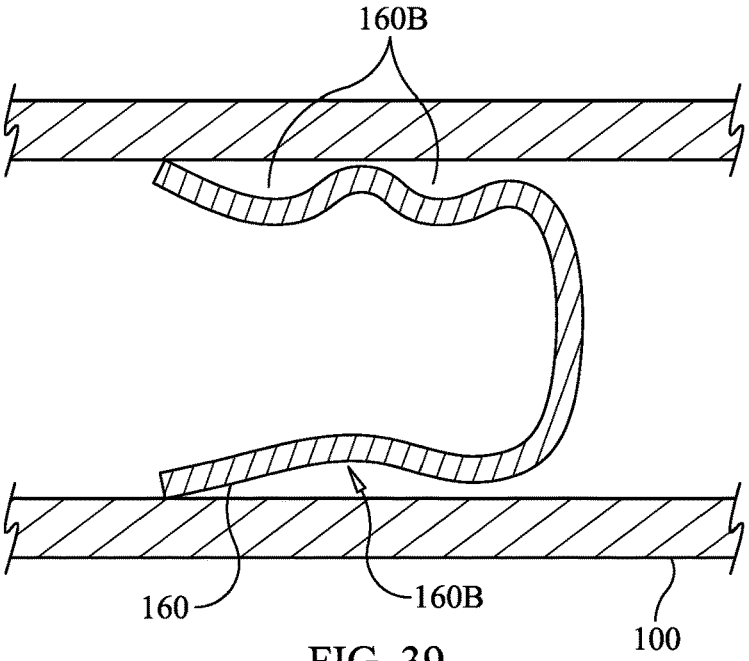
FIG. 39 schematically illustrates buckling of leaflets during removal of a securing mechanism, according to an embodiment of the present invention.

The flattened leaves of leaflets 160 allow for more asymmetric insertion force relative to removal force. That is, the minimal force required for insertion of a device with securing mechanism 10*g*, relative to the minimal force required for removal of the device with securing mechanism 10*g* is significantly less than the ratio of the minimal force required for insertion versus removal of a device with a securing mechanism using bristles having a circular cross-section relative to the minimal force required for removal of the device with a securing mechanism employing bristles having a circular cross-section. Advantageously, this further reduces the risk of device migration out of the ear during normal usage. The buckling of the leaflet 160 resulting from application of removal force (see illustration I FIG. 39) likely results in the asymmetry in insertion versus removal force, as the leaflets 160 resist removal by remaining in contact with the surface 100 and additional force is absorbed by the buckling action of the leaflets 160. Outwardly projecting members that have a circular cross-section can rotate during buckling. In contrast, the leaflets 160 have fewer degrees of freedom in buckling, which causes an increase in buckling force and an increase in force asymmetry.

As in other embodiments the individual articulation of the outwardly projecting members 160 allows better control of and less variation in pressure on the ear canal wall or other surface of a space or opening that the members 160 contact. Optionally members 160 in any given row can be cut out from a continuous skirt of material, or can be molded as shown. The individual leaflets 160 in a row reduce pleating when folded down upon insertion into a space or opening, relative to a continuous skirt or skirt with partial cutouts. Pleating causes pressure points and can cause greater variability and a less predictable performance in acoustic impedance across different ear canal shapes and sizes, as well as during different insertions of the same device, as seating of the device is not exactly reproducible with each insertion. Since the individual leaflets reduce pleating, that lie relatively flatter in all of the variations, as compared to other types of securing devices, such as a dome, for example.

As noted above, the provision of two or more rows of leaflets 160 allows for the design of tortuous pathways 13 for sound and air to pass through, between the walls of the ear canal and the securing mechanism 10*g*. Variations in the arrangement of the leaflets 160, which may include one or more of: number of leaflets per row, number of rows, depth (thickness) of the leaflets, mass of the leaflets, surface finish of the leaflets, percentage of open space/size of gaps 133*g*, distances between rows, number of rows of leaflets 160 to close off a gap in a row, width of leaflet 160, allows for tuning of desired non-uniform acoustic impedance: for example, to provide more high frequency acoustic impedance versus low and/or mid frequency impedance. Further, the leaflets 160 embodiment can add acoustic impedance in frequencies with greater amplification or greater likelihood of feedback, while still allowing for good heat and moisture control in the ear canal and minimizing the feeling of occlusion in the ear. The individually, automatically adjustable leaflets 160 help align the distal end portion of the device in the ear to point towards the tympanic membrane.

In the embodiment of FIGS. 32-39, the gap 133*g* is completely overlapped by members 160 of the next two adjacent rows as illustrated in FIG. 33, which provides this embodiment with greater differential acoustic impedance performance than an embodiment in which only 95%-99% or 90%-95% or 80% to 90% or 70% to 80% or 60% to 70% or 50% to 60% or less than 50% of the gap 133*g* is overlapped by the members of the next two successive rows. The greater the degree of overlap, the greater the degree of the differential acoustic impedance and overall acoustic impedance that results. For example, a securing mechanism 10*g* arranged such that a gap 133 in a first row of leaflets 160 is completely occluded or overlaid upon reaching the third row of leaflets 160 in a straight line direction aligned with the longitudinal axis 15 (as in FIG. 33), will exhibit less differential acoustic impedance than an arrangement where complete occlusion or overlapping is accomplished by the leaflet 160 in the second row of leaflets 160 that is immediately adjacent the first row of leaflets 160. Similarly, if a gap 133*g* is not fully occluded until reaching a leaflet 160 in a fourth row of leaflets 160, then this arrangement would provide even less differential acoustic impedance than the example where complete occlusion occurs by the third row. There is a continuum of the amount of differential acoustic impedance that can be achieved by a securement mechanism as described herein, with one of the factors that the continuum is dependent upon being the amount of overlapping or occlusion of a gap 133*g* by next adjacent row and subsequent row leaflets 160. In addition to the physical arrangement and location of the leaflets 160 of one row relevant to the next adjacent and subsequent rows, the widths 133W of the leaflets and gaps 133*g* also play important roles in changing the differential acoustic impedance properties, where wider leaflets 160 result in greater differential acoustic impedance and narrow gaps 33G result in greater differential acoustic impedance properties.

Also, the differential acoustic impedance characteristics of a securing mechanism increase as the width or cross-sectional dimension of the air channels 13 decreases. Thus, the embodiment of FIG. 34 could be provided with even greater differential acoustic impedance characteristics by moving the rows of the leaflets 160 closer together along the direction of the longitudinal axis 15. Conversely, moving the rows of leaflets 160 further apart from one another along the direction of the longitudinal axis 15 would increase the width or cross-sectional dimension of the air channels and thereby decrease the differential acoustic impedance characteristics of the securing mechanism 10*g*.

Figure 37:
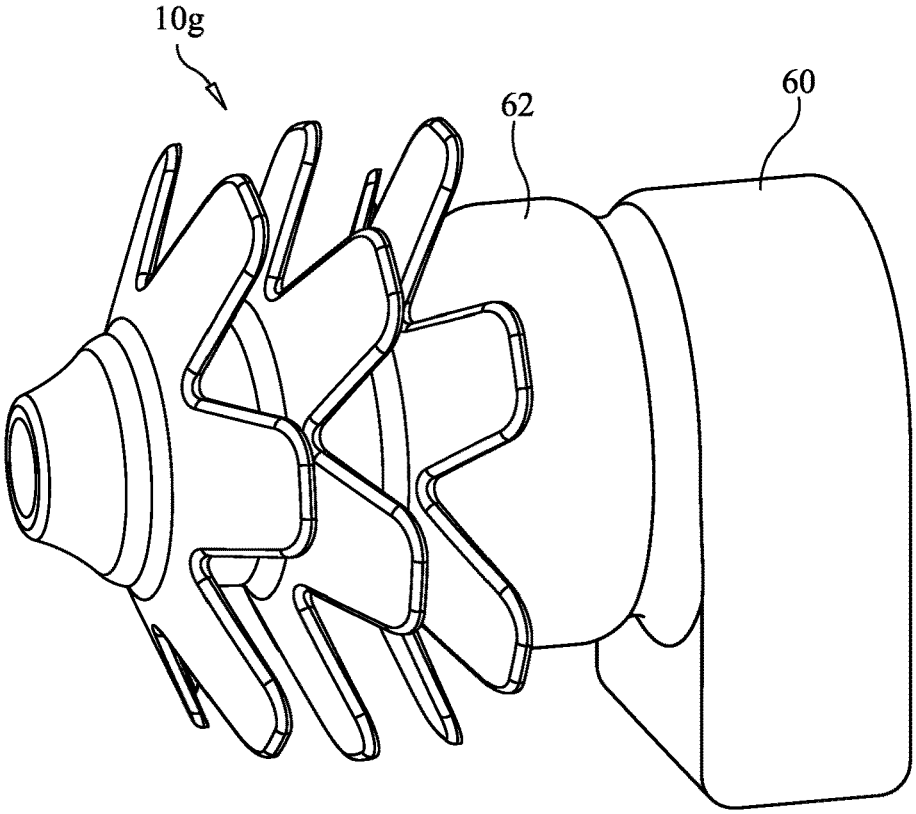
FIG. 37 is a side view of the hearing device shown in FIG. 6 having the securing mechanism shown in FIG. 32 disposed thereon, according to an aspect of the present invention.

FIG. 37 illustrates a securing mechanism 10*g* having been removably attached to a distal end portion of a hearing aid device 60 according to an embodiment of the present invention. As mentioned previously, the outwardly projecting members 160 could alternatively be permanently mounted to extend from the housing of the hearing aid device 60 or be made integral therewith.

FIG. 38 illustrates a securing mechanism 10*d* having been removably attached to a distal end portion of a housing 72 of headphone 70 according to an embodiment of the present invention. As mentioned previously, the outwardly projecting members 160 could alternatively be permanently mounted to extend from the housing 72 of the headphone 70 or be made integral therewith.

Figure 40:
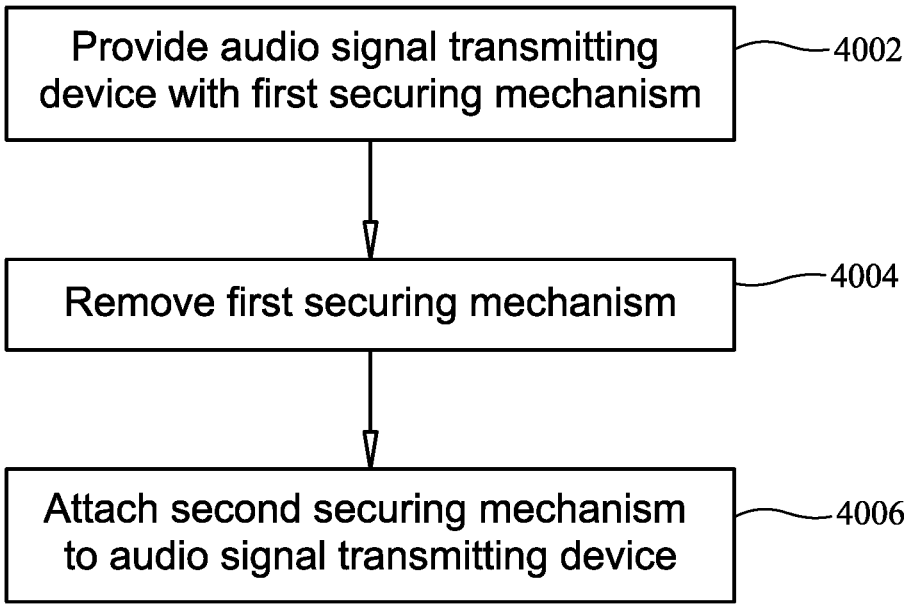
FIG. 40 illustrates events that may be carried out in a method to change an amount of force applied by a securing mechanism to a surface of an internal space or opening, according to an embodiment of the present invention.

FIG. 40 illustrates events that may be carried out in a method to change an amount of force applied by a securing mechanism to a surface of an internal space or opening, according to an embodiment of the present invention. At event 4002, an audio signal transmitting device with a first securing mechanism attached thereto and configured to contact the surface of the internal space or opening into which the securing mechanism is inserted. The first securing mechanism comprises first leaflets 160 arranged circumferentially around a first base and separated by first gaps 133*g*, wherein each first leaflet 160 has a first length dimension 133L extending in a direction radially outwardly from a longitudinal axis 15 of the first securing mechanism, a first width dimension 133W extending transverse to the longitudinal axis 15, a first depth dimension 133D extending normal to the first width dimension 133W, a first flat contact surface 160*c* configured to contact the surface of the internal space or opening and a first rib 162 extending in a length direction of the first leaflet 160. The first width dimension 133W is greater than the first depth dimension 133D. At event 4004, the first securing mechanism is removed from the audio signal transmitting device. At event 4006, a second securing mechanism is attached to the audio signal transmitting device, wherein the second securing mechanism comprises second leaflets 160 arranged circumferentially around a second base and separated by gaps 133*g*. The second leaflet 160 has a second length dimension 133L extending in a direction radially outwardly from a longitudinal axis 15 of the second securing mechanism, a second width dimension 133W extending transverse to the longitudinal axis 15, a second depth dimension 133D extending normal to the second width dimension, a second flat contact surface 160*c* configured to contact the surface of the internal space or opening and a second rib extending in a length direction of the second leaflet 160, The second width dimension 133W is greater than the second depth dimension 133D and the second rib 162 is stiffer than the first rib 162. Alternatively, the second rib 162 may be less stiff that the first rib 162.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective, spirit and scope of the present invention. All such modifications are intended to be within the scope of the claims appended hereto.

That which is claimed is:

1. A securing mechanism for an audio signal transmitting device, comprising:

a base comprising a longitudinal axis and an outer surface; and an adjustable securing mechanism disposed on at least a portion of said base, said securing mechanism being configured to contact a surface of an internal space or opening into which said securing mechanism is inserted;

said adjustable securing mechanism being configured for positioning and maintaining said base at a distance from a location along the internal space or opening; and wherein a least a portion of said adjustable securing mechanism being configured to transition from a first state to a securing state when inserted into the internal space or opening, said securing state comprising at least a portion of said adjustable securing mechanism being constrained to have a smaller dimension transverse to the longitudinal axis relative to a dimension transverse to the longitudinal axis in said first state;

wherein said adjustable securing mechanism comprises a plurality of flattened members, each of said plurality of flattened members having a flat contact surface configured to contact the surface of the internal space or opening;

wherein said flattened members comprise leaflets each having a length dimension extending in a direction radially outwardly from the longitudinal axis, a width dimension extending transverse to the longitudinal axis and a depth dimension extending normal to said width dimension; and wherein said width dimension is greater than said depth dimension.

2. The securing mechanism of claim 1, wherein said width dimension is at least two times greater than said depth dimension.

3. The securing mechanism of claim 1, wherein said depth dimension has a value in the range from 0.05 mm to 2 mm.

4. The securing mechanism of claim 3, wherein said depth dimension has a value in the range from 0.125 mm to 0.7 mm.

5. The securing mechanism of claim 1, wherein said flattened members each further comprise a rib extending in a lengthwise direction of said flattened member.

6. The securing mechanism of claim 5, wherein said rib protrudes from a surface opposite said flat contact surface.

7. The securing mechanism of claim 1 installed on an in-the-ear hearing aid.

8. The securing mechanism of claim 1 installed on an earpiece speaker.

9. The securing mechanism of claim 1, wherein said adjustable securing mechanism is configured to modulate at least one of an amplitude and a frequency of audio signals transmitted through the internal space or opening when said securing means is secured in the internal space or opening.

10. The securing mechanism of claim 1, wherein said adjustable securing mechanism provides differential acoustic impedance when used in conjunction with said audio signal transmitting device and inserted in the internal space or opening.

11. The securing mechanism of claim 1, further comprising a sound blocking portion disposed on at least another portion of said base said sound blocking portion being configured to seal circumferentially around the surface of the internal space or opening.

12. A securing mechanism for an audio signal transmitting device, said securing mechanism comprising:

a base comprising a longitudinal axis and an outer surface; and an adjustable securing mechanism disposed on at least a portion of said base, said securing mechanism being configured to contact a surface of an internal space or opening into which said securing mechanism is inserted;

wherein said adjustable securing mechanism comprises a plurality of rows of leaflets, said leaflets in each said row arranged circumferentially around said base and separated by gaps;

wherein adjacent ones of said plurality of rows are spaced apart from one another in a direction along the longitudinal axis, forming spaces between said rows;

wherein said each said leaflet has a length dimension extending in a direction radially outwardly from the longitudinal axis, a width dimension extending transverse to the longitudinal axis, a depth dimension extending normal to said width dimension and a flat contact surface configured to contact the surface of the internal space or opening; and wherein said width dimension is greater than said depth dimension.

13. The securing mechanism of claim 12, wherein said gaps in a first of said rows are overlapped by said leaflets of an immediately adjacent row by an amount greater than 30% of the gap, in a direction aligned with the longitudinal axis;

wherein said gaps, in combination with said spaces between said rows, form non-straight through channels relative to the longitudinal axis when said securing mechanism is positioned in the internal space or opening.

14. The securing mechanism of claim 13, wherein said gaps in said first row are overlapped 100% by said leaflets of said immediately adjacent row.

15. The securing mechanism of claim 12, wherein said each said leaflet further comprises a rib extending in a lengthwise direction of said leaflet.

16. The securing mechanism of claim 12, wherein said adjustable securing mechanism is configured to perform at least one of: differential acoustic impedance of; modulation of an amplitude of, or modulation of a frequency of audio signals transmitted through the internal space or opening when said securing means is secured in the internal space or opening.

17. A kit comprising a plurality of securing mechanisms for an audio signal transmitting device, each said securing mechanism comprising:

a base comprising a longitudinal axis and an outer surface; and an adjustable securing mechanism disposed on at least a portion of said base, said securing mechanism being configured to contact a surface of an internal space or opening into which said securing mechanism is inserted;

wherein said adjustable securing mechanism comprises a row of leaflets arranged circumferentially around said base and separated by gaps;

wherein said each said leaflet has a length dimension extending in a direction radially outwardly from the longitudinal axis, a width dimension extending transverse to the longitudinal axis, a depth dimension extending normal to said width dimension, a flat contact surface configured to contact the surface of the internal space or opening and a rib extending in a length direction of said leaflet;

wherein said width dimension is greater than said depth dimension;

wherein said ribs of each said securing mechanism have stiffnesses different from said ribs of at least one other of said securing mechanisms.

18. The kit of claim 17, wherein each of said adjustable securing mechanisms is configured to perform at least one of: differential acoustic impedance of; modulation of an amplitude of, or modulation of a frequency of audio signals transmitted through the internal space or opening when said securing mechanism is secured in the internal space or opening; and wherein an amount of said at least one of differential acoustic impedance, modulation of amplitude and/or modulation of frequency of audio signals provided by each said securing mechanism is different from an amount of said at least one of differential acoustic impedance, modulation of amplitude and/or modulation of frequency of audio signals by each of the others of said securing mechanisms.

19. The kit of claim 17, wherein each of said adjustable securing mechanisms comprises a plurality of said rows, wherein said rows are separated by spaces in a direction along the longitudinal axis.

20. The kit of claim 17, wherein said depth dimension of said leaflets of one of said securing mechanisms is different from a depth dimension of said leaflets of another of said securing mechanisms.

21. A method of changing an amount of force applied by a securing mechanism to a surface of an internal space or opening, said method comprising:

providing the audio signal transmitting device with a first securing mechanism attached thereto and configured to contact the surface of the internal space or opening into which said securing mechanism is inserted, wherein the first securing mechanism comprises first leaflets arranged circumferentially around a first base and separated by first gaps;

wherein said each said first leaflet has a first length dimension extending in a direction radially outwardly from a longitudinal axis of the first securing mechanism, a first width dimension extending transverse to the longitudinal axis, a first depth dimension extending normal to said first width dimension, a first flat contact surface configured to contact the surface of the internal space or opening and a first rib extending in a length direction of said first leaflet;

wherein said first width dimension is greater than said first depth dimension;

removing the first securing mechanism from the audio signal transmitting device; and attaching a second securing mechanism to the audio signal transmitting device, wherein the second securing mechanism comprises second leaflets arranged circumferentially around a second base and separated by gaps;

wherein said each said second leaflet has a second length dimension extending in a direction radially outwardly from a longitudinal axis of the second securing mechanism, a second width dimension extending transverse to the longitudinal axis, a second depth dimension extending normal to said second width dimension, a second flat contact surface configured to contact the surface of the internal space or opening and a second rib extending in a length direction of said second leaflet;

wherein said second width dimension is greater than said second depth dimension; and wherein said first rib has a first stiffness, said second rib has a second stiffness, and said first stiffness is unequal to said second stiffness.

22. A securing mechanism for an audio signal transmitting device, comprising:

a base comprising a longitudinal axis and an outer surface; and an adjustable securing mechanism disposed on at least a portion of said base, said securing mechanism being configured to contact a surface of an internal space or opening into which said securing mechanism is inserted;

said adjustable securing mechanism being configured for positioning and maintaining said base at a distance from a location along the internal space or opening; and wherein a least a portion of said adjustable securing mechanism being configured to transition from a first state to a securing state when inserted into the internal space or opening, said securing state comprising at least a portion of said adjustable securing mechanism being constrained to have a smaller dimension transverse to the longitudinal axis relative to a dimension transverse to the longitudinal axis in said first state; and wherein said adjustable securing mechanism comprises a plurality of flattened members, each of said plurality of flattened members having a flat contact surface configured to contact the surface of the internal space or opening; and wherein said flattened members each further comprise a rib extending in a lengthwise direction of said flattened member.

23. A securing mechanism for an audio signal transmitting device, comprising:

a base comprising a longitudinal axis and an outer surface; and an adjustable securing mechanism disposed on at least a portion of said base, said securing mechanism being configured to contact a surface of an internal space or opening into which said securing mechanism is inserted;

said adjustable securing mechanism being configured for positioning and maintaining said base at a distance from a location along the internal space or opening; and wherein at least a portion of said adjustable securing mechanism being configured to transition from a first state to a securing state when inserted into the internal space or opening, said securing state comprising at least a portion of said adjustable securing mechanism being constrained to have a smaller dimension transverse to the longitudinal axis relative to a dimension transverse to the longitudinal axis in said first state;

wherein said adjustable securing mechanism comprises a plurality of flattened members, each of said plurality of flattened members having a flat contact surface configured to contact the surface of the internal space or opening;

said adjustable securing mechanism further comprising a sound blocking portion disposed on at least another portion of said base.

24. The securing mechanism of claim 23, wherein said sound blocking portion is configured to seal circumferentially around the surface of the internal space or opening.

25. The securing mechanism of claim 10, wherein said differential acoustic impedance impedes relatively high range frequencies to a greater extent than a degree to which relatively low range frequencies are impeded.

* * * * *